US005308053A

United States Patent [19]

Toki et al.

[11] Patent Number: 5,308,053

[45] Date of Patent: May 3, 1994

[54] ROTATABLE CASSETTE-TYPE PAPER FEEDING APPARATUS

[75] Inventors: Hirotaka Toki, Kashihara; Hiranaga Yamamoto, Nara; Osamu Wakuda, Yamatotakada; Hiroyuki Nagao, Nara, all of Japan

[73] Assignee: Sharp Kabushiki Kaisha, Osaka, Japan

[21] Appl. No.: 846,173

[22] Filed: Mar. 5, 1992

[30] Foreign Application Priority Data

Mar. 8, 1991 [JP] Japan ..... 3-043798

[51] Int. Cl.[5] ..... B65H 3/44

[52] U.S. Cl. ..... 271/9; 271/164

[58] Field of Search ..... 271/145, 162, 164, 157, 271/158, 9

[56] References Cited

U.S. PATENT DOCUMENTS

| | | | |
|---|---|---|---|
| 4,451,191 | 5/1984 | Torre | 271/157 X |
| 5,002,267 | 3/1991 | Brecy | 271/9 |
| 5,046,715 | 9/1991 | Taniguchi et al. | 271/164 |
| 5,052,671 | 10/1991 | Matsuo | 271/9 |
| 5,065,995 | 11/1991 | Iwamoto et al. | 271/9 |
| 5,076,562 | 12/1992 | Sai et al. | 271/241 X |
| 5,083,767 | 1/1992 | Iwamoto et al. | 271/162 X |
| 5,150,690 | 9/1992 | Kunikawa et al. | 271/162 X |

FOREIGN PATENT DOCUMENTS

| | | |
|---|---|---|
| 0368665 | 5/1990 | European Pat. Off. . |
| 0370836 | 5/1990 | European Pat. Off. . |
| 0400673 | 12/1990 | European Pat. Off. . |
| 56-59245 | 5/1981 | Japan . |
| 56-59251 | 5/1981 | Japan . |
| 56-121059 | 9/1981 | Japan . |
| 59-123859 | 7/1984 | Japan . |
| 59-124634 | 7/1984 | Japan . |
| 60-248532 | 12/1985 | Japan . |
| 60-262735 | 12/1985 | Japan . |
| 2-127328 | 5/1990 | Japan . |
| 2-132021 | 5/1990 | Japan . |
| 2-205861 | 8/1990 | Japan . |
| 2-209327 | 8/1990 | Japan . |
| 2-276730 | 11/1990 | Japan . |
| 2-147434 | 12/1990 | Japan . |
| 2-295824 | 12/1990 | Japan . |
| 2-295825 | 12/1990 | Japan . |
| 2-295826 | 12/1990 | Japan . |
| 2-295827 | 12/1990 | Japan . |
| 2-300020 | 12/1990 | Japan . |
| 2-300021 | 12/1990 | Japan . |
| 2-300022 | 12/1990 | Japan . |
| 2-300023 | 12/1990 | Japan . |
| 2-300024 | 12/1990 | Japan . |
| 2-300025 | 12/1990 | Japan . |
| 2-300026 | 12/1990 | Japan . |
| 2-300027 | 12/1990 | Japan . |
| 2-300028 | 12/1990 | Japan . |
| 2-300030 | 12/1990 | Japan . |
| 2-300034 | 12/1990 | Japan . |
| 2-300035 | 12/1990 | Japan . |
| 2-300036 | 12/1990 | Japan . |
| 2-300037 | 12/1990 | Japan . |
| 2-300038 | 12/1990 | Japan . |

*Primary Examiner*—H. Grant Skaggs
*Assistant Examiner*—Carol Lynn Druzbick

[57] ABSTRACT

A rotatable cassette-type paper feeding apparatus includes a tray, a turning member mounted rotatably on the tray. A first rotating device is used for rotating the turning member, a plurality of paper cassettes installed rotatably on the turning member. A second rotating device is used for rotating the paper cassette in a paper feeding side, and a controller which controls the first rotating device to interchange the paper cassettes in the paper feeding side and in the non-paper-feeding side and which controls the second rotating device to switch the position of the paper cassette in the paper feeding side between sideways and lengthways. This structure achieves a compact rotatable cassette-type paper feeding apparatus capable of storing sheets of paper of various sizes and of feeding the paper sheets both sideways and lengthways by switching their positions.

16 Claims, 49 Drawing Sheets

No. : PATTERN No.

FIG. 24

| CONSTITUENT OPERATIONS OF PATTERNS | | | | SWITCHING |
|---|---|---|---|---|
| No. | BASIC PATTERN | No. | REVERSE PATTERN | |
| 1 | OPERATION 1 | 7 | REVERSE OPERATION 1 | MODE 1<br>↓ ↑<br>MODE 2 |
| 2 | REVERSE OPERATION 2<br>↓<br>OPERATION 4<br>↓<br>OPERATION 3 | 8 | OPERATION 2<br>↑<br>REVERSE OPERATION 4<br>↑<br>REVERSE OPERATION 2 | MODE 1<br>↓ ↑<br>MODE 3 |
| 3 | REVERSE OPERATION 2<br>↓<br>OPERATION 4<br>↓<br>OPERATION 3 | 9 | OPERATION 2<br>↑<br>REVERSE OPERATION 4<br>↑<br>REVERSE OPERATION 3 | MODE 1<br>↓ ↑<br>MODE 4 |
| 4 | OPERATION 1 | 10 | REVERSE OPERATION 1 | MODE 3<br>↓ ↑<br>MODE 4 |
| 5 | REVERSE OPERATION 3<br>↓<br>OPERATION 4<br>↓<br>OPERATION 3 | 11 | OPERATION 3<br>↑<br>REVERSE OPERATION 4<br>↑<br>REVERSE OPERATION 3 | MODE 2<br>↓ ↑<br>MODE 4 |
| 6 | REVERSE OPERATION 3<br>↓<br>OPERATION 4<br>↓<br>OPERATION 2 | 12 | OPERATION 3<br>↑<br>REVERSE OPERATION 4<br>↑<br>REVERSE OPERATION 2 | MODE 2<br>↓ ↑<br>MODE 3 |

ROTATABLE CASSETTE-TYPE PAPER FEEDING APPARATUS

FIELD OF THE INVENTION

The present invention relates to a rotatable cassette-type paper feeding apparatus which is used, for example, in a copying machine.

BACKGROUND OF THE INVENTION

For example, a copying machine is provided with a paper feeding apparatus for feeding paper onto which an image on a document is transferred. There has been a great demand for paper feeding apparatuses that are capable of supplying paper of various sizes according to the sizes of documents to be copied and in response to requests for enlarged and reduced copies. The following are some examples of such paper feeding apparatuses. A paper feeding apparatus disclosed in a Japanese Publication for Unexamined Patent Application, No. 2-295826/1990 has paper cassettes which are disposed over a plurality of stages and capable of switching the position of paper between lengthways and sideways. An apparatus illustrated in FIGS. 53 and 54 is provided with a turntable 51 on which a plurality of paper trays 54 for storing paper 53 are formed by paper guides 52. By rotating the turntable 51 the paper 53 is supplied to the main body of the copying machine from the respective paper trays 54. In the case of an apparatus shown in FIGS. 55 to 57, a plurality of box-shaped paper cassettes 62 are mounted around a rotatable supporting rod 61. In this copying machine, it is arranged that any of the paper cassettes 62 can be selectively placed in front of the paper feeding opening 64 of the main body 63 by rotating the supporting rod 61.

With the configuration of the above-mentioned application, No. 2-295826/1990, paper feeding modes are freely switched between lengthways feeding and sideways feeding. However, since the paper feeding cassettes are disposed over the plurality of stages to feed paper of various sizes, the size of the apparatus is increased. As for the paper feeding apparatus shown in FIGS. 53 and 54, it is unable to switch paper feeding modes freely between lengthways feeding and sideways feeding. Therefore, in order to feed paper of various sizes in both lengthways and sideways, a number of the paper trays 54 must be provided. This also results in an increase in the size of the apparatus. Similarly, the paper feeding apparatus shown in FIGS. 55 to 57 is unable to switch paper feeding modes freely between lengthways feeding and sideways feeding. Additionally, with the configuration of this apparatus, since the paper cassettes 62 are attached to the supporting rod 61 such that the direction of feeding paper is parallel to the axial direction of the supporting rod 61, it is difficult to reduce the height of the apparatus, thereby resulting in a large-sized apparatus.

SUMMARY OF THE INVENTION

An object of the present invention is to provide a compact rotatable cassette-type paper feeding apparatus capable of storing sheets of paper of various sizes and of feeding the paper sheets both sideways and lengthways by switching their positions.

In order to achieve the objective, a rotatable cassette-type paper feeding apparatus of the present invention is characterized in incorporating a tray, a turning member mounted rotatably on the tray, first rotating means for rotating the turning member, a plurality of paper cassettes installed rotatably on the turning member, second rotating means for rotating the paper cassette in the paper feeding side, and controller means which controls the first rotating means to interchange the paper cassettes in the paper feeding side and in the non-paper-feeding side and controls the second rotating means to switch the position of the paper cassette in the paper feeding side between sideways and lengthways.

With this configuration, the position of the paper is freely switched between sideways and lengthways by the second rotating means. In addition, one paper cassette is selected from the plurality of paper cassettes provided on the turning member by the first rotating means. Thus, it is possible to reduce the thickness of the paper feeding apparatus, realizing a compact rotatable cassette-type paper feeding apparatus.

For a fuller understanding of the nature and advantages of the invention, reference should be made to the ensuing detailed description taken in conjunction with the accompanying drawings.

BRIEF DESCRIPTION OF THE DRAWINGS

FIG. 1 is a plan view illustrating a rotatable cassette unit.

FIG. 24 is an explanatory view illustrating operations corresponding to the mode switching patterns shown in FIG. 23, controlled by a microcomputer shown in FIG. 18.

FIG. 52 is an explanatory view illustrating a state in which the rotatable cassette unit shown in FIG. 1 is provided with the space shown in FIG. 51.

FIG. 53 is a schematic plan view illustrating a paper feeding apparatus.

FIG. 54 is a schematic front view illustrating paper feeding according to the paper feeding apparatus shown in FIG. 53.

FIG. 55 is a schematic perspective view illustrating a paper feeding apparatus.

FIG. 56 is a schematic vertical sectional view illustrating one type of installation of paper cassettes on the supporting rod of the paper feeding apparatus shown in FIG. 55.

FIG. 57 is a schematic perspective view illustrating another type of installation of the paper cassettes on the supporting rod of the paper feeding apparatus shown in FIG. 55.

DETAILED DESCRIPTION OF THE EMBODIMENTS

Figure 1:
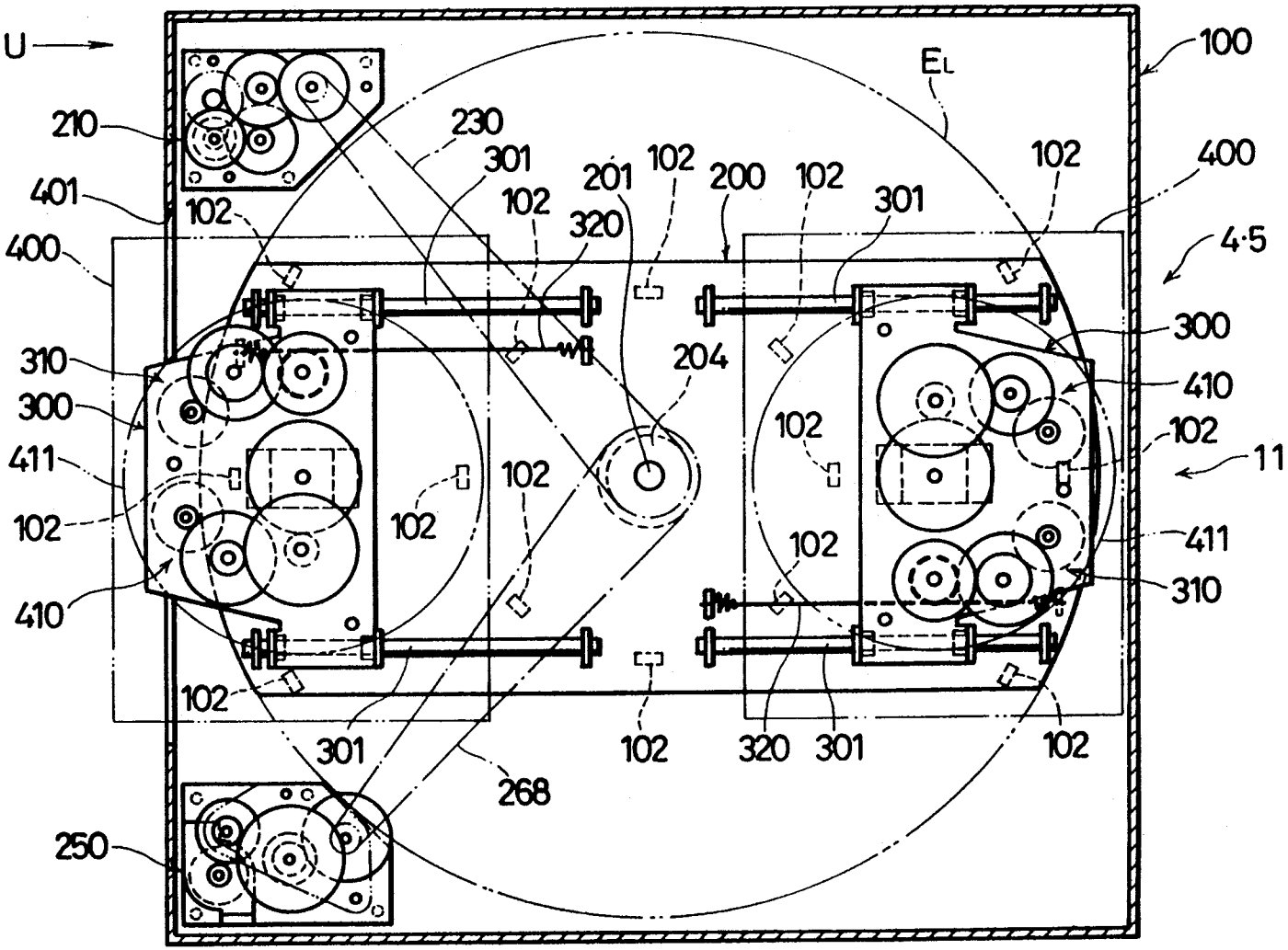
FIGS. 1 to 52 illustrate one embodiment of the present invention.
Figure 52:
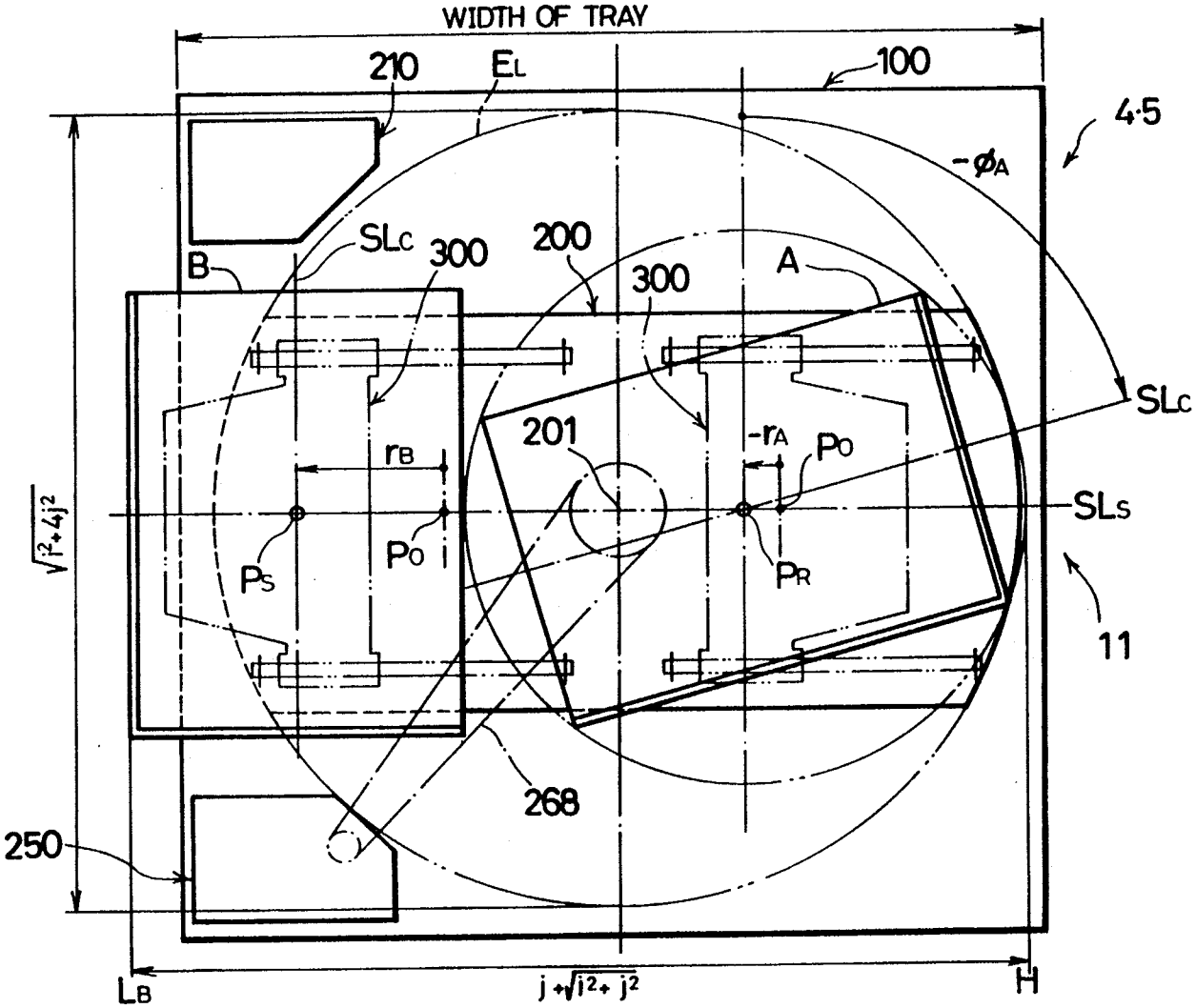
Figure 53:
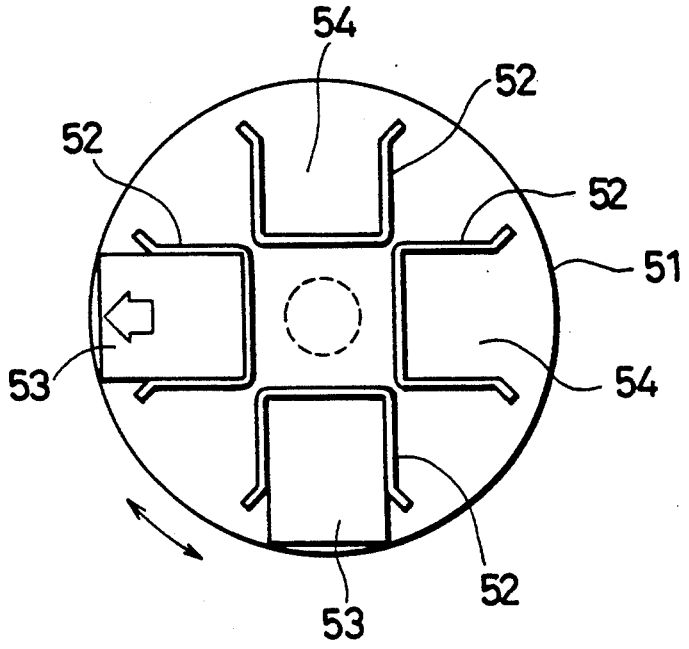
PRIOR ART FIG. 53
FIGS. 53 and 54 illustrate a conventional example.
Figure 54:
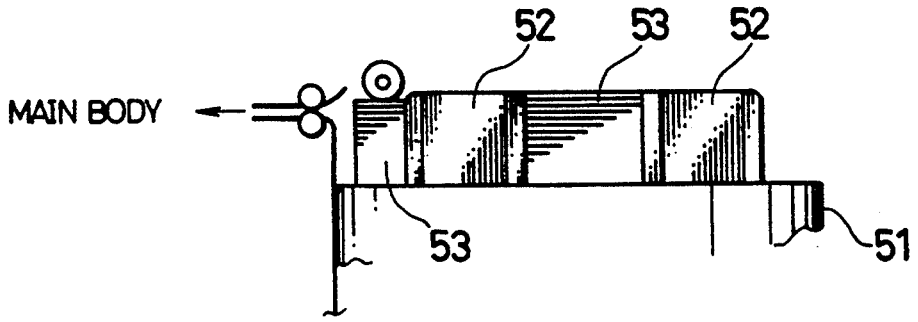
PRIOR ART FIG. 54
Figure 55:
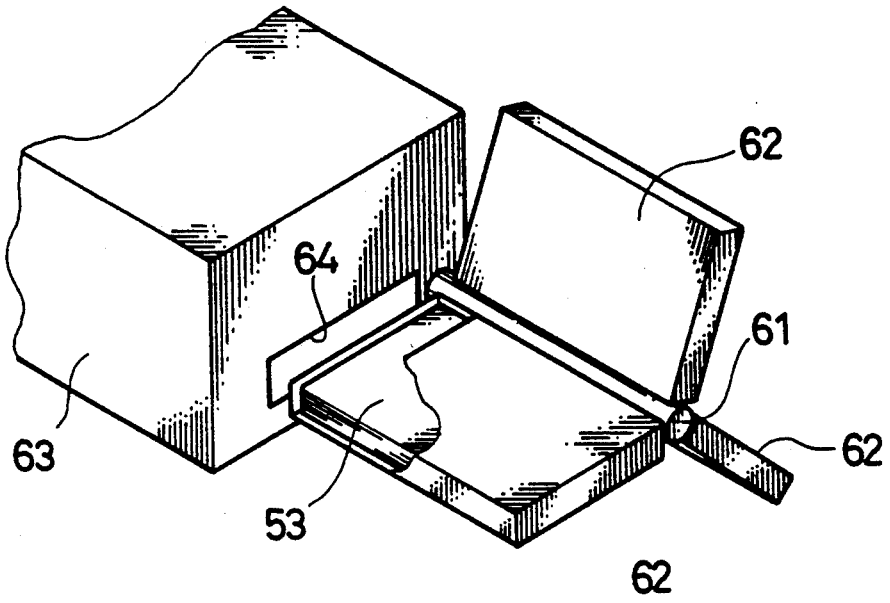
PRIOR ART FIG. 55
FIGS. 55 to 57 illustrate another conventional example.
Figure 56:
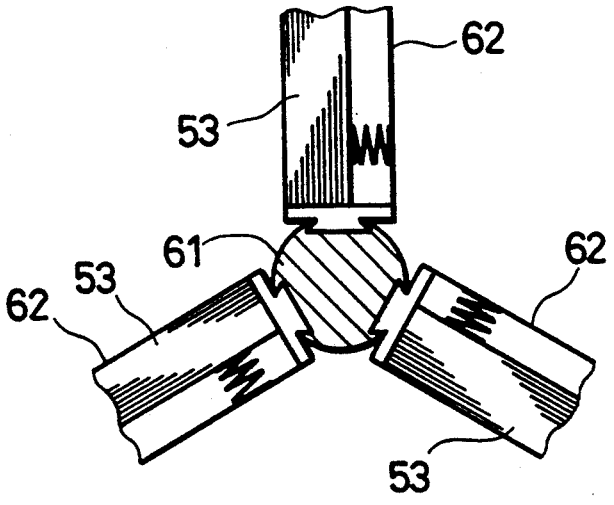
PRIOR ART FIG. 56
Figure 57:
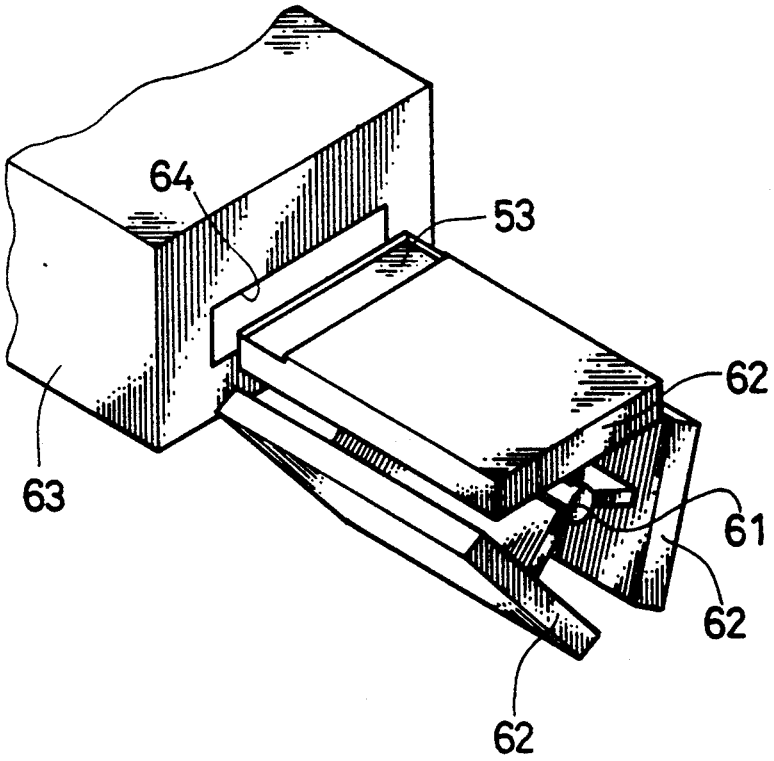

Referring to FIGS. 1 to 52, the following will describe one embodiment of the present invention.

Figure 3:
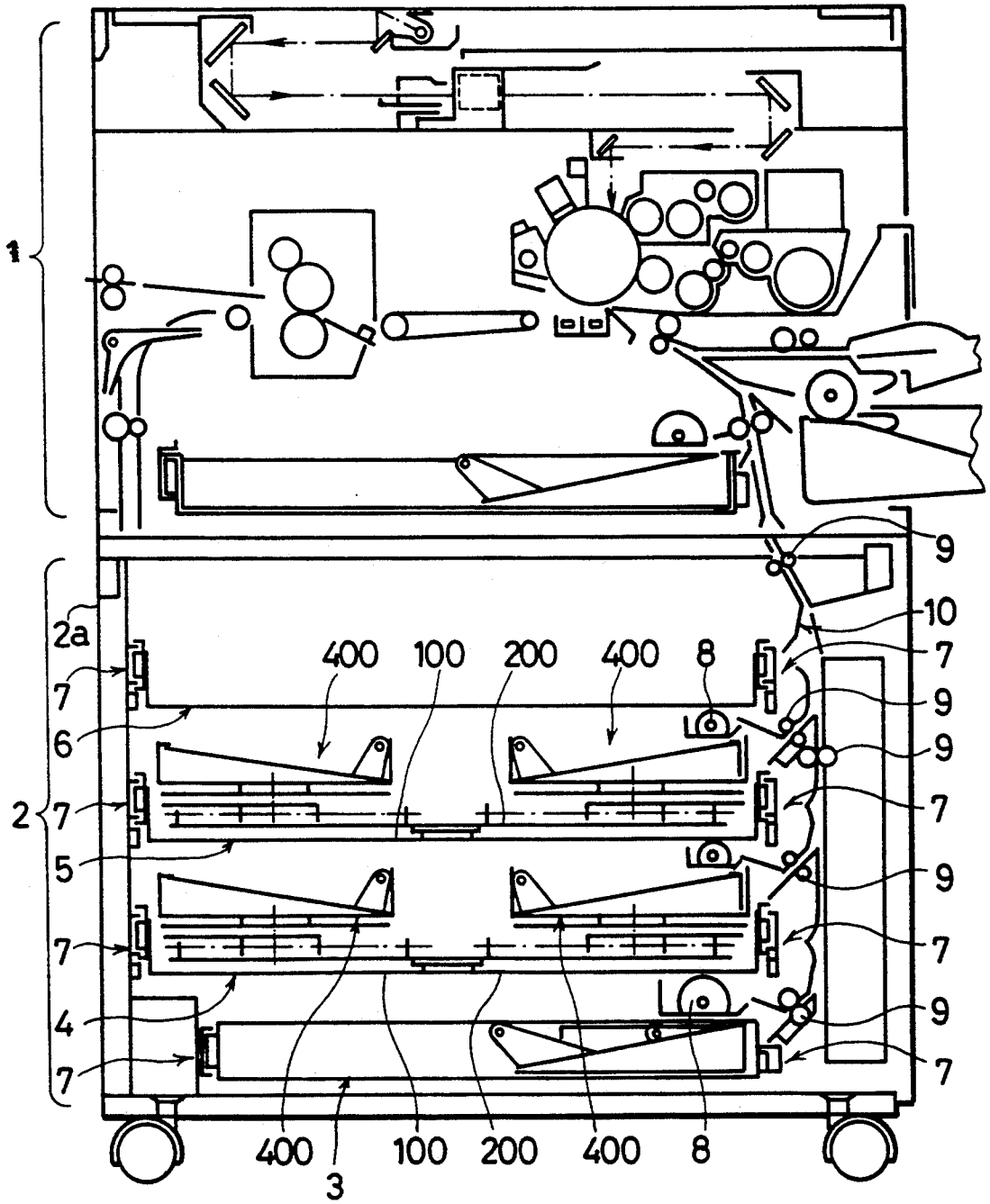
FIG. 3 is a front view illustrating a copying machine which incorporates a multi-stage paper feeding device including the rotatable cassette unit shown in FIG. 1.

As illustrated in FIG. 3, a copying machine is composed of a multi-stage paper feeding device 2 and a main body 1. The multi-stage paper feeding device 2 is located under the main body 1, and includes a stationary cassette unit 3, rotatable cassette units 4 and 5 as rotatable cassette-type paper feeding apparatuses and a tray unit 6 for receiving paper discharged from the main body. A sliding mechanism 7 is installed on each side of the respective units 3 to 6 and on the corresponding internal walls of the housing 2*a* of the multi-stage paper feeding device 2. The sliding mechanisms 7 enable the units 3 to 6 to be pulled out of the multi-stage paper feeding device 2 from the front of the copying machine. Sheets of paper stored in the stationary cassette unit 3 and rotatable cassette units 4 and 5 are supplied via paper transport path 10 to the main body 1 by a common feeding system using paper feeding rollers 8 and transport rollers 9. The above configuration of the multi-stage paper feeding device 2 and two types of horizontal rotating mechanisms, to be described later, for the rotatable cassette units 4 and 5 enable the paper feeding apparatus to feed an increased number of paper sheets and paper types, including lengthways and sideways feeding, to the main body 1 without expanding the copying machine's floor area.

Figure 2:
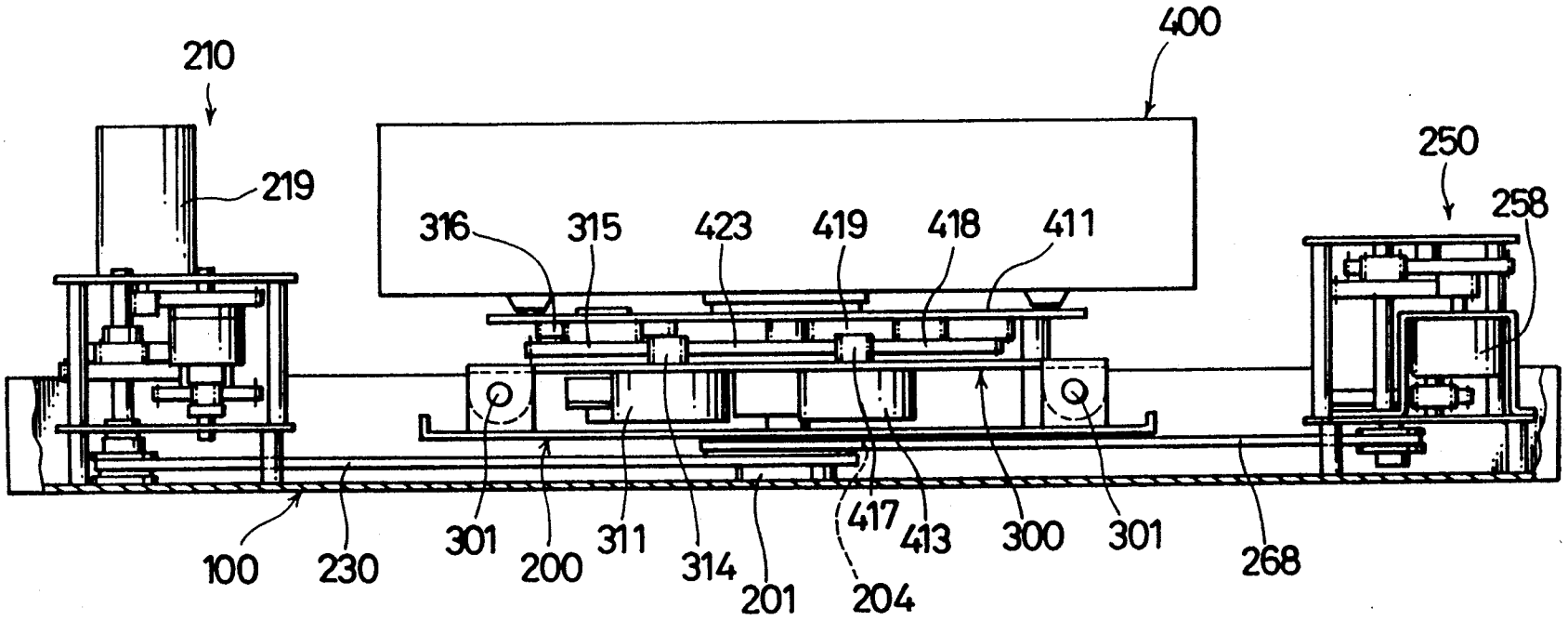
FIG. 2 is a view illustrating the rotatable cassette unit from the U side shown in FIG. 1.

As illustrated in FIGS. 1 and 2, each of the rotatable cassette units 4 and 5 has a tray 100 as a base member. A large turntable 200 serving as a cassette carrying member is mounted rotatably on the center of the floor of the tray 100 in parallel with the tray 100. A carriage 300 is installed on each side, in the longitudinal direction, of the turntable 200 so that it can slide straight in the longitudinal direction. A paper cassette 400 is mounted rotatably on the carriage 300 in parallel with the tray 100. In this embodiment, a centering system is adopted so that the rotatable cassette units 4 and 5 feed paper when the center of the paper (hereinafter referred to as paper center $S_P$) stored in paper cassettes 400 and the center line (paper feeding center line $SL_S$) for feeding paper in the paper feeding section of the multi-stage paper feeding device 2 are in alignment.

Figure 11:
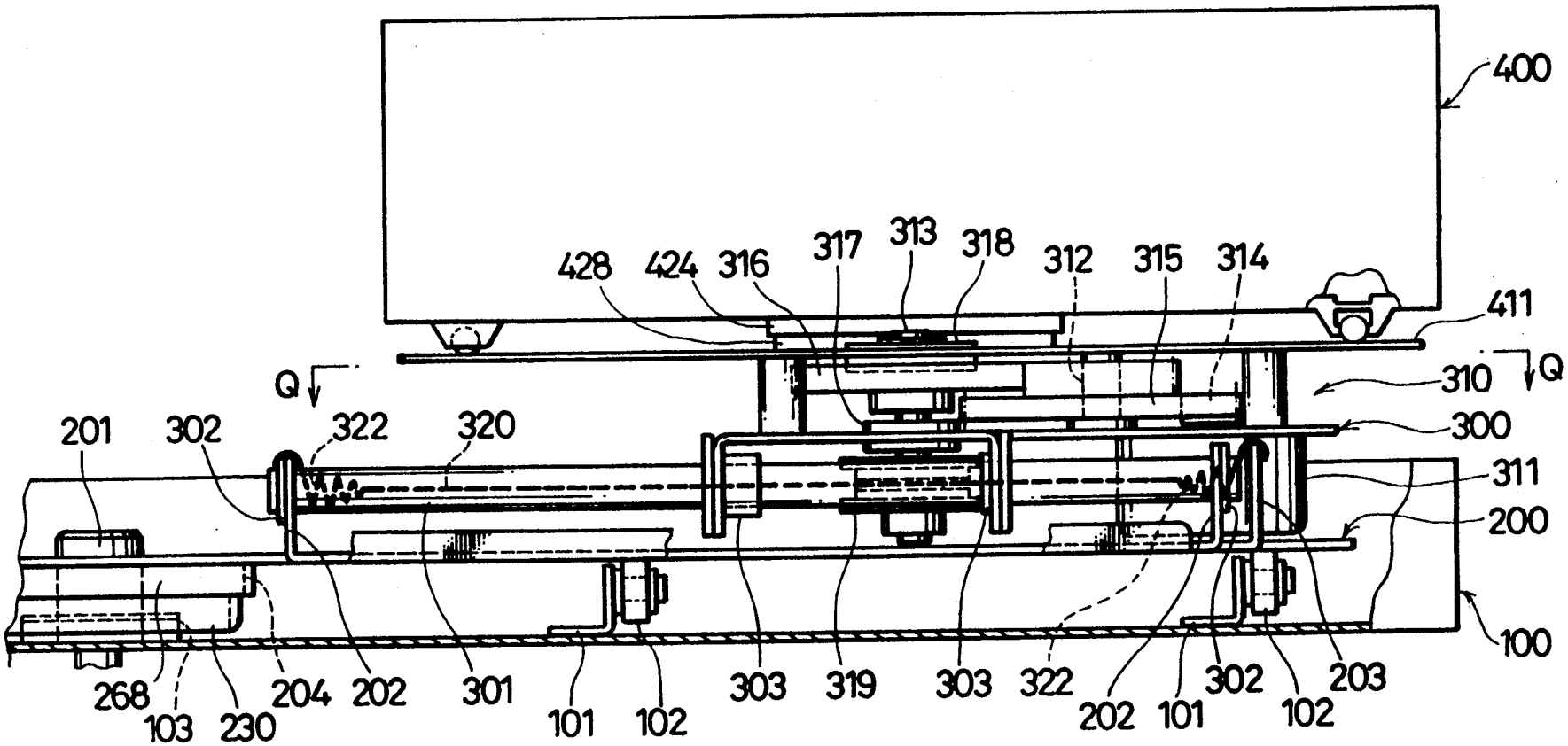
FIG. 11 is a front view of the cassette rotating mechanism shown in FIG. 1.
Figure 15:
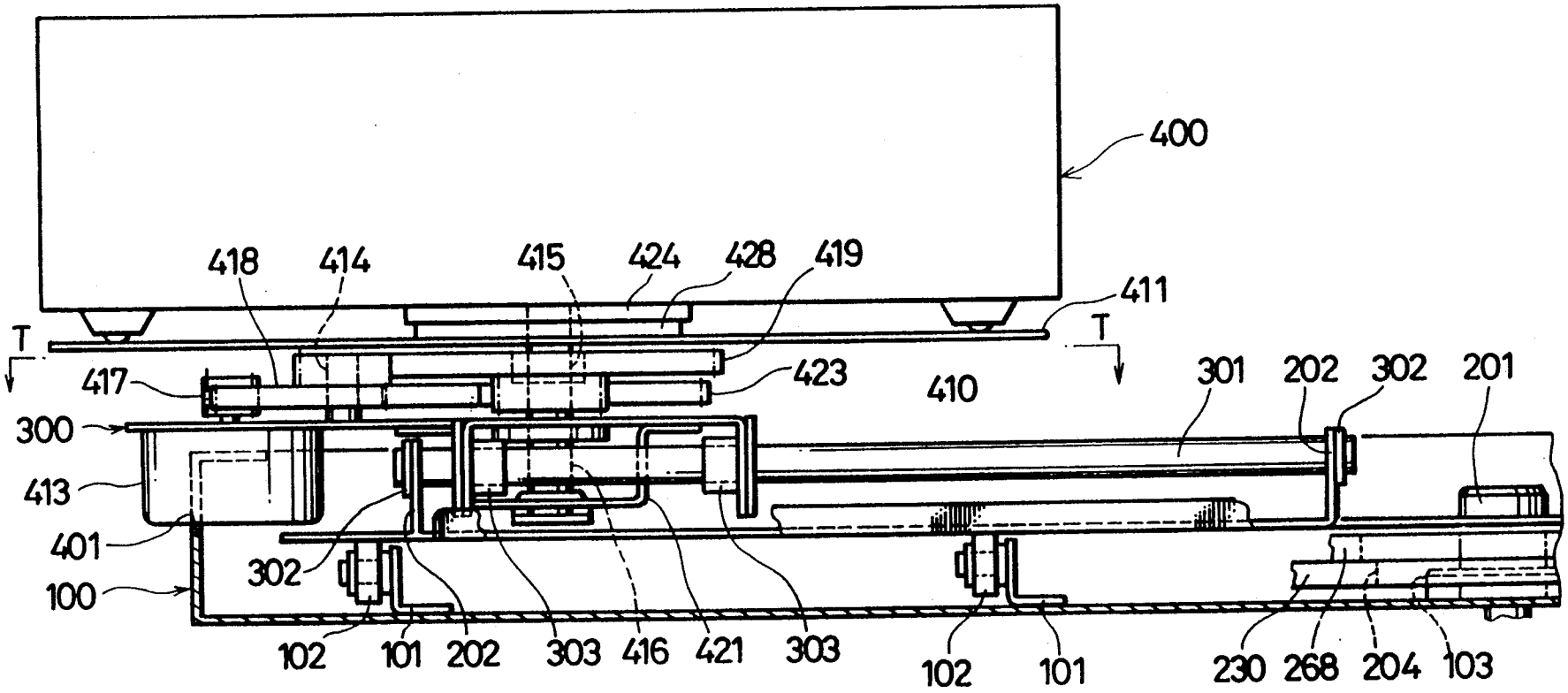
FIG. 15 is a front view of the cassette rotating mechanism shown in FIG. 1.

The turntable 200 is turned around a rotation shaft 201, and its circumferential edges in the longitudinal direction are formed like arcs of a circle around the rotation shaft 201. As illustrated in FIGS. 11 and 15, the normal load applied to the turntable 200 by the paper cassettes 400 storing paper and by other components is borne by a plurality of supporting rollers 102 attached to supporting members 101 on the floor of the tray 100 and by a thrust bearing 103 inserted into the inside of a double pulley 204. The double pulley 204 is provided for timing belts 230 and 268 and is attached to the rotation shaft 201 of the turntable 200. As illustrated in FIG. 1, installed on the turntable 200 are fourteen supporting rollers 102 in total, eight are on the inner portion thereof at intervals of 45 degrees and six are on the outer portion thereof at intervals of 30 degrees.

The turntable 200 is driven and rotated by a 180-degree rotating mechanism 210 as rotating means and high-speed rotating means for the cassette carrying member and by a small angle rotating mechanism 250 as rotating means and low-speed rotating means for the cassette carrying member shown in FIG. 1. The 180-degree rotating mechanism 210 and small angle rotating mechanism 250 are respectively disposed at the corners of the tray 100 on the non-paper-feeding side, outside of the turning space $E_L$ of the turntable 200 shown by the alternate long and two short dashes line in FIG. 1. The non-paper-feeding side is located opposite to a paper feeding side 11.

Figure 4:
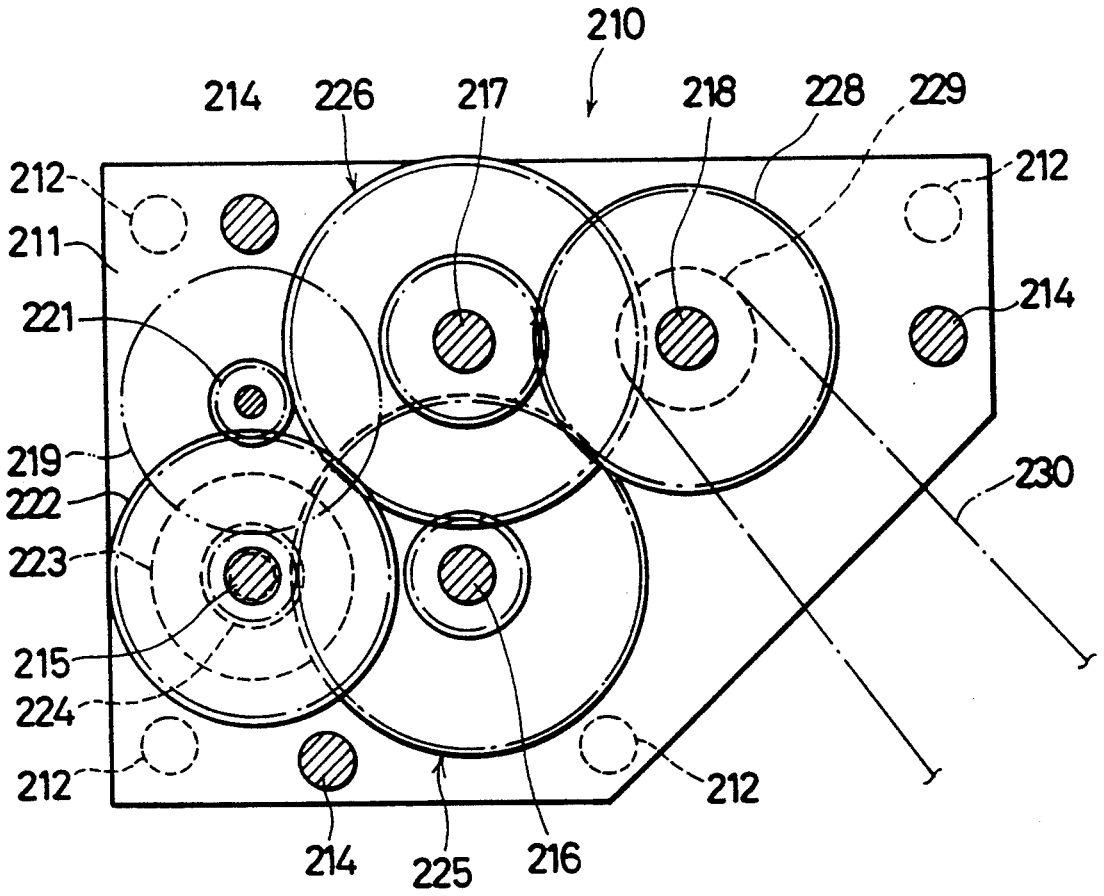
FIG. 4 is a cross section of a 180-degree rotating mechanism cut across an O—O line shown in FIG. 5.
Figure 5:
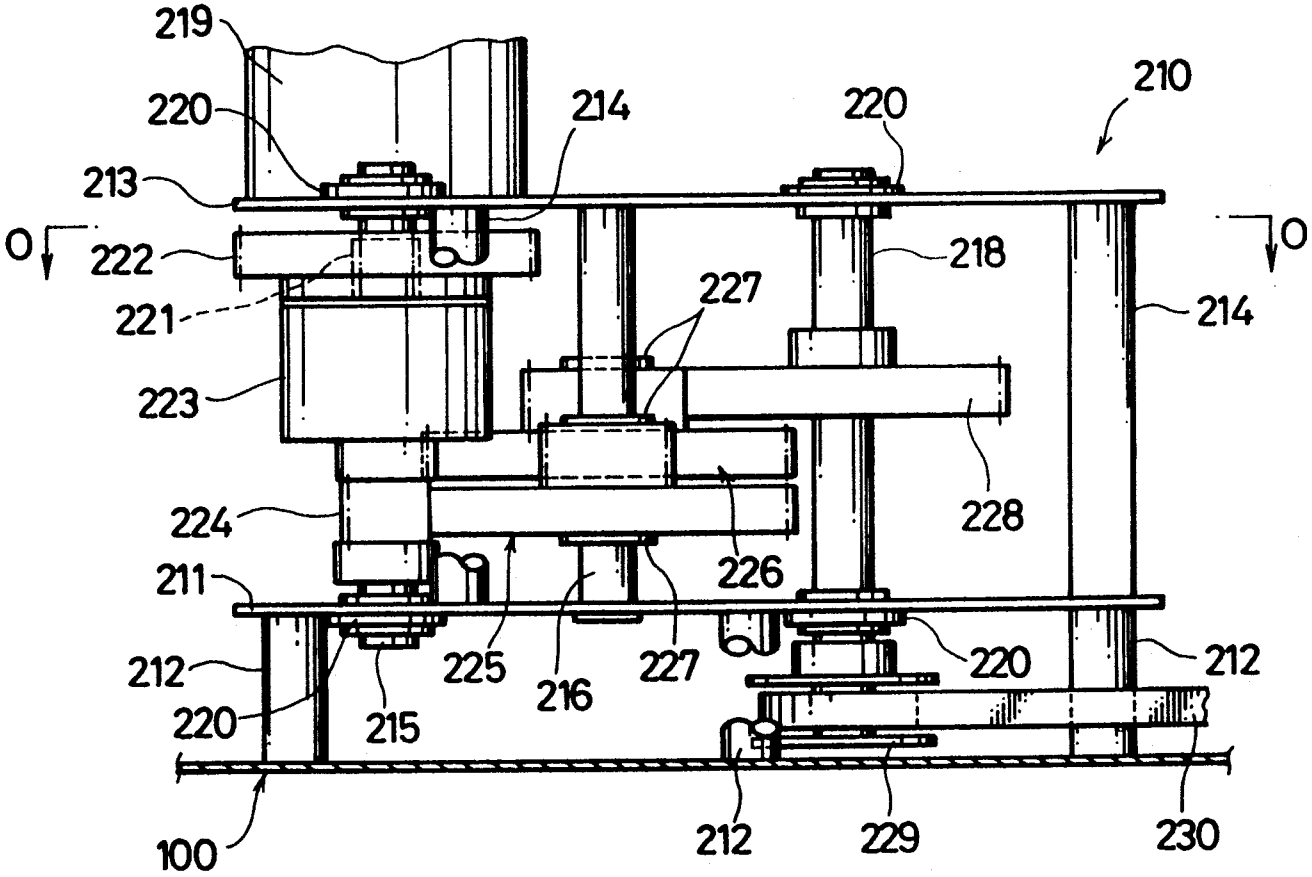
FIG. 5 is an enlarged front view of the 180-degree rotating mechanism shown in FIG. 1.
Figure 6:
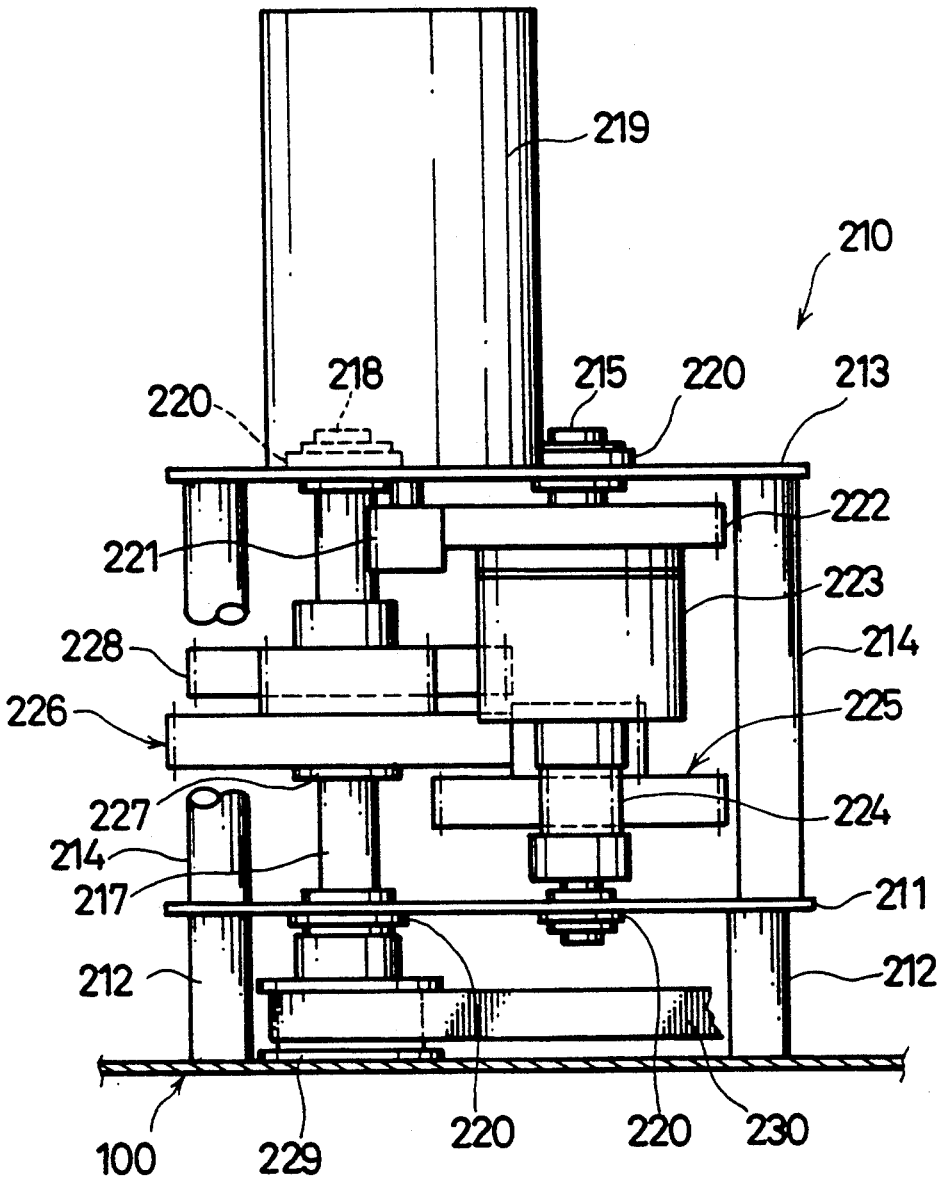
FIG. 6 is a side view of the 180-degree rotating mechanism shown in FIG. 5.

As illustrated in FIGS. 4 to 6, the lower supporting plate 211 of the 180-degree rotating mechanism 210 is placed above and parallel with the tray 100, and supported by a plurality of stays 212. The upper supporting plate 213 is placed above and parallel with the lower supporting plate 211, and supported by a plurality of stays 214. First to fourth shafts, 215 to 218, are installed between the lower supporting plate 211 and the upper supporting plate 213, and a DC motor 219 is mounted on the upper supporting plate 213. The top and bottom ends of the first shaft 215 and of the forth shaft 218 are rotatably held in oil impregnated metal powder sintered bearings 220. Meanwhile, the top and bottom ends of the second shaft 216 and of the third shaft 217 are respectively fixed to the upper and lower supporting plates 213 and 211.

A gear 222, which engages with a motor gear 221 secured to the rotation shaft of the DC motor 219, is attached rotatably to an upper portion of the first shaft 215, while a gear 224 is fixed to a lower portion thereof with screws. In addition, a clutch 223 is fixed to a portion of the first shaft 215 between the gear 222 and gear 224 with screws. The clutch 223 connects or disconnects the transmission of the driving force between the gears 222 and 224. A double gear 225 engaging with the gear 224 and a double gear 226 engaging with the double gear 225 are positioned by E-rings 227 and rotatably attached to the second shaft 216 and the third shaft 217, respectively. A timing pulley gear 228 engaging with the double gear 226 is fixed to a portion of the fourth shaft 218 between the lower and upper supporting plates 211 and 213 with screws, and a timing pulley 229 is fixed to a portion thereof between the lower supporting plate 211 and the tray 100 with screws.

A timing belt 230 connects the timing pulley 229 and the lower stage of the double pulley 204 attached to the rotation shaft 201. Accordingly, the power of the DC motor 219 is transmitted to the rotation shaft 201 at a reduction gear ratio $i_3$ smaller than a reduction gear ratio $i_4$ of the small angle rotating mechanism 250 via the timing pulley 229, timing belt 230, double pulley 204, and a series of power-transmission gears, including the motor gear 221, gear 222, clutch 223, gear 224, double gears 225 and 226 and timing pulley gear 228. As a result, the turntable 200 is rotated.

The reason why the reduction gear ratio $i_3$ of the 180-degree rotating mechanism 210 is set smaller than the reduction gear ratio $i_4$ of the small angle rotating mechanism 250 is as follows. Unlike the small angle rotating mechanism 250 that performs its operation in association with a carriage driving mechanism 310 and a cassette rotating mechanism 410, to be described later, the 180-degree rotating mechanism 210 performs its operation independently that can only turn the turntable 200 by 180 degrees. Therefore in order to shorten the operation time, the 180-degree rotating mechanism must rotate the turntable 200 at an increased speed compared to the speed of the small angle rotating mechanism 250.

Figure 7:
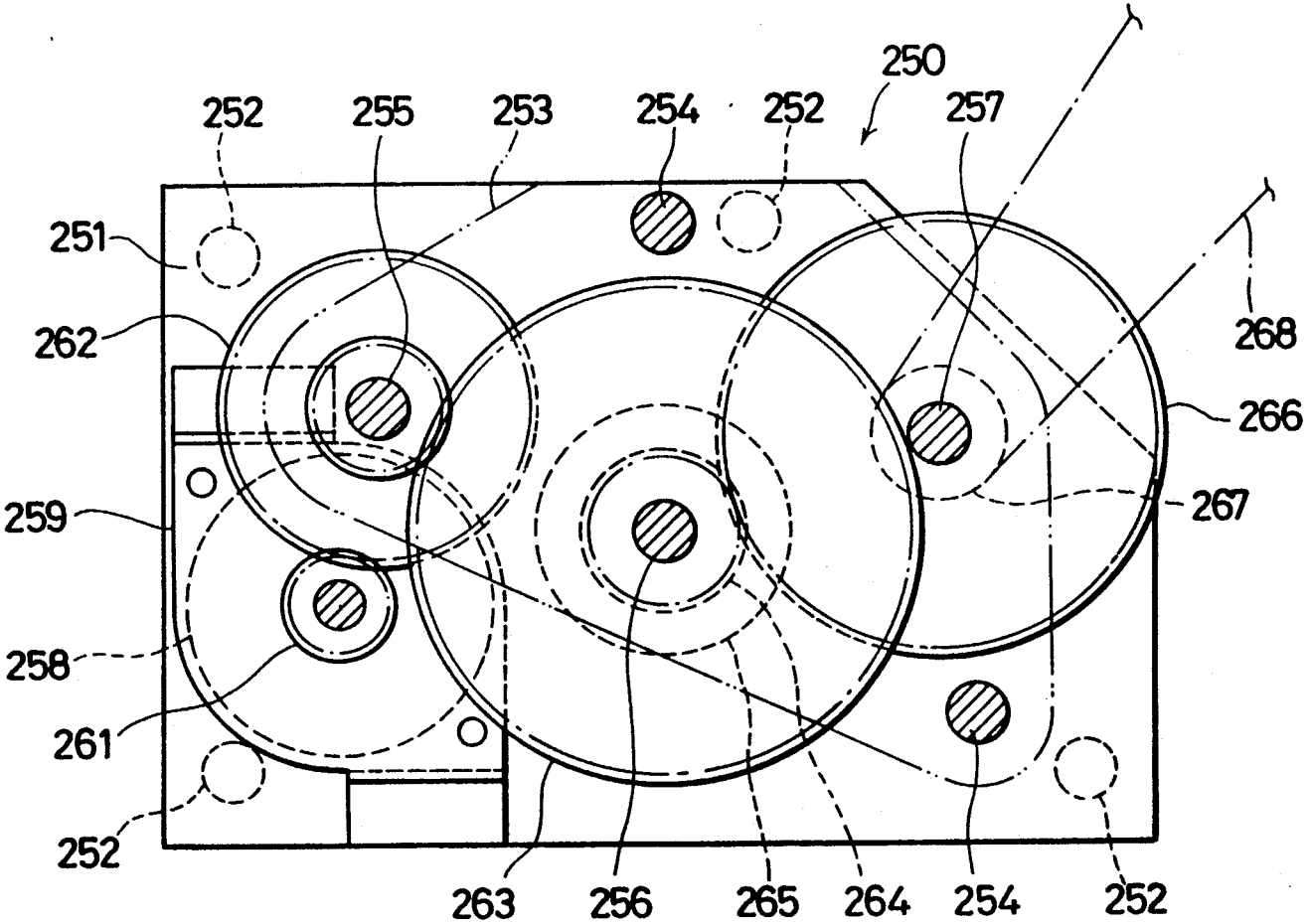
FIG. 7 is a cross section of a small angle rotating mechanism cut across a P—P line shown in FIG. 8.
Figure 8:
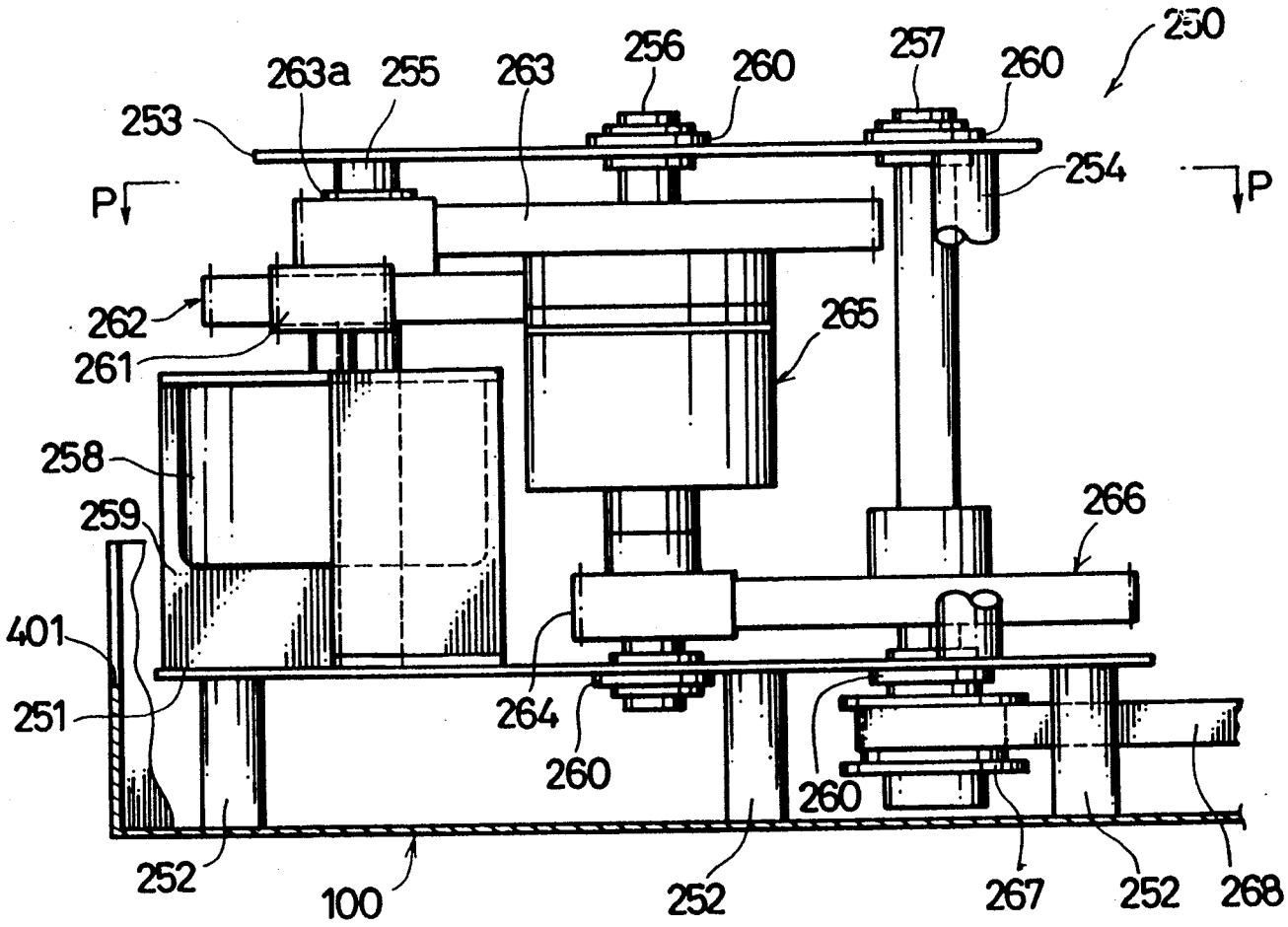
FIG. 8 is an enlarged front view of the small angle rotating mechanism shown in FIG. 1.
Figure 9:
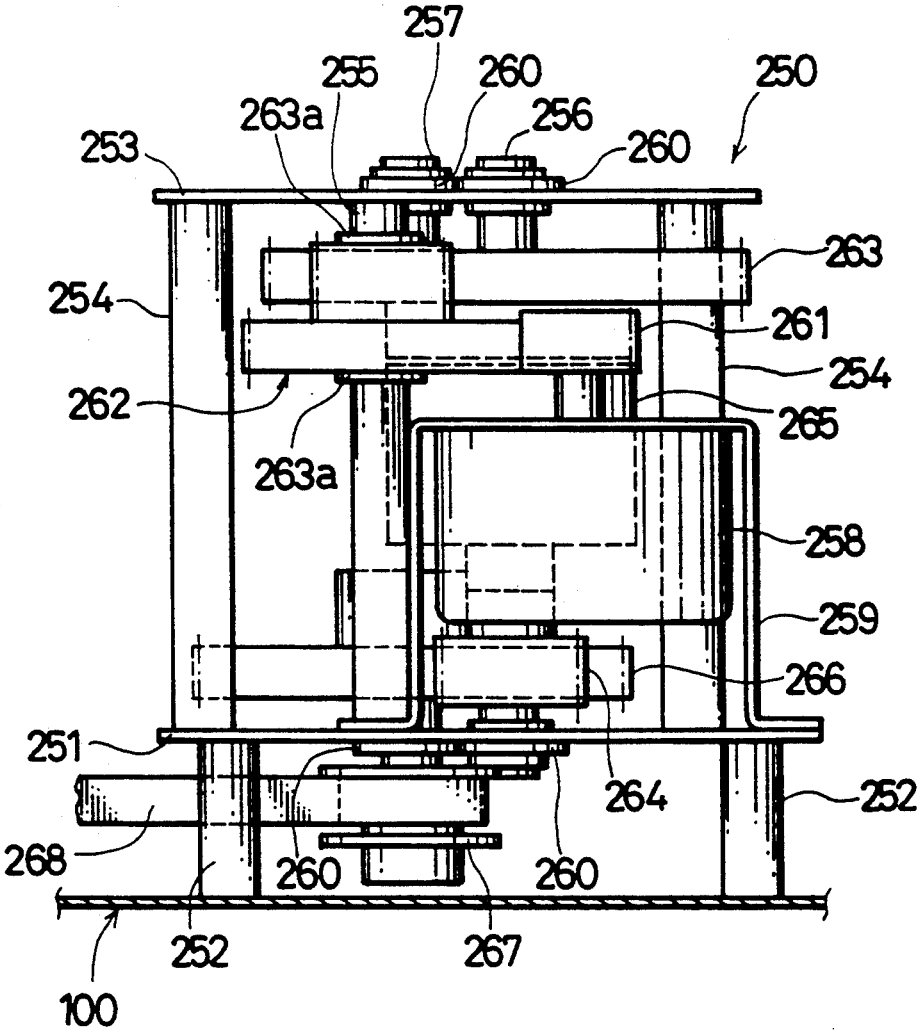
FIG. 9 is a side view of the small angle rotating mechanism shown in FIG. 8.

With regard to the small angle rotating mechanism 250, as illustrated in FIGS. 7 to 9, a lower supporting plate 251 is placed above and parallel with the tray 100, and supported by a plurality of stays 252, and an upper supporting plate 253 is disposed above and parallel with the lower supporting plate 251 and supported by a plurality of stays 254. First to third shafts, 255 to 257, are installed between the lower and upper supporting plates 251 and 253, and a pulse motor 258 is mounted on the lower supporting plate 251 with a motor supporting member 259. The top and bottom ends of the second shaft 256 and of the third shaft 257 are rotatably held in oil impregnated metal powder sintered bearings 260, while the top and bottom ends of the first shaft 255 are fixed to the upper supporting plate 253 and lower supporting plate 251, respectively.

A double gear 262, which engages with a motor gear 261 attached to the rotation shaft of the pulse motor 258, is positioned by E-rings 263*a* and attached rotatably to the first shaft 255. A gear 263 engaging with the double gear 262 is attached rotatably to an upper portion of the second shaft 256, while a gear 264 is fixed to a lower portion thereof with screws. In addition, a clutch 265 is fixed to a portion of the second shaft 256 between the gears 263 and 264 with screws. The clutch 265 connects and disconnects the transmission of the driving force between the gears 263 and 264. A timing pulley gear 266 engaging with the gear 264 is fixed to a portion of the third shaft 257 between the lower and upper supporting plates 251 and 253 with screws, while a timing pulley 267 is fixed to a portion thereof between the lower supporting plate 251 and the tray 100 with screws.

A timing belt 268 connects the timing pulley 267 and the upper stage of the double pulley 204 attached to the rotation shaft 201. Accordingly, the power of the pulse motor 258 is transmitted to the rotation shaft 201 at the reduction gear ratio $i_4$ via the timing pulley 267, timing belt 268, double pulley 204, and a series of power-transmission gears, including the motor gear 261, double gear 262, gear 263, clutch 265, gear 264 and timing pulley gear 266. As a result, the turntable 200 is rotated.

Figure 10:
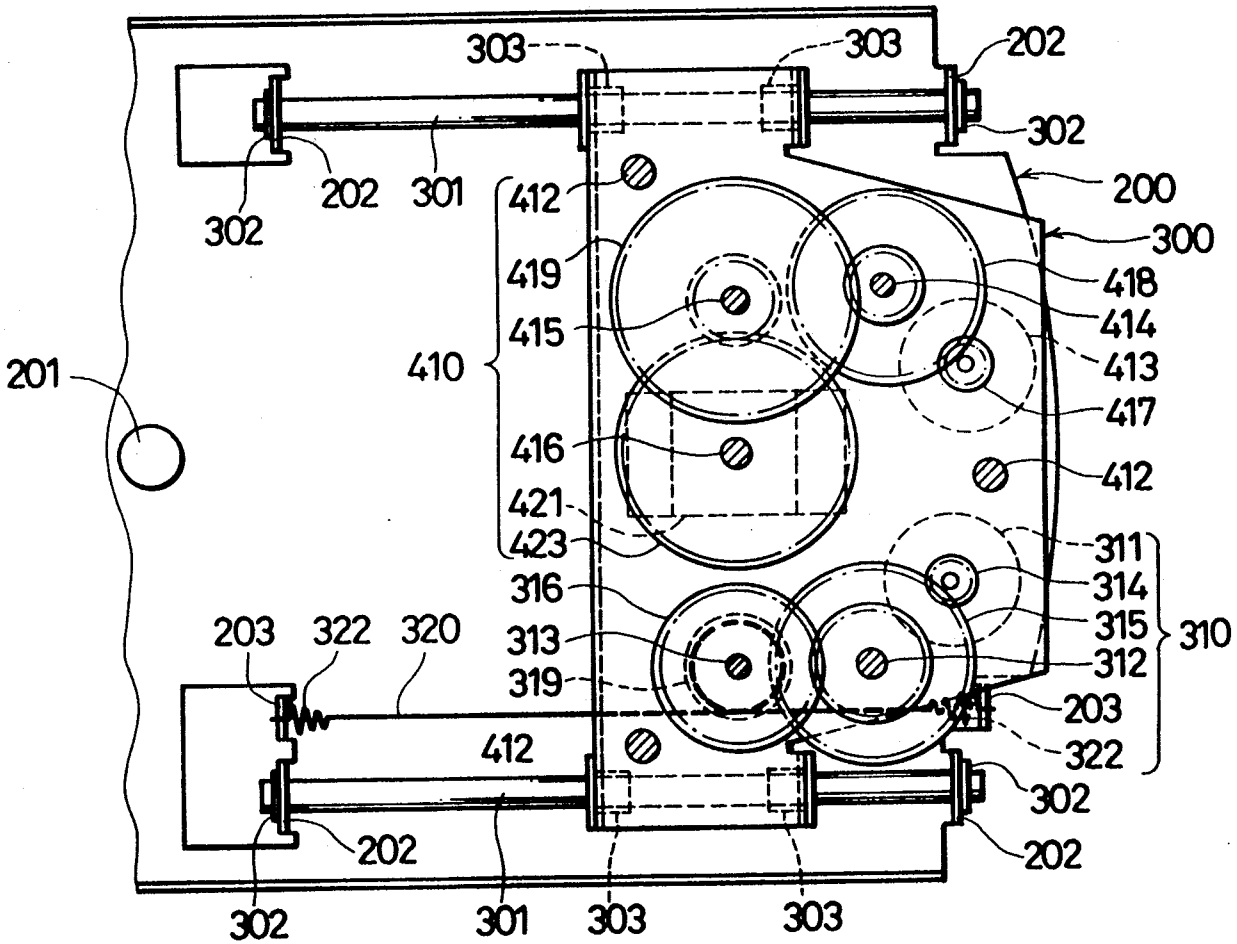
FIG. 10 is an enlarged view illustrating a carriage driving mechanism and a cassette rotating mechanism installed on one side of a large turntable shown in FIG. 1, and is also a cross sectional plan view of FIG. 11 cut across a Q—Q line.

Each carriage 300 installed on the turntable 200 is supported by and slides over two slide supporting bars 301. As illustrated in FIG. 1, the two slide supporting bars 301 are mounted on each side of the turntable 200. They are disposed horizontally in the longitudinal direction of and in parallel with the turntable 200. As shown in FIGS. 10 and 11, each slide supporting bar 301 passes through a pair of bar supporting sections 202 of the turntable 200 in parallel with the turntable 200, and is fastened by E-rings 302. The bar supporting sections 202 are formed by cutting and raising sections of the turntable 200. The carriages 300 are mounted slidably on the slide supporting bars 301 with bearings 303 installed on the bottom surfaces of the carriages 300. As shown in FIG. 1, the carriage driving mechanisms 310 as cassette moving means and the cassette rotating mechanisms 410 as cassette rotating means are disposed on the carriages 300 symmetrically about the rotation shaft 201 of the turntable 200. The carriage driving mechanisms 310 drive the carriages 300 to slide over the slide supporting bars 301.

Figure 12:
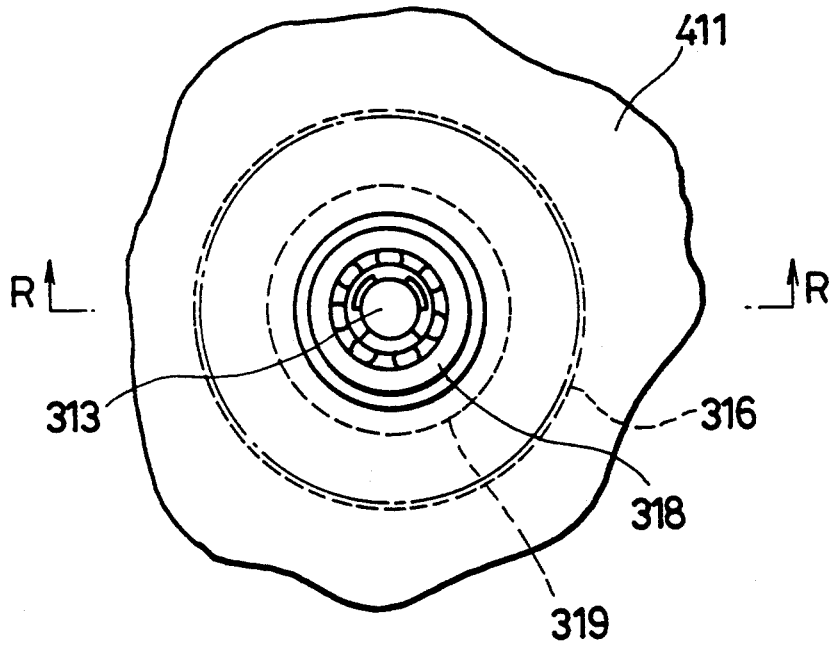
FIG. 12 is a plan view illustrating the structure of a pulley shaft shown in FIG. 10.
Figure 13:
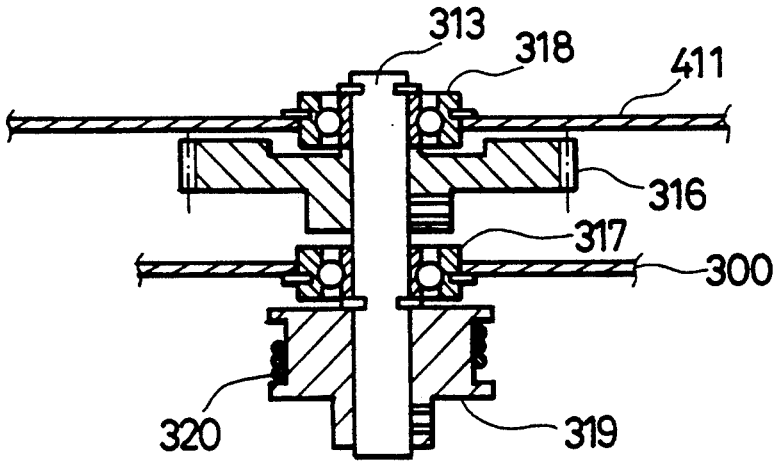
FIG. 13 is a cross sectional plan view of FIG. 12 cut across a R—R line.

With regard to the carriage driving mechanism 310, a pulse motor 311 is mounted on the bottom surface of the carriage 300, a fixed shaft 312 is secured to the upper surface thereof, and a pulley shaft 313 passes through the carriage 300 vertically. A double gear 315, which engages with a motor gear 314 secured to the rotation shaft of the pulse motor 311, is attached rotatably to the fixed shaft 312. As, illustrated in FIGS. 12 and 13, a near central portion and an upper portion of the pulley shaft 313 are supported by the carriage 300 and a cassette supporting circular plate 411 via radial bearings 317 and 318, respectively. A pulley gear 316 engaging with the double gear 315 is fixed to a portion of the pulley shaft 313 between the radial bearings 317 and 318 with screws, while a wire pulley 319 is fixed to a lower portion thereof with screws. Accordingly, the power of the pulse motor 311 is transmitted to the wire pulley 319 at a reduction gear ratio $i_1$ via a series of power-transmission gears, including the motor gear 314, double gear 315 and wire pulley gear 316.

A wire 320 is wound around and fastened to the central portion of the wire pulley 319 with screws. As illustrated in FIG. 10, the both ends of the wire 320 are connected to the wire joint sections 203 of the turntable 200 located in the vicinity of the bar supporting sections 202 through springs 322 for preventing looseness so that the wire 320 can extend along the slide supporting bar 301. With this arrangement, the carriage 300 is moved toward the rotation shaft of the turntable 200 or the opposite direction according to a rotation of the wire pulley 319, i.e., the normal rotation or the reverse rotation of the pulse motor 311. In consideration of the movement of the carriage 300, as shown in FIGS. 1 and 15, the non-paper-feeding side of the tray 100 is provided with an opening 401 which permits the carriage 300 and paper cassette 400 to protrude from the tray 100.

Figure 14:
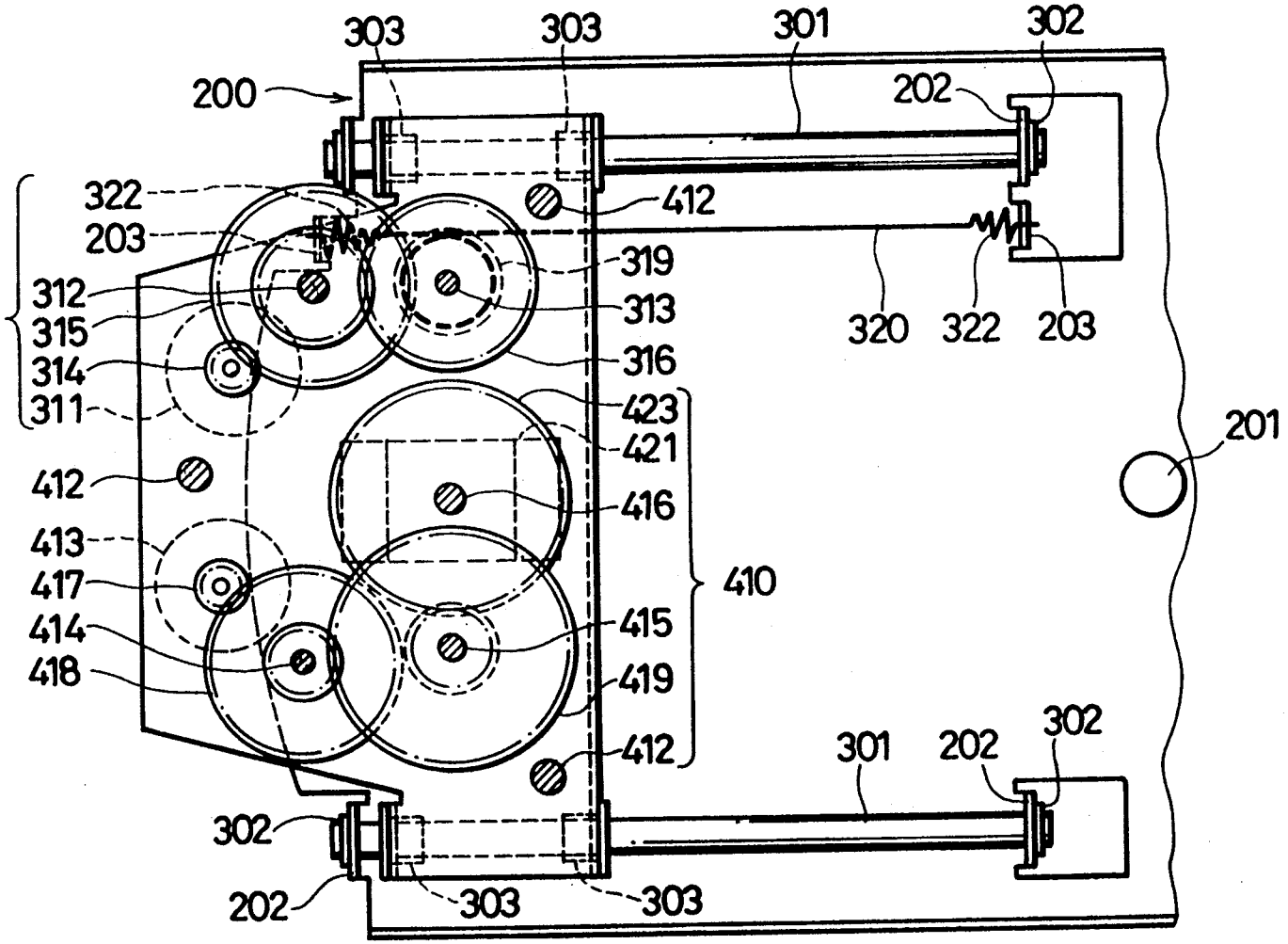
FIG. 14 is an enlarged view of a carriage driving mechanism and a cassette rotating mechanism installed on the other side of the turntable shown in FIG. 1, and is also a cross sectional plan view of FIG. 15 cut across a T—T line.

As illustrated in FIGS. 14 and 15, the carriage 300 is provided with the cassette rotating mechanism 410. With regard to the cassette rotating mechanism 410 the cassette supporting circular plate 411 is mounted on the carriage 300 in parallel with the carriage 300 to support the paper cassette 400 through three spacers 412 shown in FIG. 14. Additionally, a pulse motor 413 is mounted on the bottom surface of the carriage 300, fixed shafts 414 and 415 are secured to the upper surface thereof, and a cassette rotation shaft 416 passes through the carriage 300 vertically.

Figure 17:
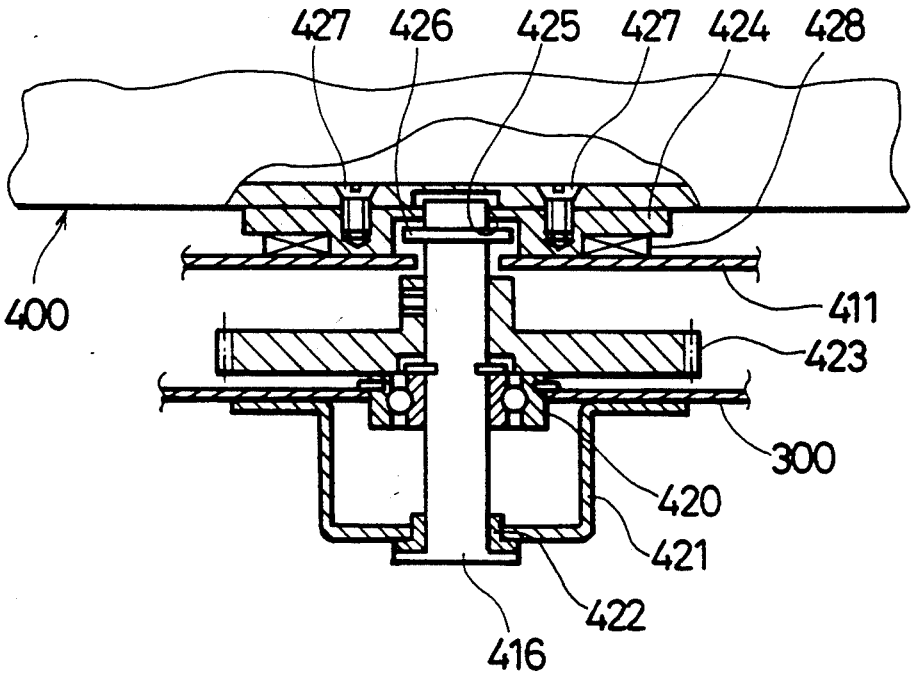
FIG. 17 is a cross sectional plan view of FIG. 16 cut across an S—S line.

A double gear 418, which engages with a motor gear 417 attached to the rotation shaft of the pulse motor 413, is attached rotatably to the fixed shaft 414, while a double gear 419, which engages with the double gear 418, is attached rotatably to the fixed shaft 415. As illustrated in FIG. 17, a near central portion of the cassette rotation shaft 416 is supported by the cassette supporting circular plate 411 through a radial bearing 420, while a lower portion thereof is supported by a U-shaped member 421 mounted on the bottom surface of the carriage 300 through an oil impregnated metal powder sintered bearing 422. A cassette gear 423 engaging with the double gear 419 is fixed to an upper portion of the cassette rotation shaft 416 with screws. Accordingly, the power of the pulse motor 413 is transmitted to the cassette rotation shaft 416 at a reduction gear ratio $i_2$ via a series of power-transmission gears, including the motor gear 417, double gears 418 and 419 and cassette gear 423.

Figure 16:
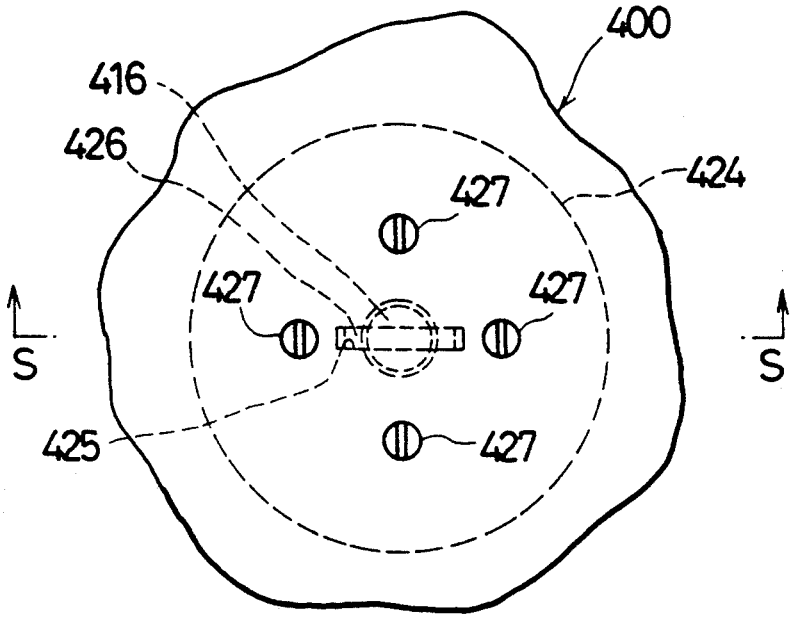
FIG. 16 is a plan view illustrating the structure of a cassette rotation shaft shown in FIG. 15.

As illustrated in FIG. 16, the top end of the cassette rotation shaft 416 is inserted from an opening formed on the cassette supporting circular plate 411 into a cassette connecting circular plate 424 that is installed on the bottom surface of the paper cassette 400 with screws 427. A joining socket 425 is formed on the cassette connecting circular plate 424. By joining a connecting pin 426 secured to the top end of the cassette rotation shaft 416 to the joining socket 425, the cassette rotation shaft 416 is connected to the central portion of the paper cassette 400. Disposed between the cassette connecting circular plate 424 and the cassette supporting circular plate 411 is a thrust bearing 428 for supporting the paper cassette 400 rotatably. This configuration enables the paper cassette 400 to be rotated according to the normal rotation or reverse rotation of the pulse motor 413.

Figure 18:
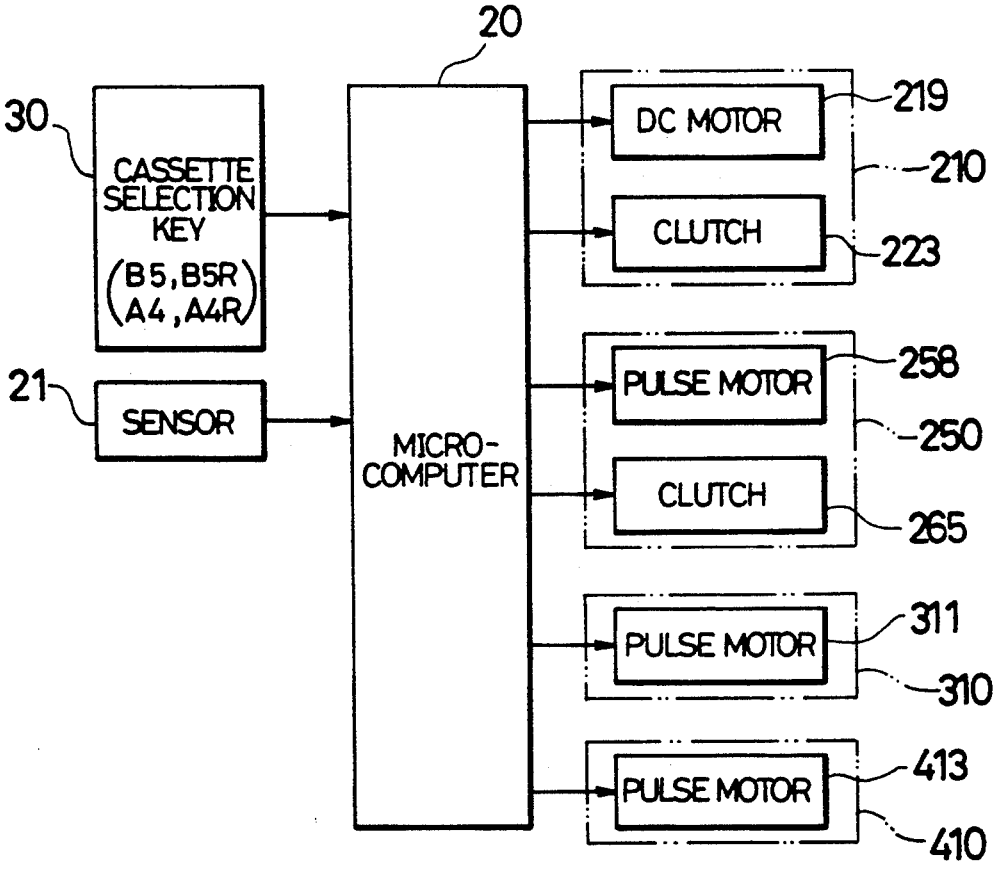
FIG. 18 is a block diagram illustrating a control system of the rotatable cassette unit shown in FIG. 1.

A microcomputer 20 as controller means shown in FIG. 18 controls the 180-degree rotating mechanism 210 to rotate the turntable 200 around the rotation shaft 201, the small angle rotating mechanism 250 to rotate the turntable 200 (hereinafter referred to as $\theta$-axis driving), the carriage driving mechanism to move the carriage 300, i.e., the paper cassette 400 along the slide supporting bars 301, i.e. in the radial direction of rotation of the turntable 200 (referred to as r-axis driving), and the cassette rotating mechanism 410 to rotate the cassette around the cassette rotation shaft 416 (referred to as $\phi$-axis driving). More specifically, the microcomputer 20 controls $\phi$-axis driving, r-axis driving and $\phi$-axis driving simultaneously such that the paper cassette 400 storing paper of a selected size is set in a position which allows the paper to be fed while aligning the paper center $S_P$ with the paper feeding center line $SL_S$. At this time, the microcomputer 20 controls the DC motor 219 and clutch 223 of the 180-degree rotating mechanism 210, the pulse motor 258 and clutch 265 of the small angle rotating mechanism 250, the pulse motor 311 of the carriage driving mechanism 310, and the pulse motor 413 of the cassette rotating mechanism 410 as described below.

Paper to be used is selected according to an input entered by an operator via a cassette selection key 30 or by the detection of a sensor (not shown). Namely, the selection is made based on the size of a document placed on the document platen of the main body 1, the position of the document, i.e., whether it is placed lengthways or sideways, a detection signal from the sensor, a type of copying, for example, enlarged copying or reduced copying, and other factor. In this embodiment, assuming that B5-sized paper and A4-sized paper are stored in the two paper cassettes 400 of each of the rotatable cassette units 4 and 5, B5, B5R, A4 and A4R paper are available.

Based on the above configuration, the following will explain the operations of the 180-degree rotating mechanism 210, small angle rotating mechanism 250, carriage driving mechanism 310 and cassette rotating mechanism 410, respectively.

Figure 19:
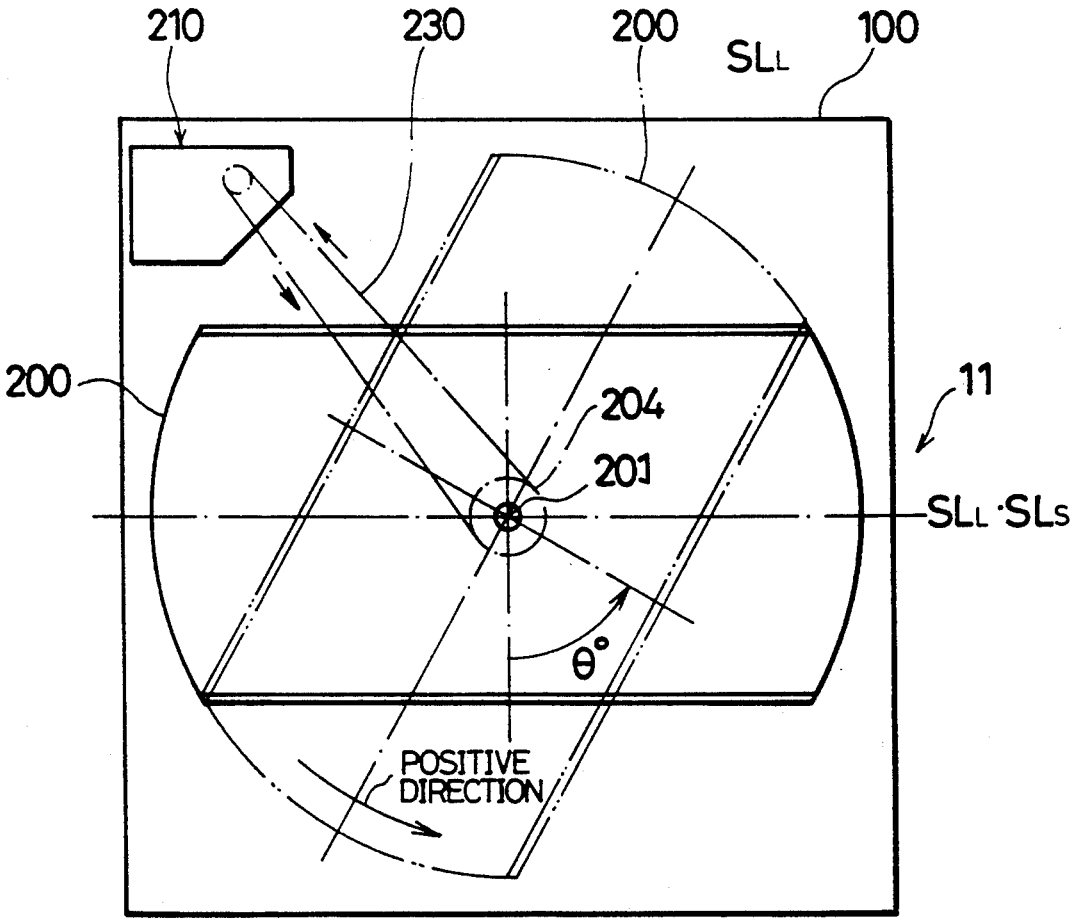
FIG. 19 is a view explaining the operation of the 180-degree rotating mechanism shown in FIGS. 4 to 6.

As illustrated in FIG. 19, the 180-degree rotating mechanism 210 simply turns the turntable 200 by 180 degrees so as to interchange the places of the paper cassette 400 in the paper feeding side 11 and the paper cassette 400 in the non-paper-feeding side. At this time, the power of the DC motor 219 is increased at the reduction gear ratio $i_3$ and transmitted to the rotation shaft 201 of the turntable 200 via the series of power transmission gears shown in FIGS. 4 to 6, timing belt 230 and double pulley 204. The position of the turntable 200 after the 180-degree turn, is detected by a sensor 21 shown in FIG. 18. Then according to a detection signal from the sensor 21, the microcomputer 20 controls the DC motor 219 so as to position the turntable 200 accurately. When the 180-degree rotating mechanism 210 is actuated, the clutch 223 provided for the series of power transmission gears is turned ON by the microcomputer 20 so that the power of the DC motor is transmitted. On the contrary, when the small angle rotating mechanism 250 is actuated as to be described later, it is turned OFF in order to cutoff the power transmission of the DC motor 219.

Figure 20:
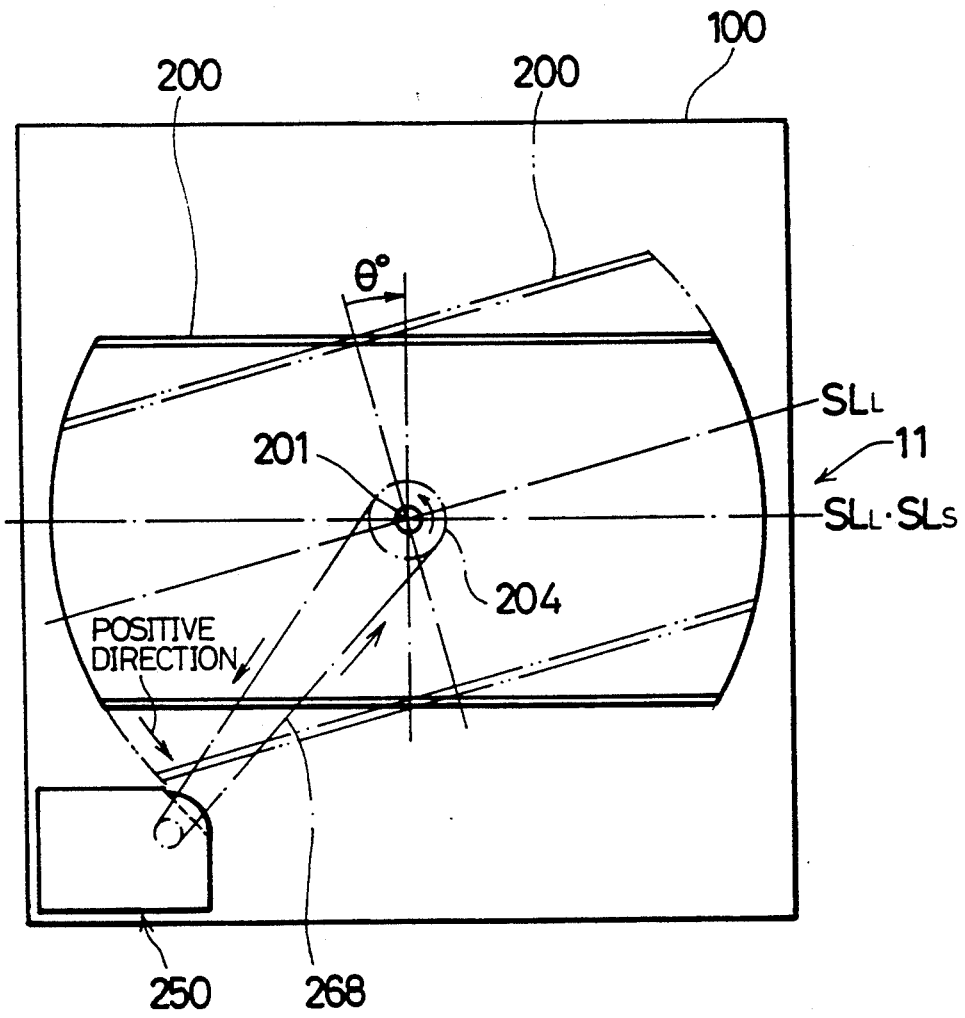
FIG. 20 is a view explaining the operation of the small angle rotating mechanism shown in FIGS. 7 to 9.

During $\theta$-axis driving by the small angle rotating mechanism 250, the power of the pulse motor 258 is increased at the reduction gear ratio $i_4$ and transmitted to the rotation shaft 201 of the turntable 200 by the series of power transmission gears shown in FIGS. 7 to 9, timing belt 268 and double pulley 204. In consequence, the turntable 200 is rotated by a small angle as illustrated in FIG. 20. This rotation is controlled by the microcomputer 20 such that the paper center $S_P$ of the paper stored in the paper cassette 400 in the paper feeding side 11 aligns with the paper feeding center line $SL_S$ according to lengthways feeding or sideways feeding. When the small angle rotating mechanism 250 is actuated, the clutch 265 provided for the series of transmission gears is turned ON to transmit the power of the pulse motor 258. On the other hand, when the 180-degree rotating mechanism 210 is actuated, it is turned OFF to cutoff the power transmission of the pulse motor 258.

During r-axis driving by the carriage driving mechanism 310, the power of the pulse motor 311 is increased at the reduction gear ratio $i_1$ and transmitted to the wire pulley 319 attached to the pulley shaft 313 by the series of power transmission gears shown in FIGS. 10 and 11. Accordingly, the microcomputer 20 controls the carriage driving mechanism 310 to drive the carriage 300 such that the paper cassette 400 in the paper feeding side 11 is moved to the switching position, sideways feeding position or retracted position.

Figure 32:
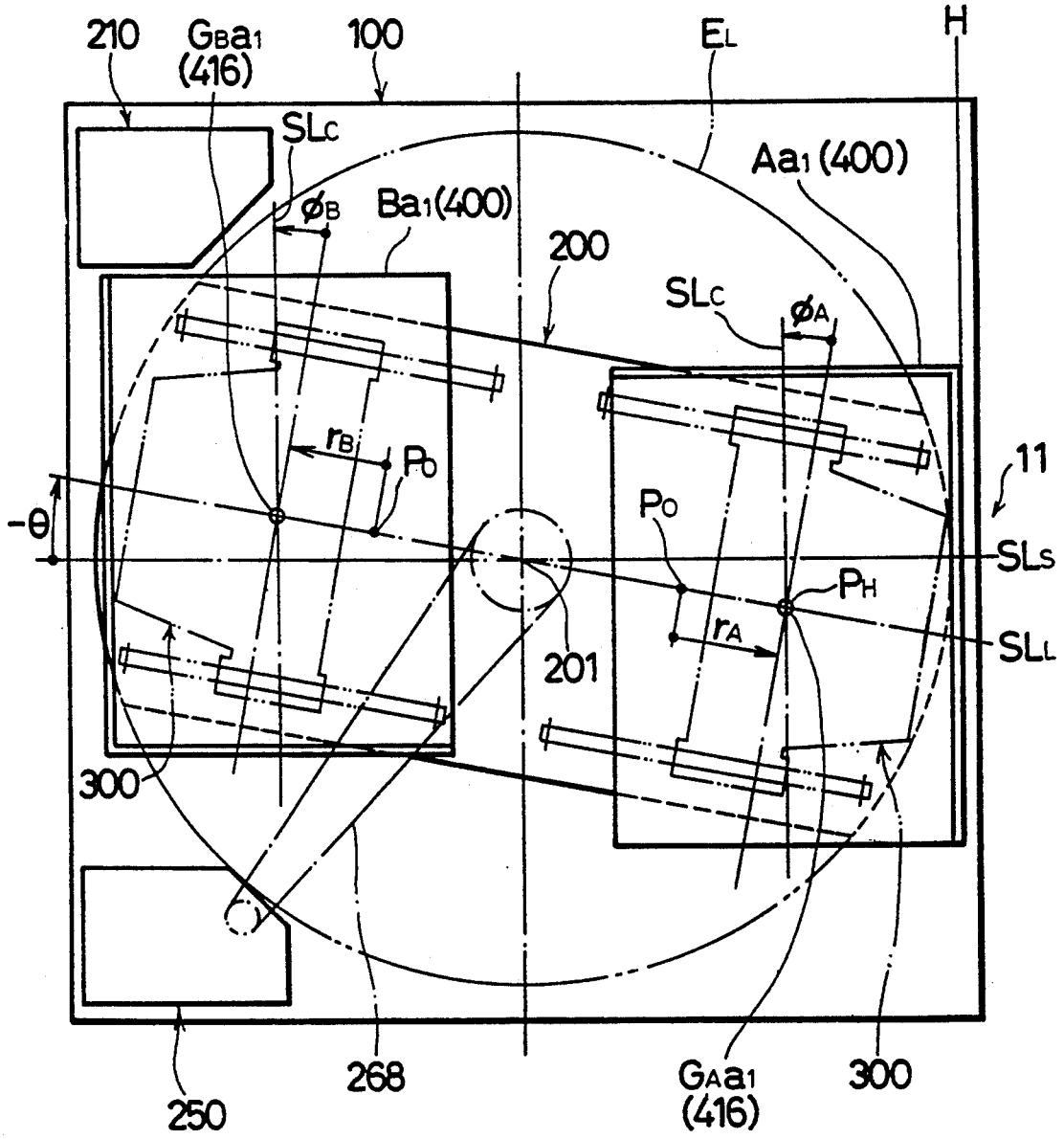
FIG. 32 is an explanatory view illustrating the states of the turntable, carriages and paper cassettes at time $a_1$ during Operation 1 shown in FIGS. 25 and 26.
Figure 33:
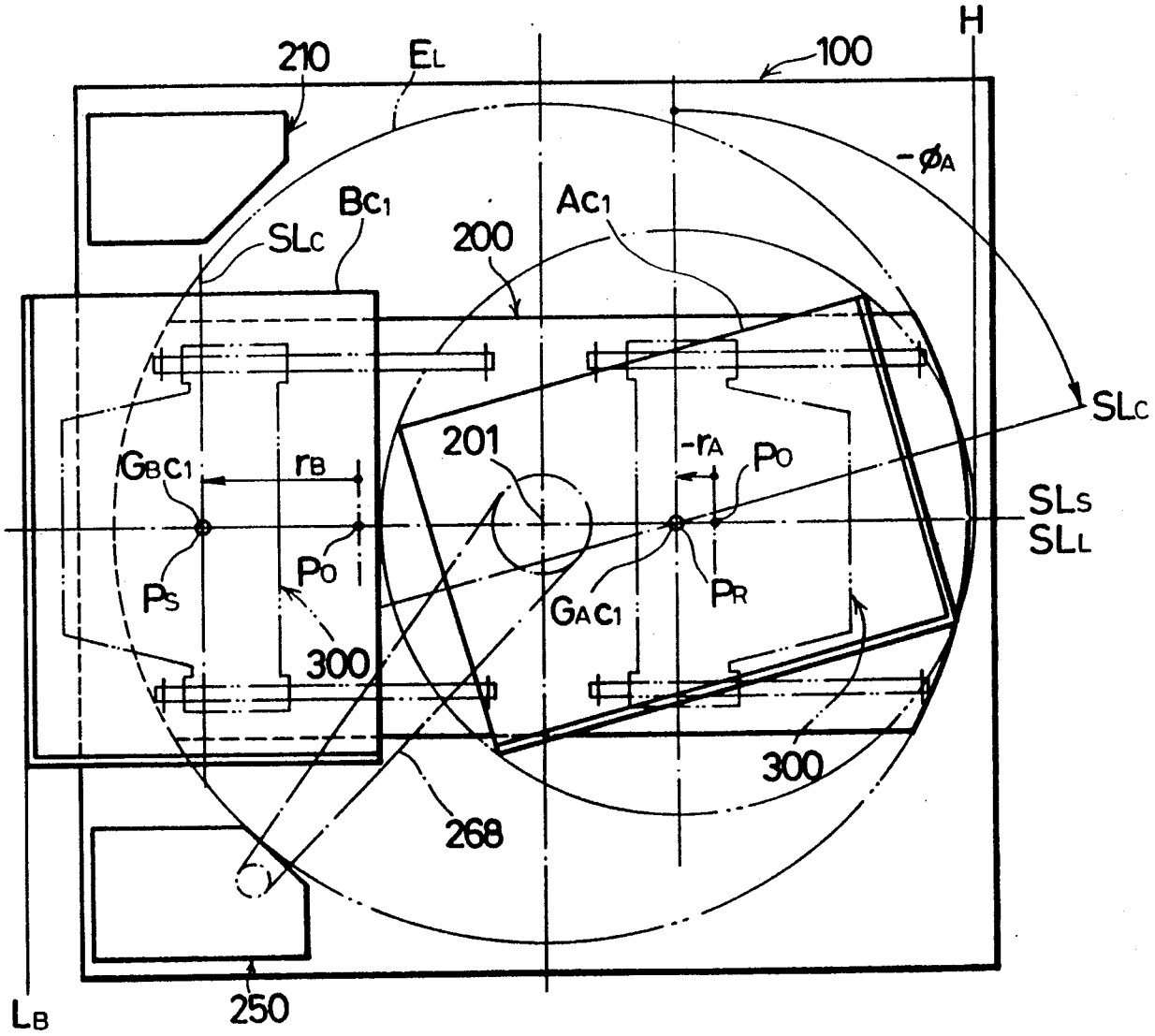
FIG. 33 is an explanatory view illustrating the states of the turntable, carriages and paper cassettes at time $c_1$ during Operation 1 shown in FIGS. 25 and 26.

The switching position is a position at which the two paper cassettes 400 placed side by side come to the closest proximity of the rotation shaft 201 of the turntable 200. It is defined in this embodiment that the sides of the paper cassettes 400 come into contact with each other on the rotation shaft 201 at the switching position. The sideways feeding position is a position at which, when the paper cassette 400 in the paper feeding side 11 is placed for sideways feeding as shown in FIG. 32, its leading end in the feeding direction aligns with a predetermined cassette leading end setting line H. The retracted position is a position at which, when switching the position of the paper cassette 400 in the paper feeding side 11 from sideways to lengthways as illustrated in FIG. 33, its leading end in the feeding direction does not protrude from the cassette leading end setting line H.

Figure 21:
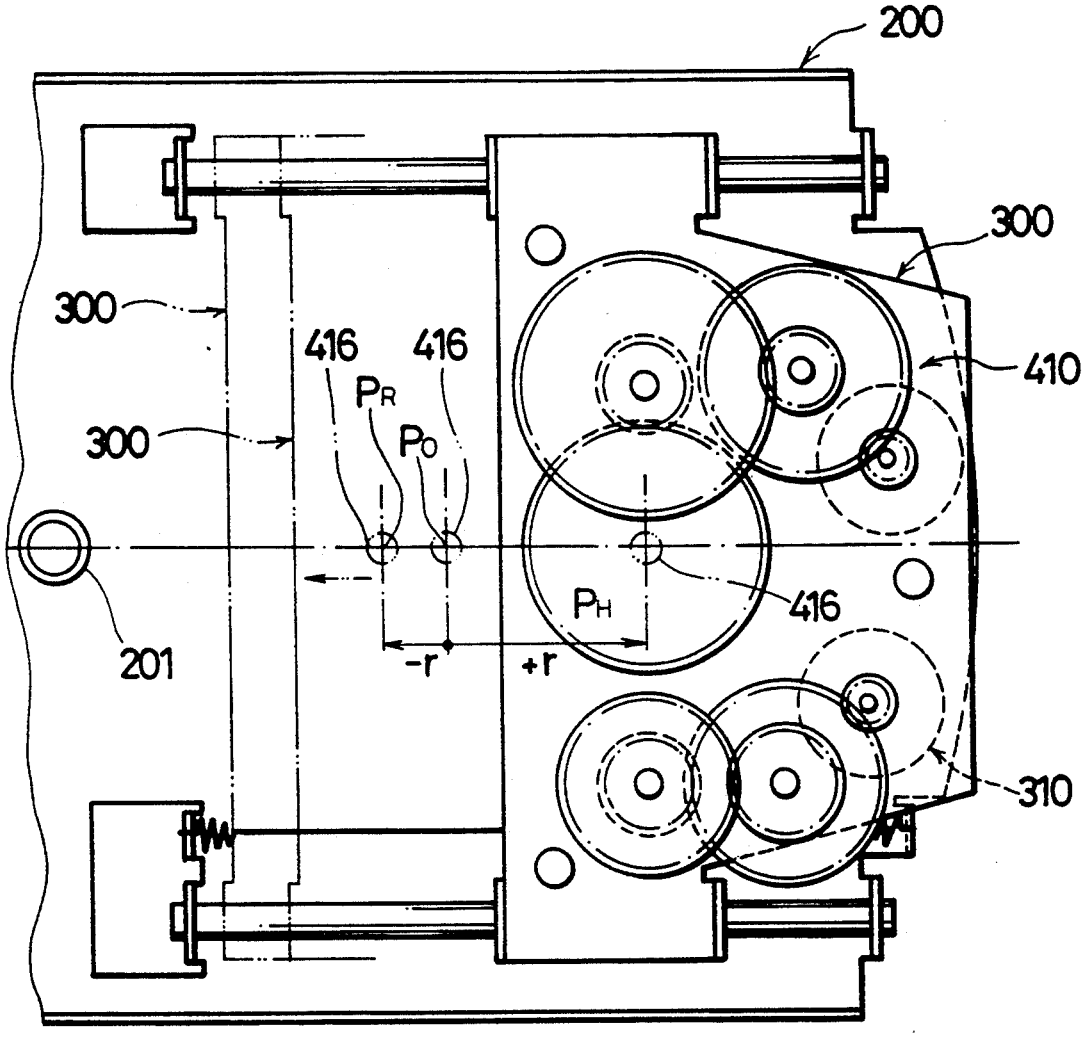
FIG. 21 a schematic plan view illustrating the operation of the carriage driving mechanism shown in FIGS. 10 and 11.
Figure 22:
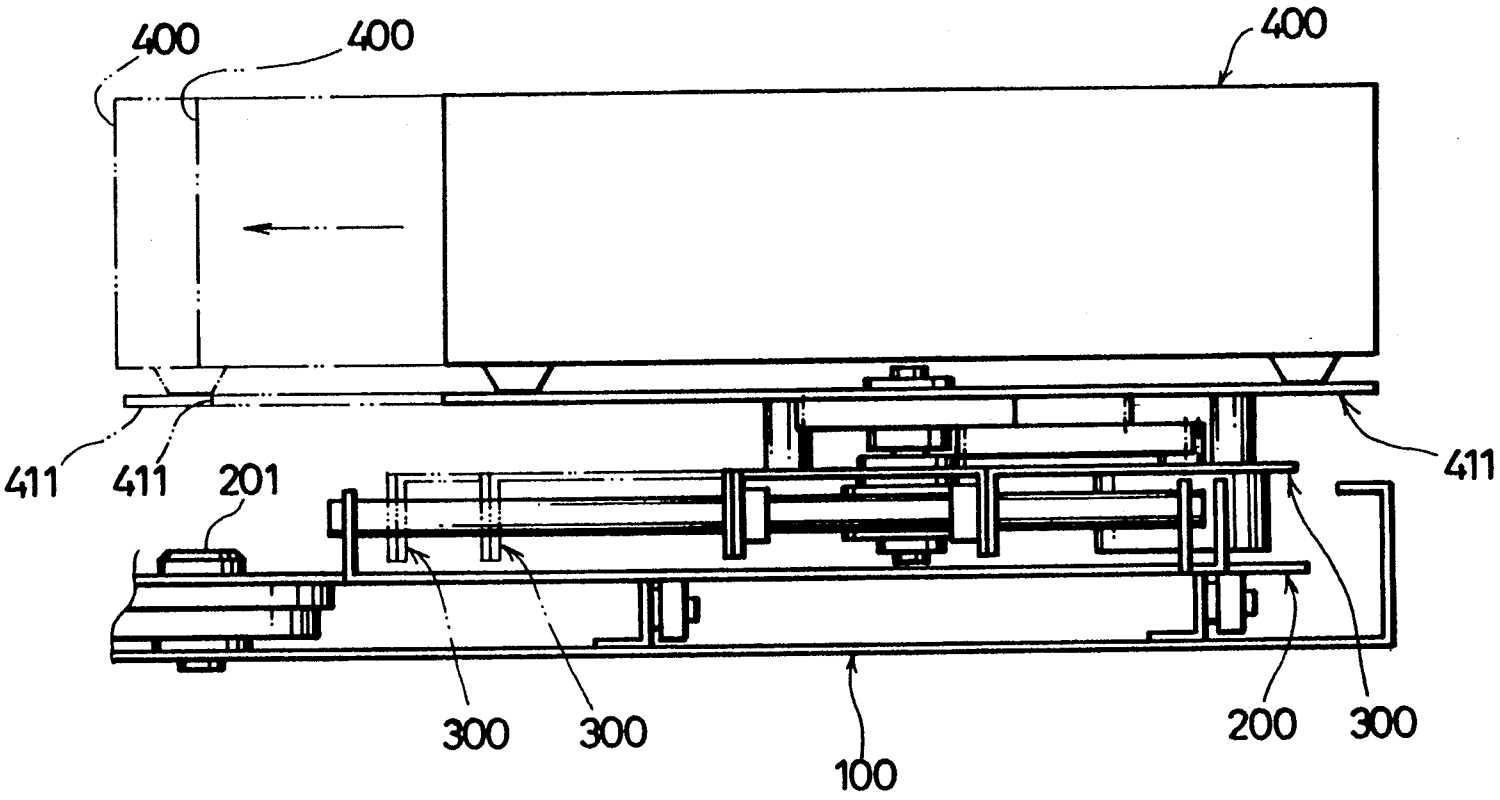
FIG. 22 is a schematic front view illustrating the movement of a paper cassette caused by the movement of the carriage shown in FIG. 21.

With the movement of the paper cassette 400 toward the switching, sideways feeding or retracted position, the cassette rotation shaft 416 is moved to a switching point $P_O$, sideways feeding point $P_H$ or retracted point $P_R$ shown in FIG. 21. Here, the paper cassette 400 is moved as shown in FIG. 22. It is assumed in the explanation of the carriage driving mechanism 310 that, taking the switching point $P_O$ as a reference point, the direction toward the rotation shaft 201 of the turntable 200, i.e., toward the sideways feeding point $P_H$ is a positive direction and its opposite direction, i.e., toward the retracted point $P_R$ is a negative direction.

When the carriage driving mechanism 310 is in the non-paper-feeding side, it drives the carriage 300 such that the paper cassette 400 in the non-paper-feeding side is moved between the switching position and a clearance position. The clearance position is a position at which the paper cassette 400 in the non-paper-feeding side protrudes from the tray 100 toward a direction opposite to the rotation shaft 201 of the turntable 200 and its protruding end aligns with a predetermined clearance line $L_B$ as illustrated in FIG. 33. When the paper cassette 400 in the non-paper-feeding side is located in the clearance position, it does not interfere with the rotation of the paper cassette 400 in the paper feeding side 11 for switching its position between the sideways and lengthways. With the movement of the paper cassette 400 toward the switching or clearance position, the cassette rotation shaft 416 is moved to the switching point $P_O$ shown in FIG. 38 or the clearance point $P_S$ shown in FIG. 33.

During $\phi$-axis driving by the cassette rotating mechanism 410, the power of the pulse motor 413 is increased at the reduction gear ratio $i_2$ and transmitted to the cassette rotation shaft 416 by the series of power transmission gears shown in FIGS. 14 to 15. The microcomputer 20 controls the cassette rotating mechanism 410 to rotate the paper cassette 400 such that the paper is fed according to a selected feeding mode, i.e., sideways or lengthways feeding and that leading edge of the paper toward the feeding direction forms right angles with the feeding direction. Moreover, the cassette rotating mechanism 410 is controlled such that the longest side of the paper cassette 400 in the non-paper-feeding side forms right angles with the paper feeding center line $SL_S$ during the rotation of the turntable 200 by the 180-degree rotating mechanism 210 and switching of the position of the paper cassette 400 in the paper feeding side 11 between sideways and lengthways.

Driving of the turntable 200 by the 180-degree rotating mechanism 210, $\theta$-axis driving, r-axis driving and $\phi$-axis driving enable the places of the cassette 400 in the paper feeding side 11 and the cassette 400 in the non-paper-feeding side to be interchanged and also the position of the paper cassette 400 in the paper feeding side 11 to be changed between lengthways and sideways.

Denoting the two paper cassettes 400 in the rotatable cassette unit 4 as cassette No. 1 and cassette No. 2, their states in the paper feeding side 11 are classified into four modes as described below.

Mode 1—cassette No. 1 is positioned for sideways feeding

Mode 2—cassette No. 1 is positioned for lengthways feeding

Mode 3—cassette No. 2 is positioned for sideways feeding

Mode 4—cassette No. 2 is positioned for lengthways feeding

Figure 23:
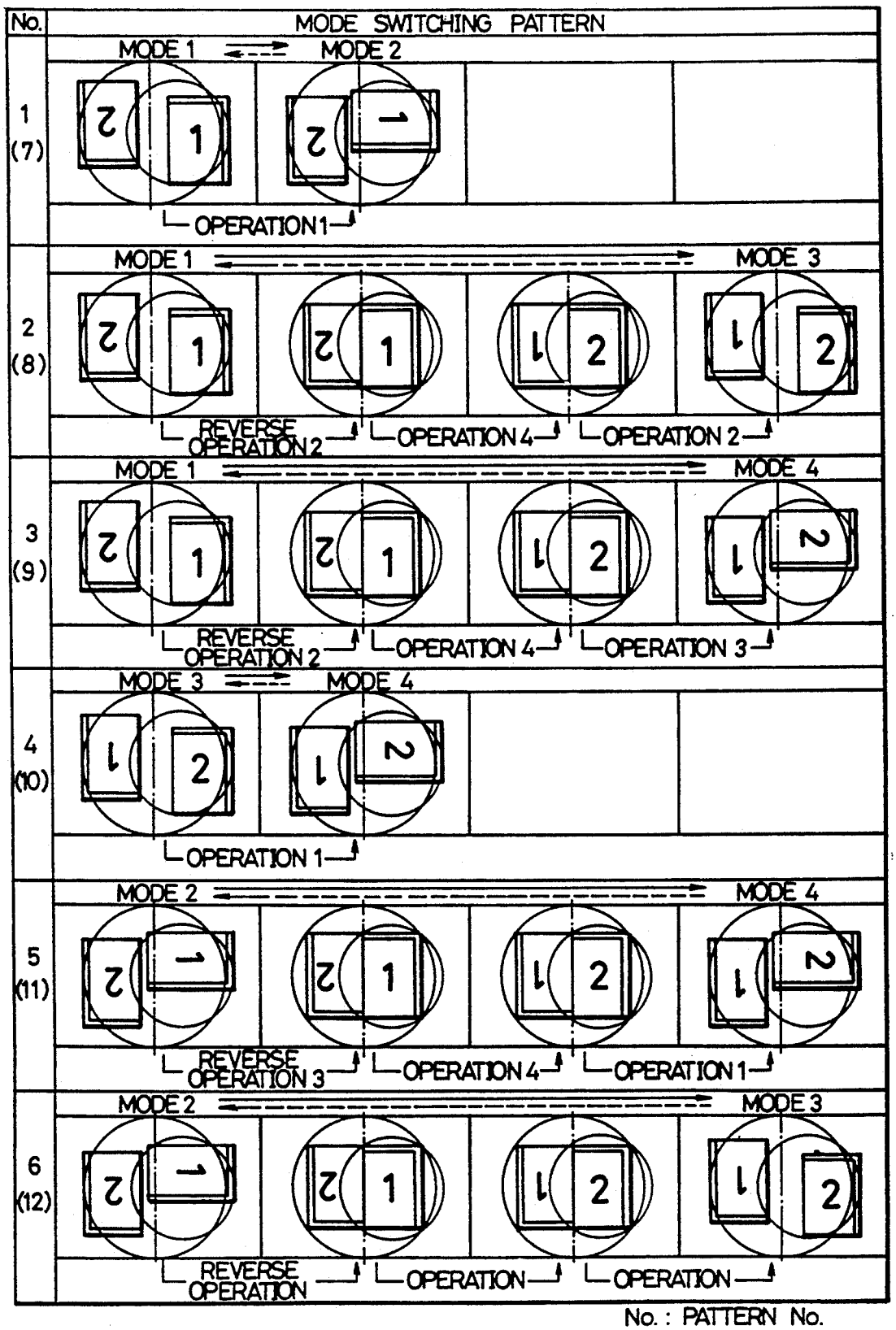
FIG. 23 is an explanatory view illustrating patterns of switching of modes of the paper cassettes executed by the 180-degree rotating mechanism, small angle rotating mechanism and carriage driving mechanisms shown in FIGS. 4 to 17.

As for switching of the states of cassettes No. 1 and No. 2 from one mode to other three modes, there are twelve switching patters in total. However, six, a half of the twelve switching patterns, are reverse operations of the other six, and six switching patterns shown in FIG. 23 are regarded as basic switching patterns. In the Figure, the basic switching patterns are indicated with the solid lines, while their reverse patterns are indicated with the broken lines. Besides, in each mode, the right is the paper feeding side 11 and the left is the non-paper-feeding side.

A single switching pattern is constituted by an operation or a combination of four operations described below.

Operation 1—switching the position of the paper cassette 400 in the paper feeding side 11 between lengthways and sideways Operation 2—after interchanging the places of the paper cassettes 400 in the paper feeding side 11 and in the non-paper-feeding side, positioning the paper cassette 400 in the paper feeding side 11 for sideways feeding Operation 3—after interchanging the places of the paper cassettes 400 in the paper feeding side 11 and in the non-paper-feeding side, positioning the paper cassette 400 in the paper feeding side 11 for lengthways feeding Operation 4—interchanging the places of the paper cassettes 400 in the paper feeding side 11 and non-paper-feeding side Denoting the reverse modes of Operations 1 to 4 as Reverse Operations 1 to 4, the mode switching patterns are respectively formed by combinations of Operations 1 to 4 and Reverse Operations 1 to 4 as shown in FIG. 24. Reverse Operations 1 to 4 are carried out by reversing the rotation of the corresponding motors.

Since the microcomputer 20 memorizes the mode switching patterns shown in FIG. 23 and their constituent operations shown in FIG. 24, after selecting a size of paper to be fed from B5, A5R, A4 and A4R it executes operations constituting a mode switching pattern according to the selection. This permits a selected cassette to be placed in the paper feeding position in the corresponding mode. Further, since the 180-degree rotating mechanism 210, small angle rotating mechanism 250, carriage driving mechanism 310 and cassette rotating mechanism 410 are controlled by the above-mentioned four operations, that is, a series of controlling operations, control of the respective mechanisms is simplified.

The following will explain Operations 1 to 4 controlled by the microcomputer 20.

First, Operation 1 of switching the state of a cassette from Mode 1 to Mode 2 will be explained. Assuming that the paper cassette 400 for B5-sized paper is located in the paper feeding side 11 and the paper cassette 400 for A4-sized paper is located in the non-paper-feeding side.

Figure 25:
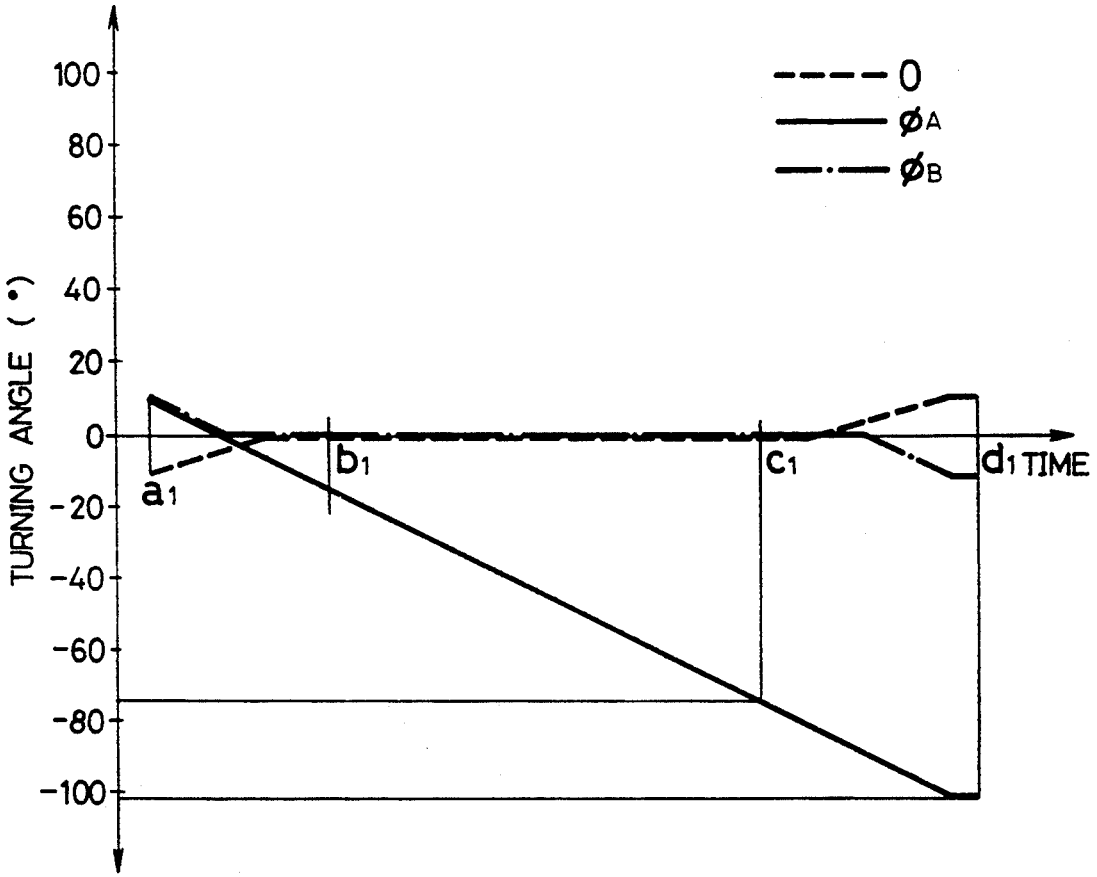
FIG. 25 is a graph illustrating the relations between the turning angle ($\theta$) of the rotation shaft of the turntable and the turning angles ($\phi_A$ and $\phi_B$) of the cassette rotation shafts of the paper cassettes in the paper feeding side and non-paper-feeding side and time during Operation 1 shown in FIG. 24.
Figure 26:
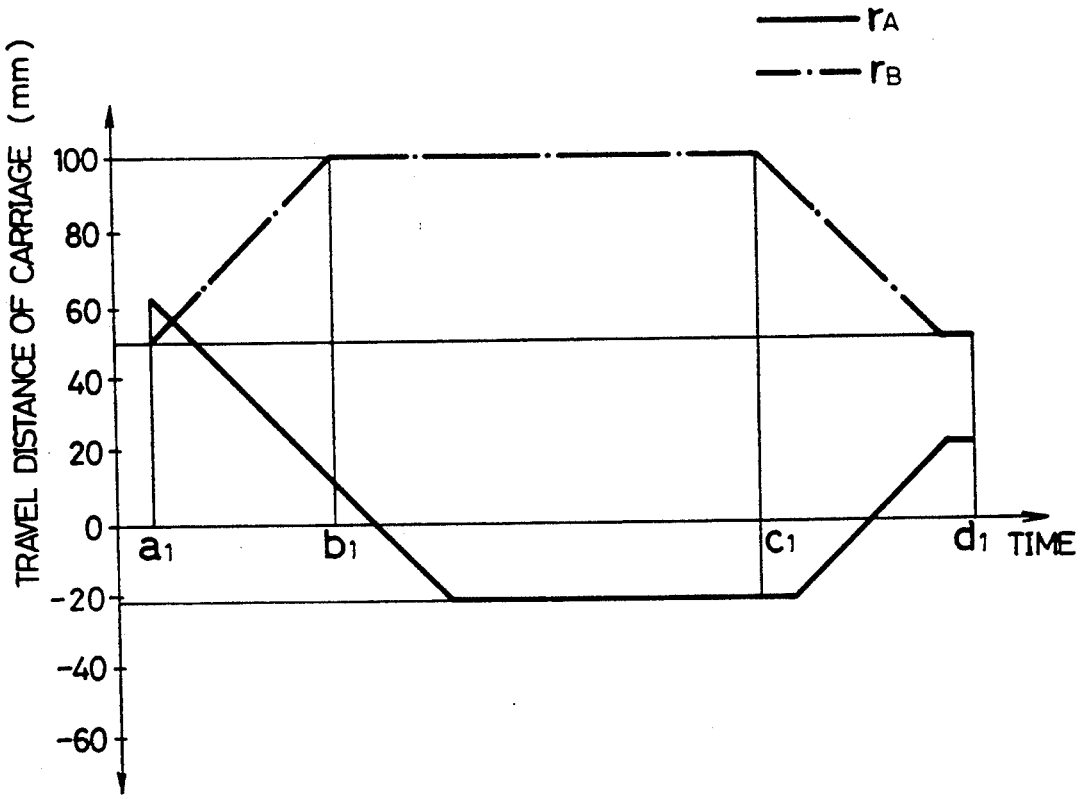
FIG. 26 is a graph illustrating the relations between the travel distances ($r_A$ and $r_B$) of the carriages in the paper feeding side and non-paper-feeding side and time during Operation 1 shown in FIG. 24.

In Operation 1, to shorten the operation time, the $\theta$-axis driving for rotating the turntable 200 by the small angle rotating mechanism 250 and the $\phi$-axis driving for turning the paper cassette 400 by the cassette rotating mechanism 410 shown in FIG. 25 and the r-axis driving for moving the carriage 300 by the carriage driving mechanism 310 shown in FIG. 26, are simultaneously controlled. Similarly, the $\theta$-axis driving, $\phi$-axis driving and r-axis driving are simultaneously controlled in Operations 2 and 3.

As illustrated in FIG. 32, $\theta$ represents the displacement of the rotation shaft 201 of the turntable 200, i.e., turning angle. This is an angle between the paper feeding center line $SL_S$ and the rotated turntable center line $SL_L$ extending in the longitudinal direction of the turntable 200, i.e., a line passing through the cassette rotation shafts 416 of the two paper cassettes 400 and the rotation shaft 201 of the turntable 200. Additionally, with regard to $\theta$, the displacement in the counterclockwise direction is given by a positive value and the displacement in the clockwise direction is given by a negative value. Each of $\phi_A$ and $\phi_B$ represents the turning angle of the paper cassette 400 with respect to the turntable center line $SL_L$. This turning angle indicates how much a cassette center line $SL_C$ which crosses the paper feeding center line $SL_S$ at right angles when the paper cassette 400 is in a state $Aa_1$ for sideways feeding, is moved out of the condition when it crosses the turntable center line $SL_L$ at right angles. With regard to $\theta$, similar to the above, the displacement in the counterclockwise direction is given by a positive value and the displacement in the clockwise direction is given by a negative value. Each of $r_A$ and $r_B$ represents the travel distance of the cassette rotation shaft 416 from the switching point $P_O$ shown in FIG. 21 as the result of the movement of the carriage 300. Regarding the travel distance, the movement from the switching point $P_O$ toward the rotation shaft 201 is given by a negative value and the movement in the opposite direction is given by a positive value.

In this embodiment, since the reduction gear ratios $i_1$, $i_2$ and $i_4$ are set for the $\theta$-axis driving, r-axis driving and $\phi$-axis driving respectively, the $\theta$-axis driving, r-axis driving and $\phi$-axis driving are controlled simultaneously by a uniform motion, i.e., by maintaining the relations, $r:\phi:\theta = 2$ mm:1°:0.5°. In this embodiment, this operation is performed by driving the pulse motors 258, 311 and 413 as power source at a frequency, 100 PPS, 7.5°/step.

Figure 27:
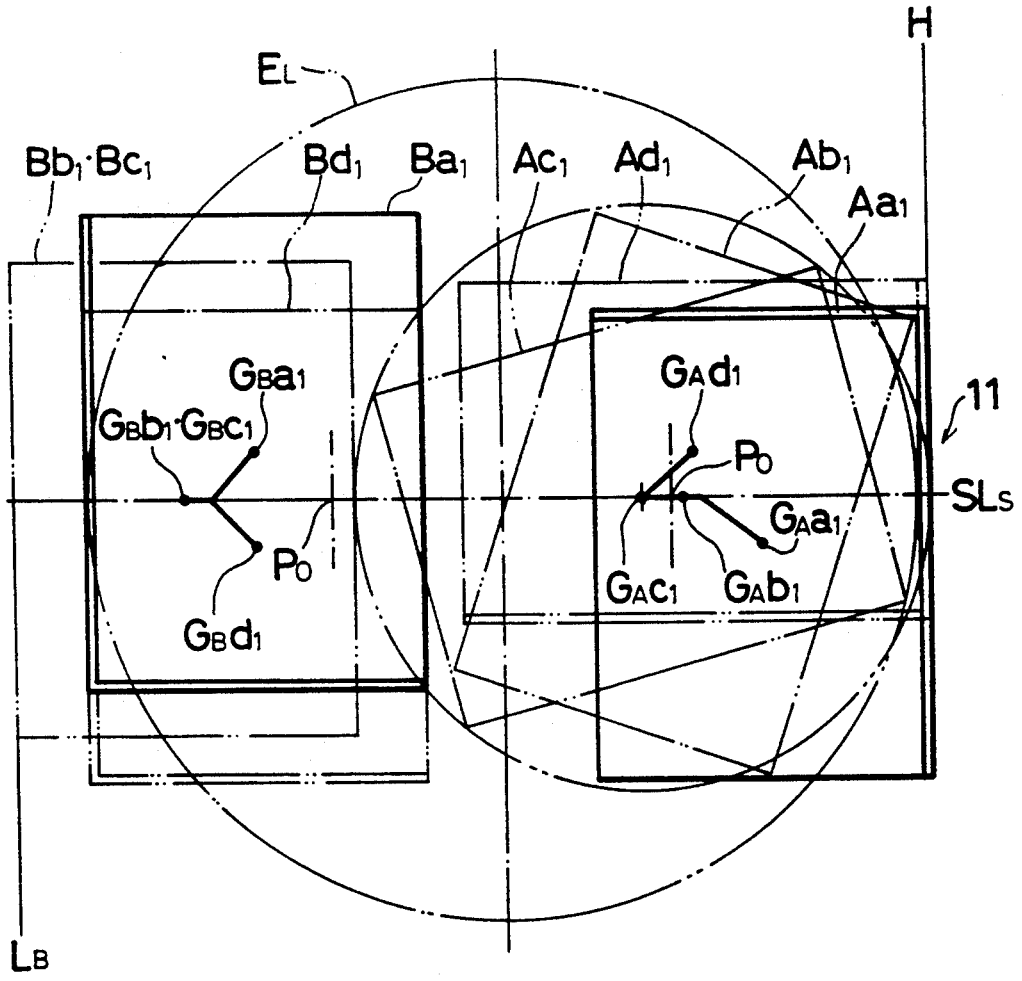
FIG. 27 is an explanatory view illustrating the locations of the cassette rotation shafts and the paper cassettes at time $a_1$ to time $d_1$, in relation to the rotation of the turntable's rotation shaft and of the cassette rotation shafts shown in FIG. 25 and the movements of the carriages shown in FIG. 26.

When Operation 1 is started in the state of Mode 1, with the controlling operations shown in FIGS. 26 and 27 the cassette A in the paper feeding side 11 storing B5-sized paper is moved from the sideways feeding state $Aa_1$ at start time $a_1$ drawn with the solid line to a lengthways feeding state $Ad_1$ via states $Ab_1$ and $Ac_1$ indicated with the alternate long and two short dashes lines according to elapsed time, $b_1$, $c_1$ and $d_1$ as illustrated in FIG. 27. During the operation, the cassette A is moved such that its leading end in the feeding direction is moved substantially along the predetermined cassette leading end setting line H without causing it to protrude from the cassette leading end setting line H. It is arranged that when the cassette A is set in the paper feeding position for sideways or lengthways feeding, the leading end of the cassette A in the feeding direction aligns with the cassette leading end setting line H. Moreover, denoting the cassette rotation shaft 416, i.e., the rotation axis of the cassette A and the cassette rotation shaft 416 of the cassette B as a cassette rotation shaft $G_A$ and a cassette rotation shaft $G_B$, respectively, the cassette rotation shaft $G_A$ is moved to $G_Aa_1$ to $G_Ad_1$ in accordance with the states $Aa_1$ to $Ad_1$ of the cassette A.

As for a cassette B in the non-paper-feeding side, to avoid interference between the cassettes A and B, it is moved from a sideways feeding state $Ba_1$ at start time $a_1$ drawn with the solid line to a state $Bd_1$ via states $Bb_1$ and $Bc_1$ illustrated with the alternate long and two short dashes lines according to elapsed time, $b_1$, $c_1$ and $d_1$. As a result, the cassette rotation shaft $G_B$ is moved to $G_Ba_1$ to $G_Bd_1$ in accordance with the states $Ba_1$ to $Bd_1$ of the cassette B.

Figure 28:
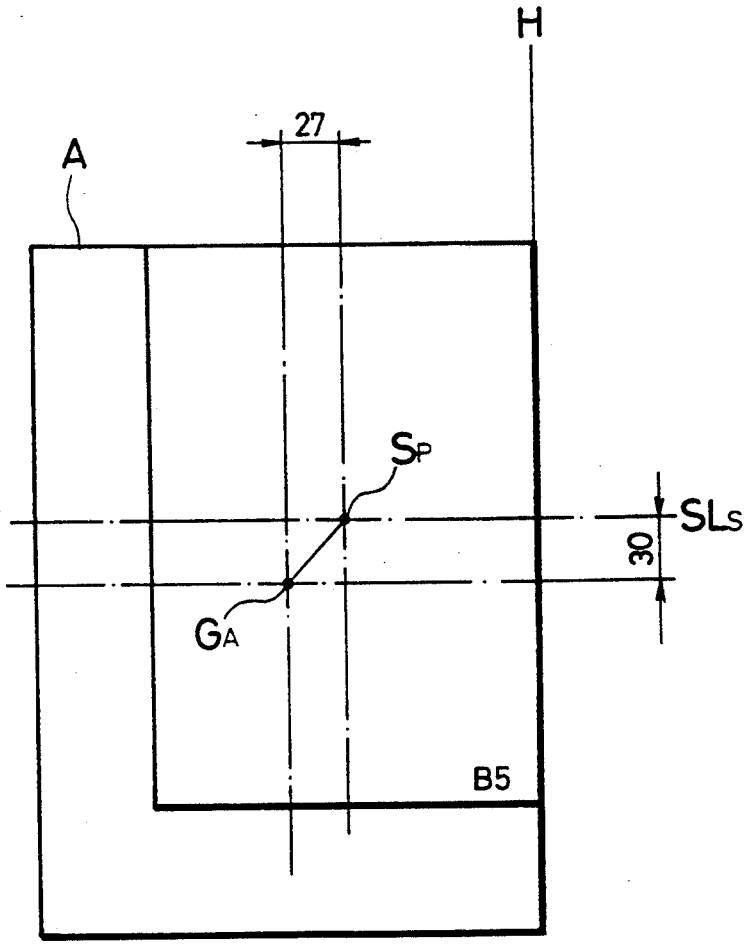
FIG. 28 is an explanatory view illustrating the relations between the paper feeding center line $SL_S$ and the paper center $S_P$ of B5-sized paper stored in the paper cassette that is positioned for sideways feeding and the cassette rotation shaft $G_A$.
Figure 29:
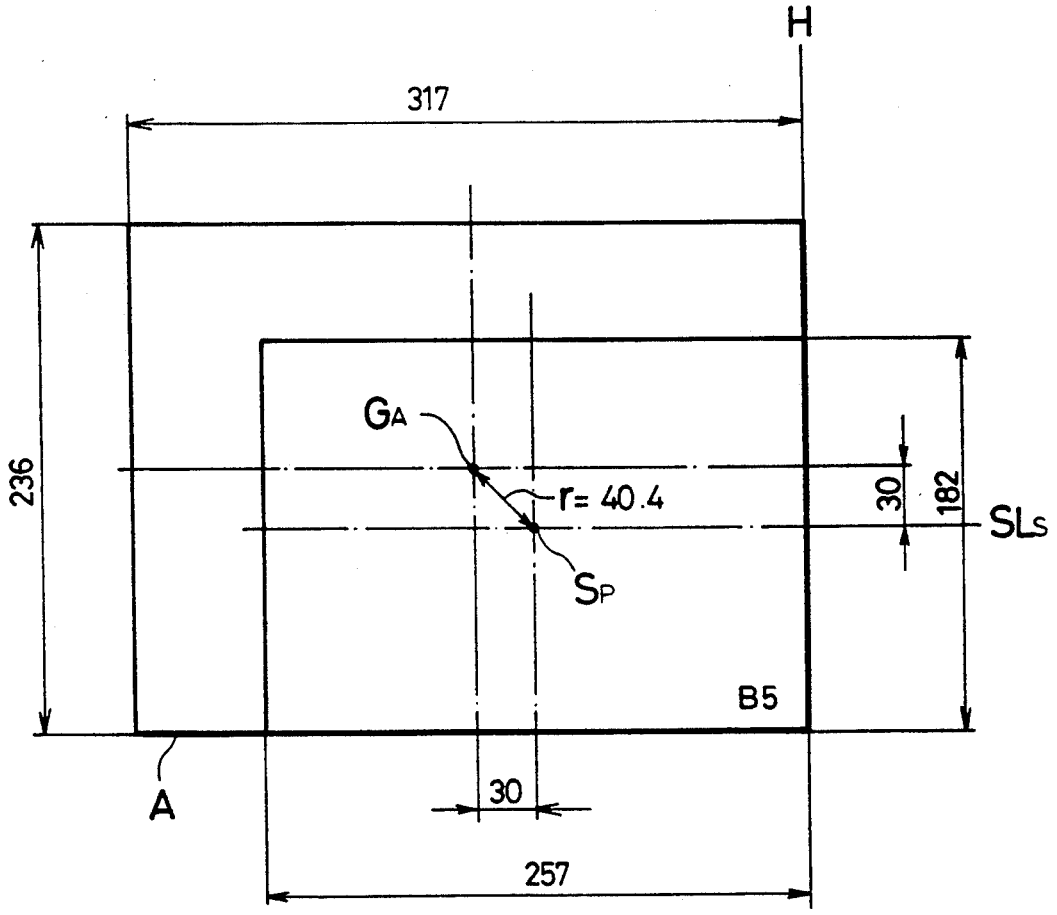
FIG. 29 is an explanatory view illustrating the relations between the paper feeding center line $SL_S$ and the paper center $S_P$ of B5-sized paper stored in the paper cassette that is positioned for lengthways feeding and the cassette rotation shaft $G_A$.
Figure 30:
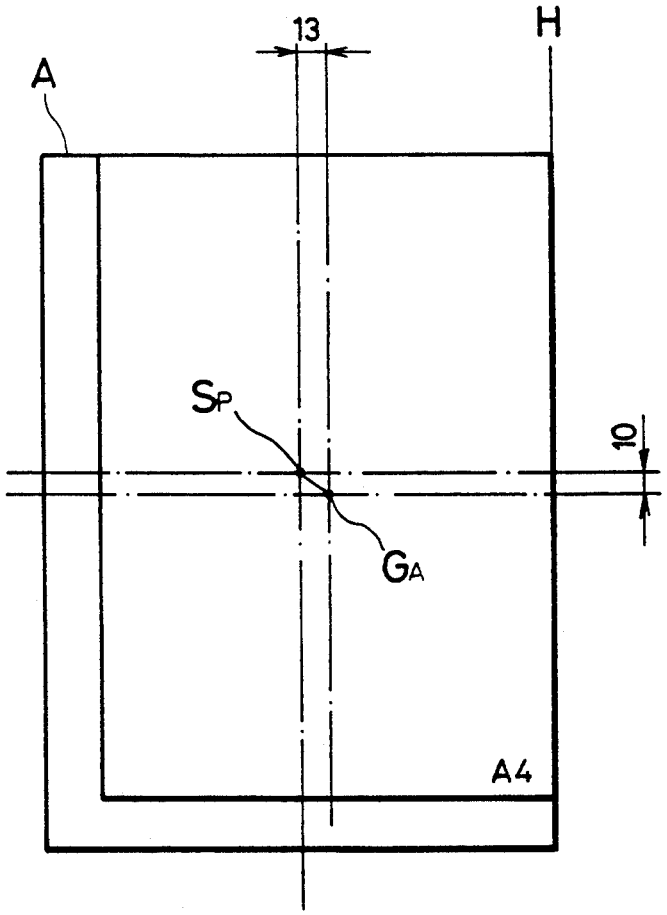
FIG. 30 is an explanatory view illustrating the relations between the paper feeding center line $SL_S$ and the paper center $S_P$ of A4-sized paper stored in the paper cassette that is positioned for sideways feeding and the cassette rotation shaft $G_A$.
Figure 31:
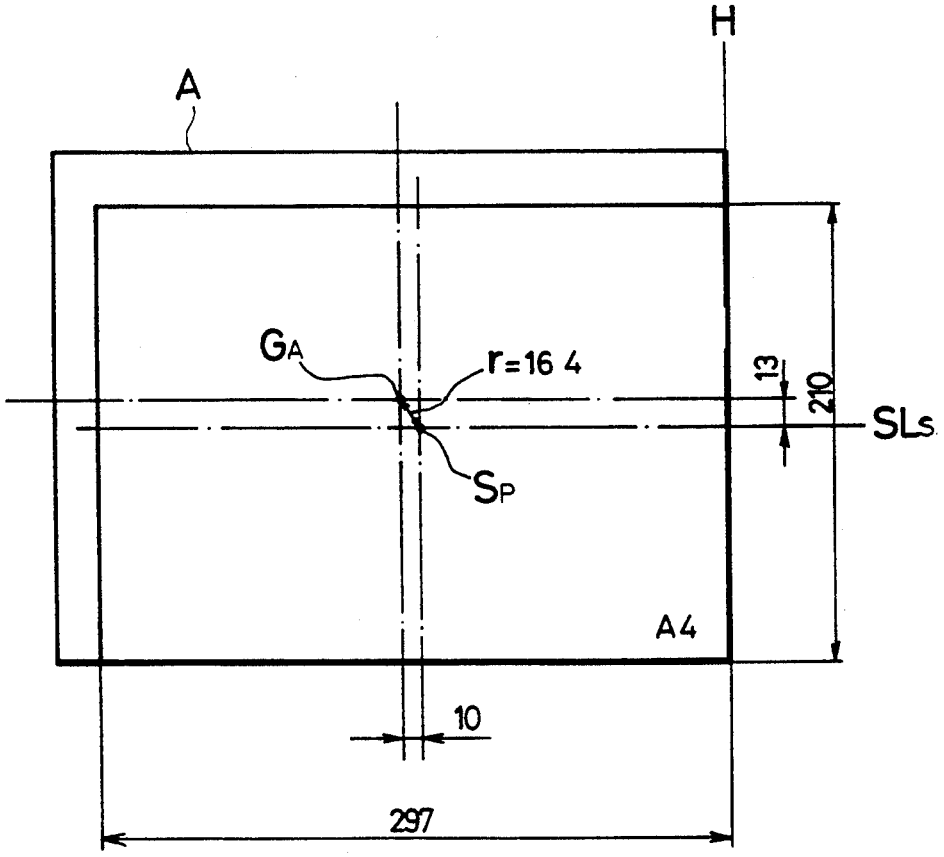
FIG. 31 is an explanatory view illustrating the relations between the paper feeding center line $SL_S$ and the paper center $S_P$ of A4-sized paper stored in the paper cassette that is positioned for lengthways feeding and the cassette rotation shaft $G_A$.

As illustrated in FIG. 28, when the cassette A is in the sideways feeding state $Aa_1$, the cassette rotation shaft $G_A$ is in an offset state with respect to the paper feeding center line $SL_S$ since the paper center $S_P$ of the paper stored in the cassette A, whose one side is uniformly registered against one of the longest sides of the cassette A, is aligned with the paper feeding center line $SL_S$ of the multi-stage paper feeding device 2. This is due to the fact that the paper center $S_P$ of the B5-sized paper stored in the cassette A is in the offset state with respect to the cassette rotation shaft $G_A$. The paper center $S_P$ and the cassette rotation shaft $G_A$ also come into an offset state when B5-sized paper is stored in the cassette A positioned for lengthways feeding as shown in FIG. 29, when A4-sized paper is stored in the cassette A positioned for sideways feeding as shown in FIG. 30, and when A4-sized paper is stored in the cassette A positioned for lengthways feeding as shown in FIG. 31. In each case, the cassette rotation shaft $G_A$ is in an offset state with respect to the paper feeding center line $SL_S$.

Therefore, when the cassette A in the paper feeding side 11 is in the sideways feeding state $Aa_1$, i.e., at start time $a_1$, as illustrated in FIG. 32, the turntable 200 is turned by an angle of $-\theta$ by the $\theta$-axis driving in order to align the paper center $S_P$ shown in FIG. 28 with the paper feeding center line $SL_S$. At this time, the cassette rotation shaft $G_A$ is also rotated by an angle of $+\phi_A$ by the $\phi$-axis driving as shown in FIG. 28 so that the leading edge of the paper in the feeding direction crosses the paper feeding center line $SL_S$ at right angles. Further, the carriage 300, i.e., the cassette rotation shaft $G_A$ is moved by a distance of $+r_A$ shown in FIG. 28 by the r-axis driving in order to align the leading end of the cassette A in the feeding direction with the cassette leading end setting line H. On the contrary, regarding the cassette B in the non-paper-feeding side, the cassette rotation shaft $G_B$ is rotated by an angle of $+\phi_B$ that is equal to $\phi_A$ and moved by a distance of $+r_B$.

At time $b_1$ the turntable 200 is not turned, $\theta = 0°$, i.e., in a stationary state in which the turntable center line $SL_L$ is aligned with the paper feeding center line $SL_S$. In this state, the cassette A is rotated with a uniform speed toward the negative direction by the $\phi$-axis driving, and is moved in the negative direction with respect to the point $G_Aa_1$ by the r-axis driving without causing its leading end in the feeding direction to protrude from the cassette leading end setting line H. Meanwhile, with regard to the cassette B, as illustrated in FIG. 33, at time $c_1$, the cassette rotation shaft $G_B$ is not rotated, $\phi_B = 0°$, i.e., in a stationary state where the cassette center line $SL_C$ crosses the turntable center line $SL_L$ at right angles. In this state, the cassette rotation shaft $G_B$ is moved in the positive direction from the switching point $P_O$ to the furthermost clearance point $P_S$ and stopped. It is arranged in this embodiment that $r_B = 101$ mm. Accordingly, the cassette B is stopped in a state in which its end protrudes from the tray 100 to the clearance line $L_B$ and its cassette center line $SL_C$ crosses the paper feeding center line $SL_S$ at right angles at the clearance position located furthest away from the rotation shaft 201 of the turntable 200.

At time $c_1$, as illustrated in FIG. 33, the states of the turntable 200 and the cassette B in the non-paper-feeding side are the same as that at time $b_1$. At this time, with regard to the cassette A, the cassette rotation shaft $G_A$ is rotated with a uniform speed toward the negative direction by the $\phi$-axis driving, and is moved to the retracted point $P_R$ by the r-axis driving. In this Figure, the cassette rotation shaft $G_A$ is rotated by an angle of $\phi_A$, that is, $-75$ degrees.

Figure 34:
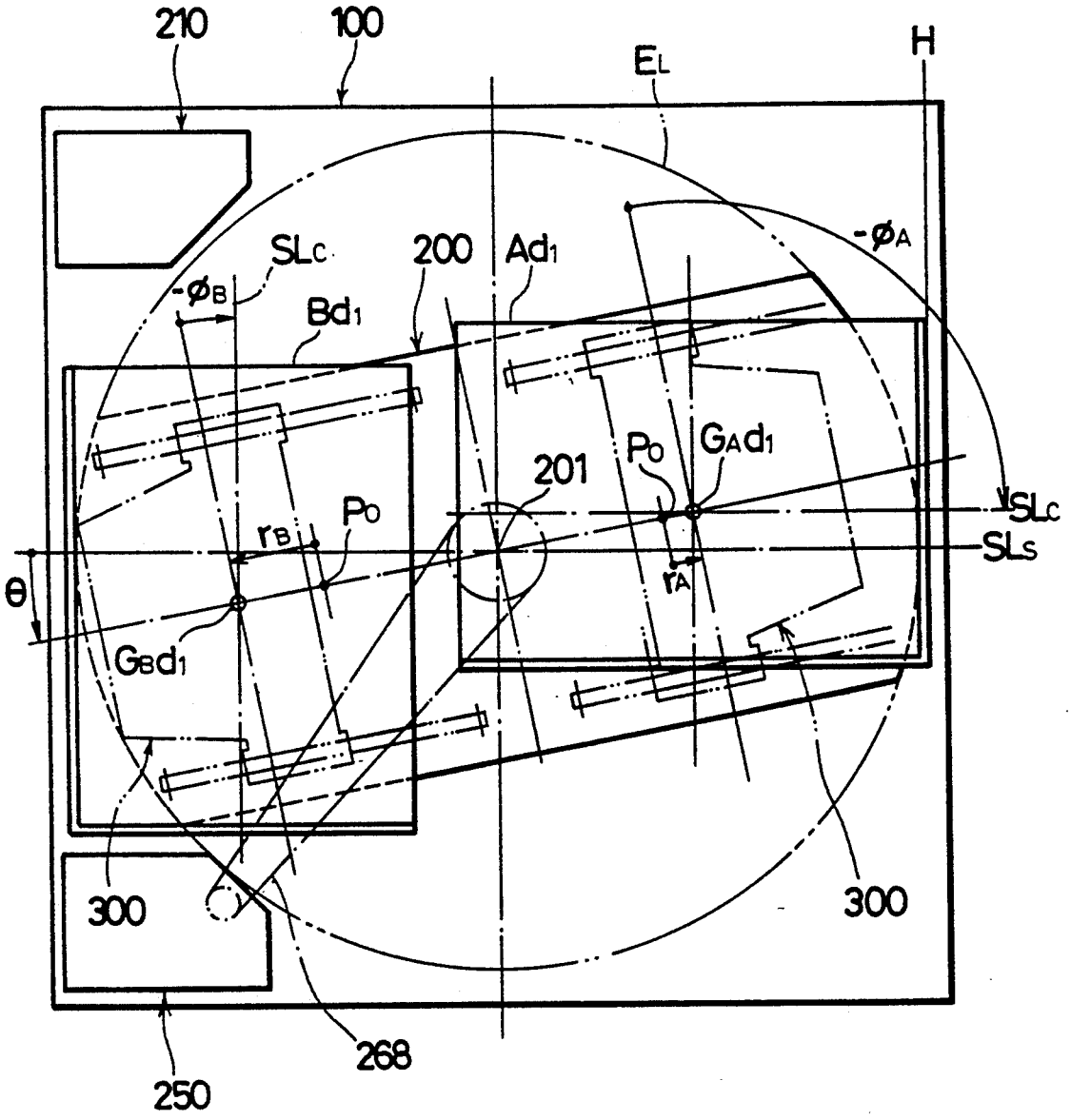
FIG. 34 is an explanatory view illustrating the states of the turntable, carriages and paper cassettes at time $d_1$ during Operation 1 shown in FIGS. 25 and 26.

At time $d_1$ Operation 1 is completed. As illustrated in FIG. 34, the turntable 200 is turned by an angle of $+\theta$ by the $\theta$-axis driving in order to align the paper center $S_P$ shown in FIG. 31 with the paper feeding center line $SL_S$, and is stopped. At this time, with regard to the cassette A, the cassette rotation shaft $G_A$ is rotated by an angle of $-\phi_A$ by the $\phi$-axis driving so that the cassette center line $SL_C$ is parallel with the paper feeding center line $SL_S$ and that the leading edge of the paper in the feeding direction crosses the paper feeding center line $SL_S$ at right angles. Further, the cassette rotation shaft $G_A$ is moved by a distance of $+r_A$ shown in FIG. 31 by the r-axis driving in order to align the leading end of the cassette A in the feeding direction with the cassette leading end setting line H. On the contrary, regarding the cassette B in the non-paper-feeding side, the cassette rotation shaft $G_B$ is rotated by an angle of $-\phi_B$ and moved by a distance of $+r_B$ that is equal to the distance moved in the state $Ba_1$.

Operation 2 will be explained below.

Figure 35:
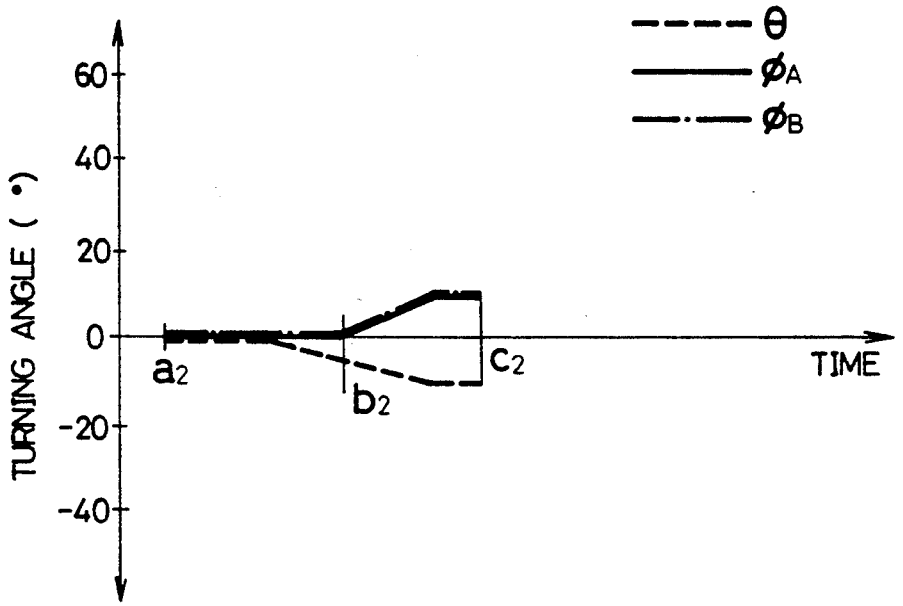
FIG. 35 is an explanatory view illustrating the relations between the turning angle ($\theta$) of the rotation shaft of the turntable and the turning angles ($\phi_A$ and $\phi_B$) of the cassette rotation shafts of the paper cassettes in the paper feeding side and non-paper-feeding side and time during Operation 2 shown in FIG. 24.
Figure 36:
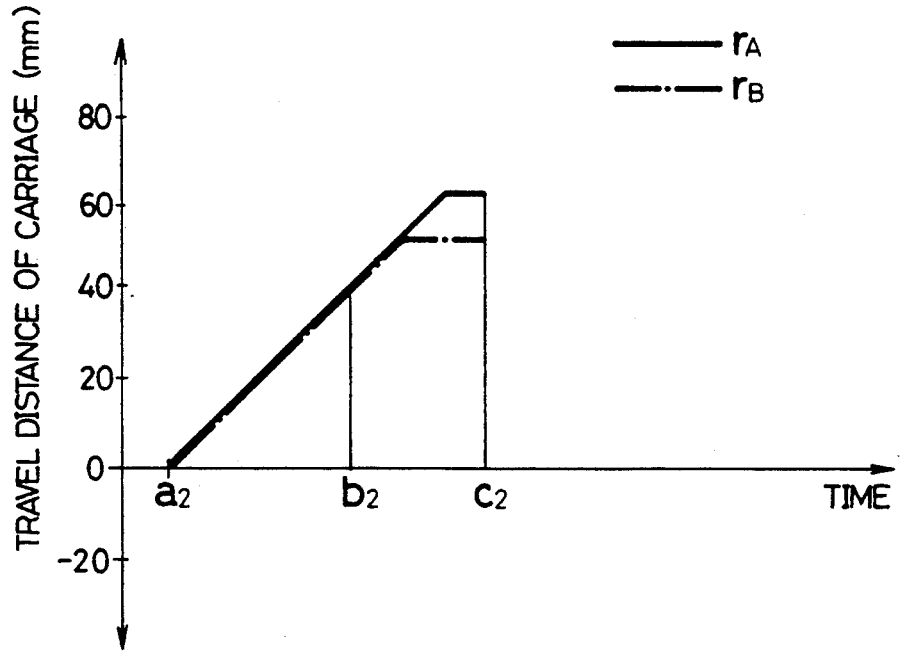
FIG. 36 is a graph illustrating the relations between the travel distances ($r_A$ and $r_B$) of the carriages in the paper feeding side and non-paper-feeding side and time during Operation 2 shown in FIG. 24.
Figure 37:
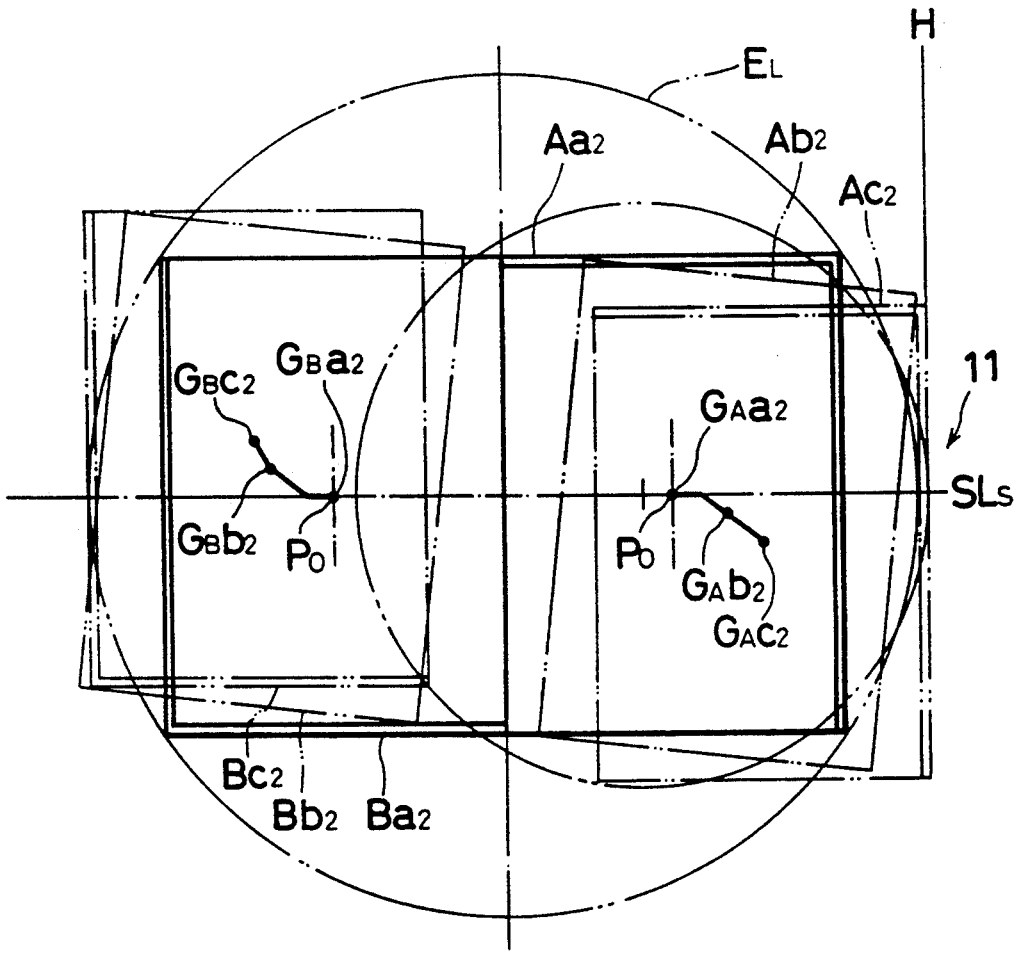
FIG. 37 is an explanatory view illustrating the locations of the cassette rotation shafts and the paper cassettes at time $a_2$ to time $c_2$, in relation to the rotation of the turntable's rotation shaft and of the cassette rotation shafts shown in FIG. 35 and the movements of the carriages shown in FIG. 36.

In Operation 2, as described above, after interchanging the places of the paper cassettes 400 in the paper feeding side 11 and in the non-paper-feeding side, the paper cassette 400 in the paper feeding side 11 is positioned for sideways feeding. During Operation 2, as illustrated in FIG. 37, at start time $a_2$ the cassettes A and B are in the states $Aa_2$ and $Ba_2$, i.e., they are in the closest proximity as shown with the solid lines, and then parted from each other to reach states $Ac_2$ and $Bc_2$ via states $Ab_2$ and $Bb_2$ shown with the alternate long and two short dashes lines according to elapsed time $b_2$ and $c_2$ by the controlling operations shown in FIGS. 35 and 36. With this operation, finally the cassette A is positioned for sideways feeding. During the operation, the rotation shafts $G_A$ and $G_B$ of the cassettes A and B are also moved to $G_Aa_2$ to $G_Ac_2$ and to $G_Ba_2$ to $G_Bc_2$, respectively, in accordance with the states $Aa_2$ to $Ac_2$ and $Ba_2$ to $Bc_2$ of the cassettes A and B.

Figure 38:
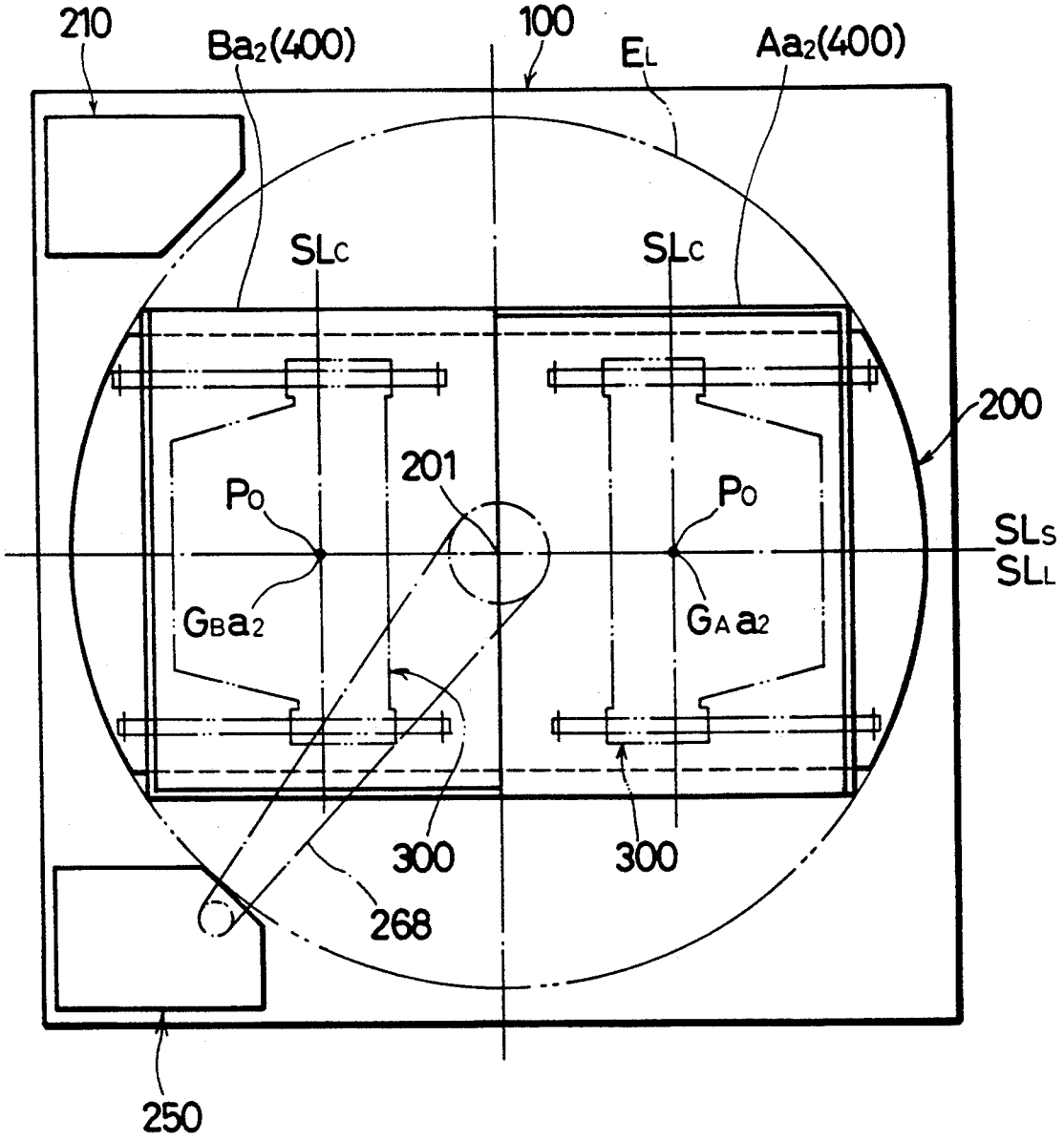
FIG. 38 is an explanatory view illustrating the states of the turntable, carriages and paper cassettes at time $a_2$ during Operation 2 shown in FIGS. 35 and 36.

When Operation 2 is started at time $a_2$, as illustrated in FIG. 38, the turntable 200 is stopped, $\theta=0°$. In this state, both $\phi_A$ and $\phi_B$ are 0 degrees, the cassette center lines $SL_C$ of the cassettes A and B cross the turntable center line $SL_L$ and the paper feeding center line $SL_S$ at right angles respectively, both $r_A$ and $r_B$ are 0 degrees, and the cassette rotation shafts $G_A$ and $G_B$ of the cassettes A and B are located at the respective switching points $P_O$.

At time $b_2$, the turntable 200 is turned in the negative direction by the $\theta$-axis driving. At this time, the cassette center lines $SL_C$ of the cassettes A and B still cross the turntable center line $SL_L$ at right angles. In addition, the cassette rotation shafts $G_A$ and $G_B$ of the cassettes A and B are respectively moved toward the positive direction from the switching points $P_O$ by the r-axis driving.

Figure 39:
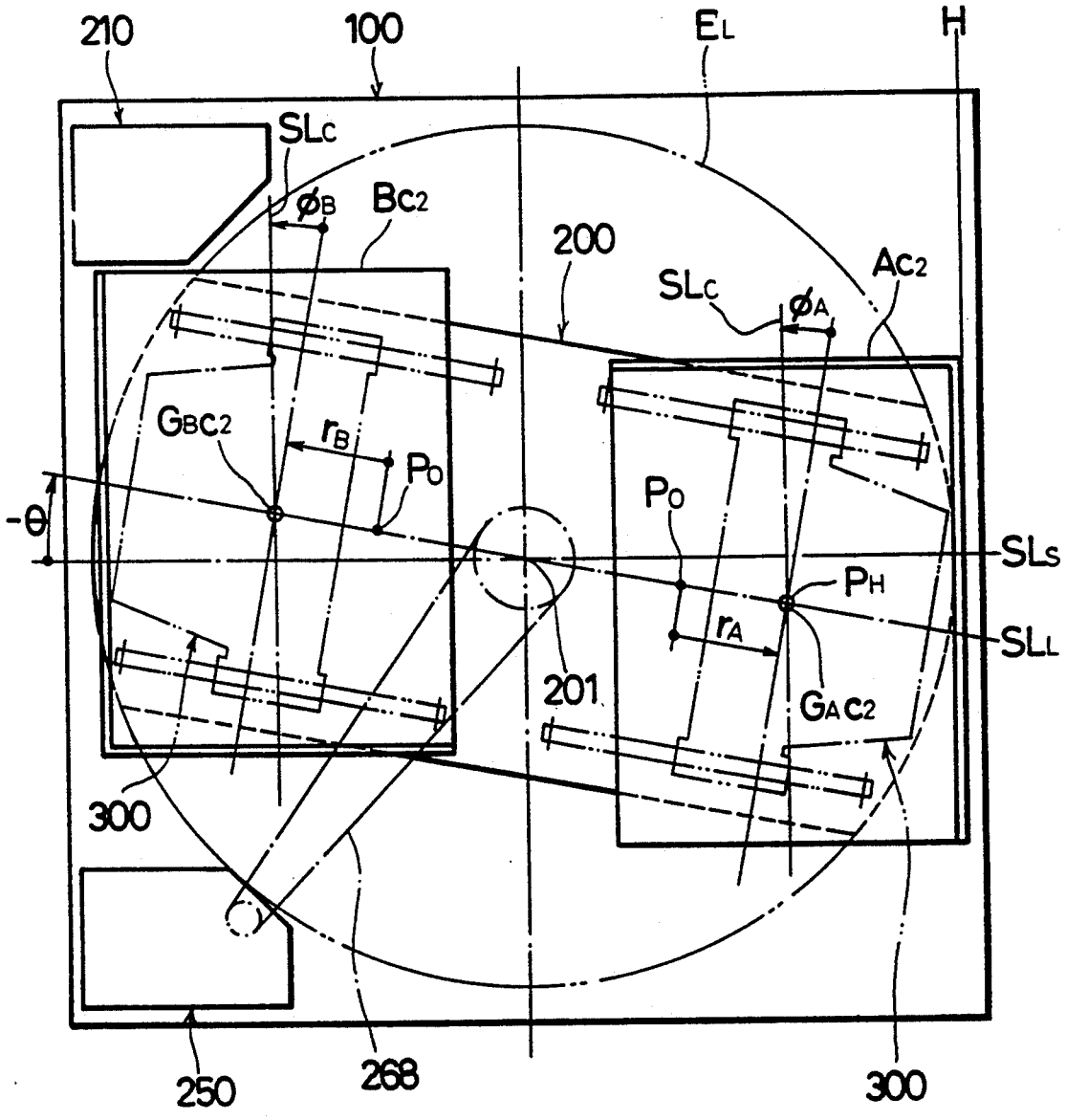
FIG. 39 is an explanatory view illustrating the states of the turntable, carriages and paper cassettes at time $c_2$ during Operation 2 shown in FIGS. 35 and 36.

At time $c_2$, Operation 2 is finished. At this time, as illustrated in FIG. 39, the turntable 200 is turned by an angle of $-\theta$ by the $\theta$-axis driving in order to align the paper center $S_P$ with the paper feeding center line $SL_S$, and is stopped. With regard to the cassette A, the cassette rotation shaft $G_A$ is rotated by an angle of $+\phi_A$ by the $\phi$-axis driving so that the cassette center line $SL_S$ crosses the paper feeding center line $SL_S$ at right angles and that the leading edge of the paper in the feeding direction crosses the paper feeding center line $SL_S$ at right angles. Furthermore, the cassette rotation shaft $G_A$ is moved by a distance of $+r_A$ by the r-axis driving in order to align the leading end of the cassette A in the feeding direction with the cassette leading end setting line H. On the contrary, regarding the cassette B in the non-paper-feeding side, the cassette rotation shaft $G_B$ is rotated by an angle of $+\phi_B$ that is equal to $+\phi_A$ and moved by a distance of $+r_B$ that is shorter than $r_A$.

The following will explain Operation 3.

Figure 40:
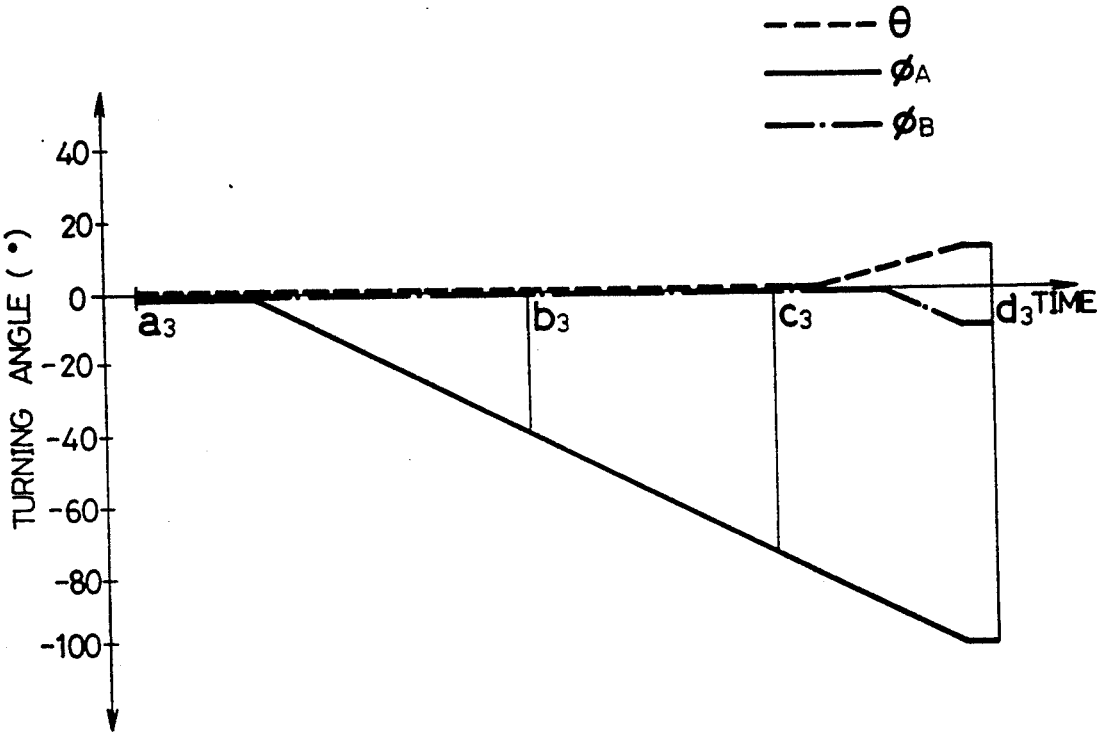
FIG. 40 is a graph illustrating the relations between the turning angle ($\theta$) of the rotation shaft of the turntable and the turning angles ($\phi_A$ and $\phi_B$) of the cassette rotation shafts of the paper cassettes in the paper feeding side and non-paper-feeding side and time during Operation 3 shown in FIG. 24.
Figure 41:
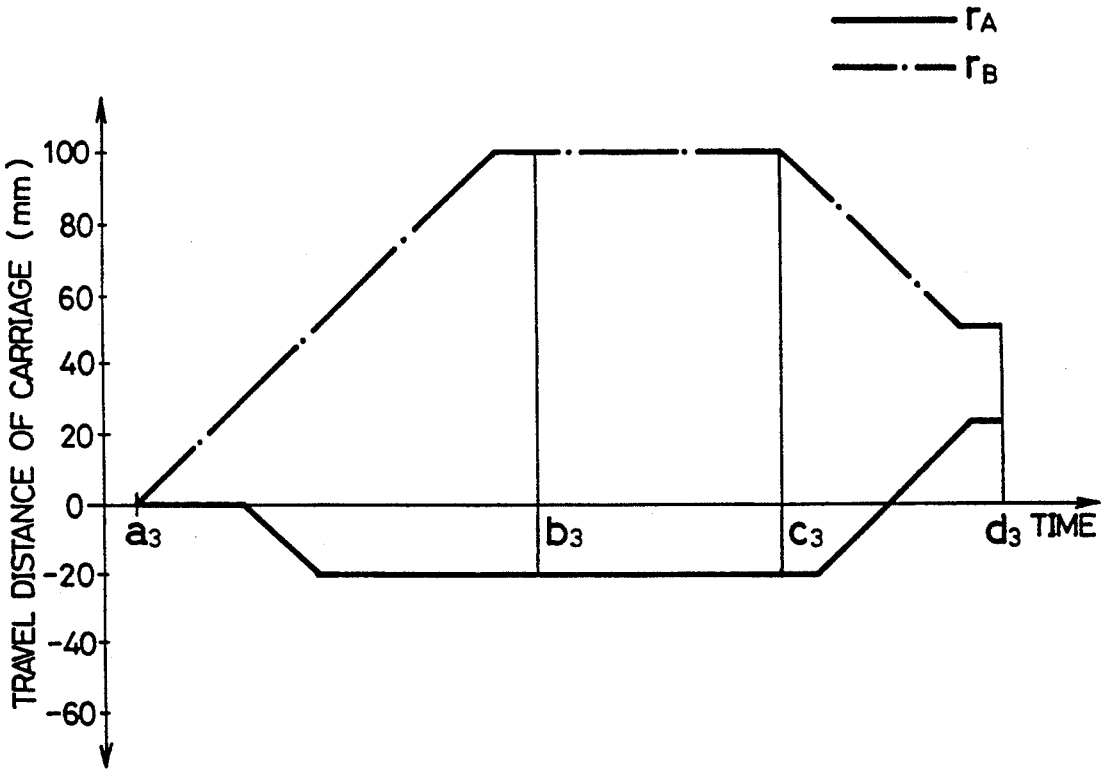
FIG. 41 is a graph illustrating the relations between the travel distances ($r_A$ and $r_B$) of the carriages in the paper feeding side and non-paper-feeding side and time during Operation 3 shown in FIG. 24.
Figure 42:
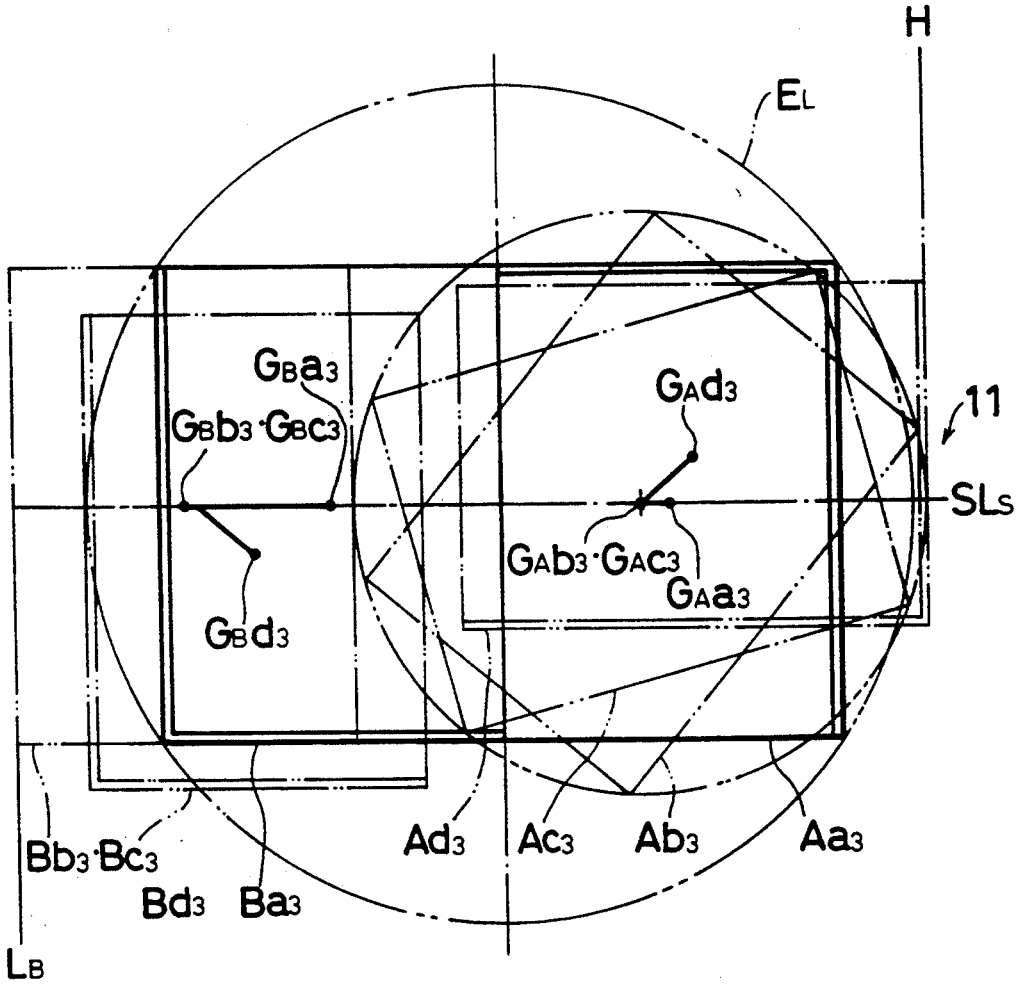
FIG. 42 is an explanatory view illustrating the locations of the cassette rotation shafts and the paper cassettes at time $a_3$ to $d_3$, in relation to the rotation of the turntable's rotation shaft and of the cassette rotation shafts shown in FIG. 40 and the movements of the carriages shown in FIG. 41.

In Operation 3, as described above, after interchanging the places of the paper cassettes 400 in the paper feeding side 11 and in the non-paper-feeding side, the paper cassette 400 in the paper feeding side 11 is positioned for lengthways feeding. During this operation, as illustrated in FIG. 42, the displacement of the cassettes A and B are controlled by the controlling operations shown in FIGS. 40 and 41. Namely, the cassettes A and B are moved from the states $Aa_3$ and $Ba_3$ at start time $a_3$, i.e., they are in the closest proximity as shown with the solid lines so that the cassette A is ready for lengthways feeding and cassette B is in a state $Bd_3$ for sideways feeding according to elapsed time $b_3$, $c_3$ and $d_3$. At this time, the rotation shafts $G_A$ and $G_B$ of the cassettes A and B are also moved to $G_Aa_3$ to $G_Ad_3$ and to $G_Ba_3$ to $G_Bd_3$, respectively.

Figure 43:
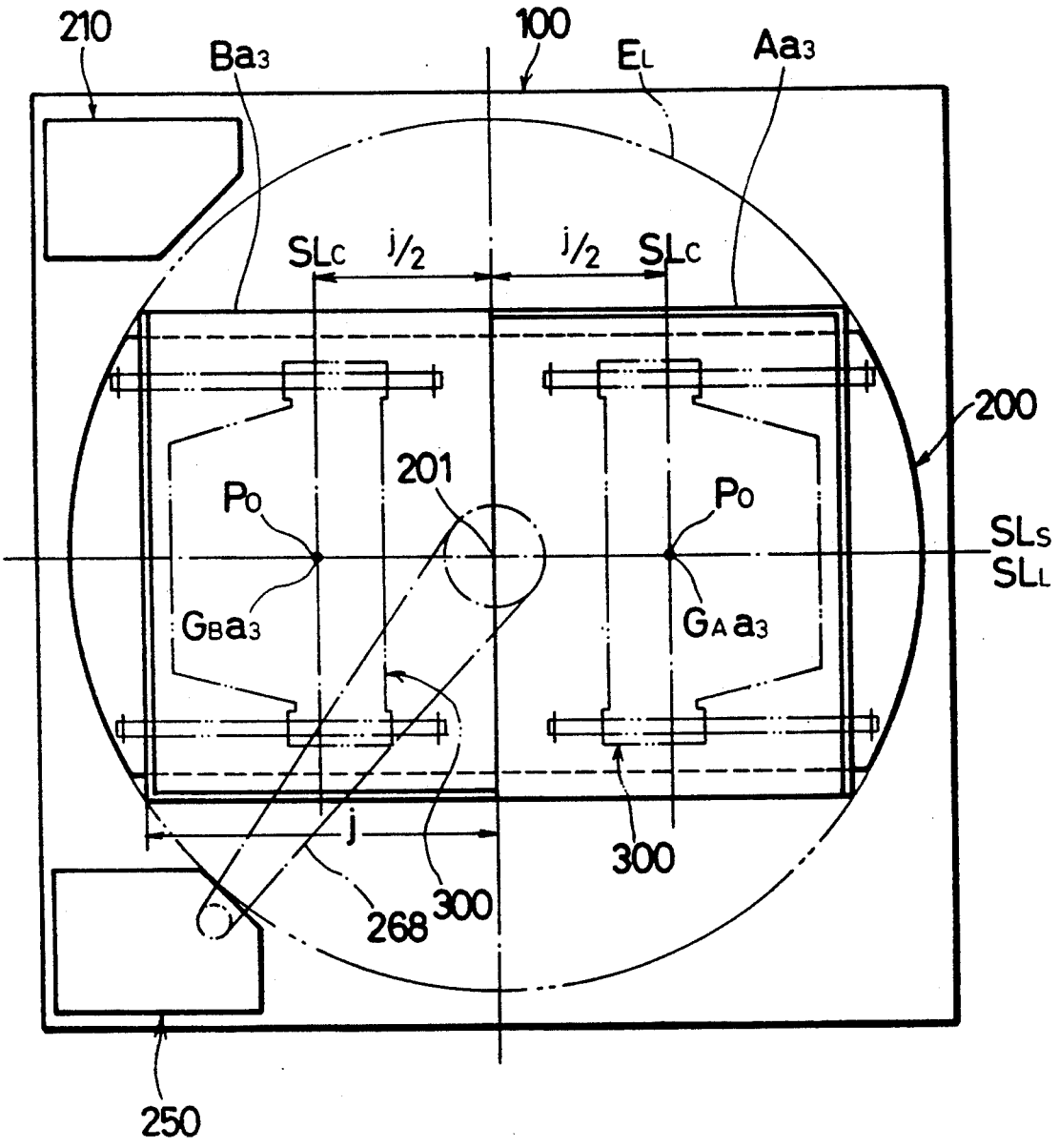
FIG. 43 is an explanatory view illustrating the states of the turntable, carriages and paper cassettes at time $a_3$ during Operation 3 shown in FIGS. 40 and 41.

At time $a_3$, Operation 3 is started. At this time, as illustrated in FIG. 43, the states of the turntable 200 and the cassette B in the non-paper-feeding side are the same states as that at time $a_2$ in Operation 2 shown in FIG. 38.

Figure 44:
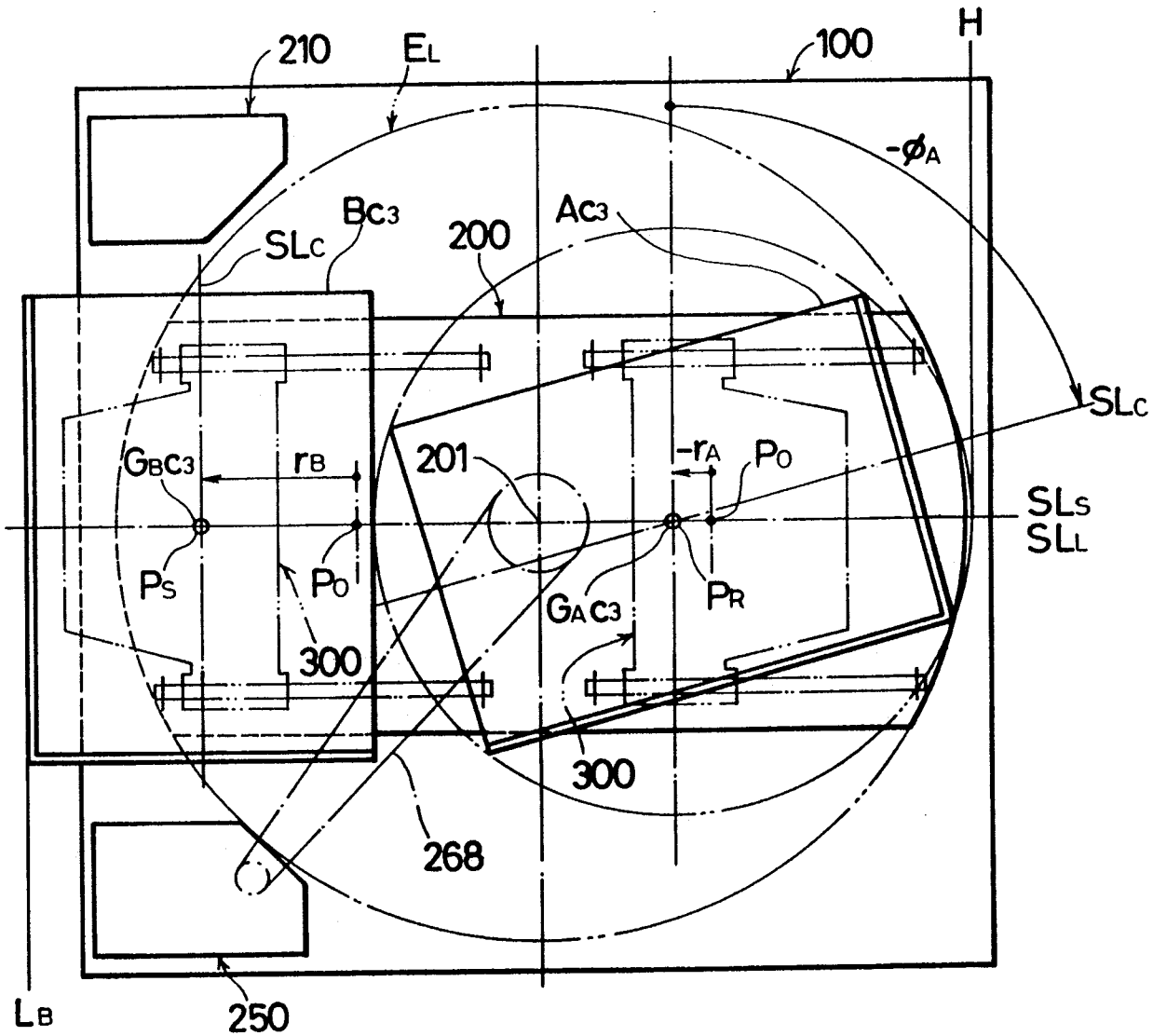
FIG. 44 is an explanatory view illustrating the states of the turntable, carriages and paper cassettes at time $c_3$ during Operation 3 shown in FIGS. 40 and 41.

At time $b_3$, the turntable 200 is still in the stationary state like at time $a_3$. At this time, with regard to the cassette A, the cassette rotation shaft $G_A$ is rotated with a uniform speed toward the negative direction by the $\phi$-axis driving, and is moved by a distance of $-r_A$ from the switching point $P_O$ to the retracted point $P_R$ at which the cassette A is rotated without causing its leading end in the feeding direction to protrude from the cassette leading end setting line H by the r-axis driving. Regarding the cassette B, as illustrated in FIG. 44 showing the states thereof at time $c_3$, the cassette rotation shaft $G_B$ is $\phi_B=0°$, i.e., it is in a stationary state in which its cassette center line $SL_C$ crosses the turntable center line $SL_L$ at right angles and the cassette rotation shaft $G_B$ is stopped at the clearance point $P_S$. The states at time $c_3$ shown in FIG. 44 and time $d_3$ shown in FIG. 44 are the same as that at time $c_1$ and time $d_1$ in Operation 1 shown in FIGS. 33 and 34.

The explanations of Operations 1 to 3 described above show the controlled variable for the case where the cassette A stores B5-sized paper, so the control variable will vary when the cassette A stores paper of a different size.

Figure 46:
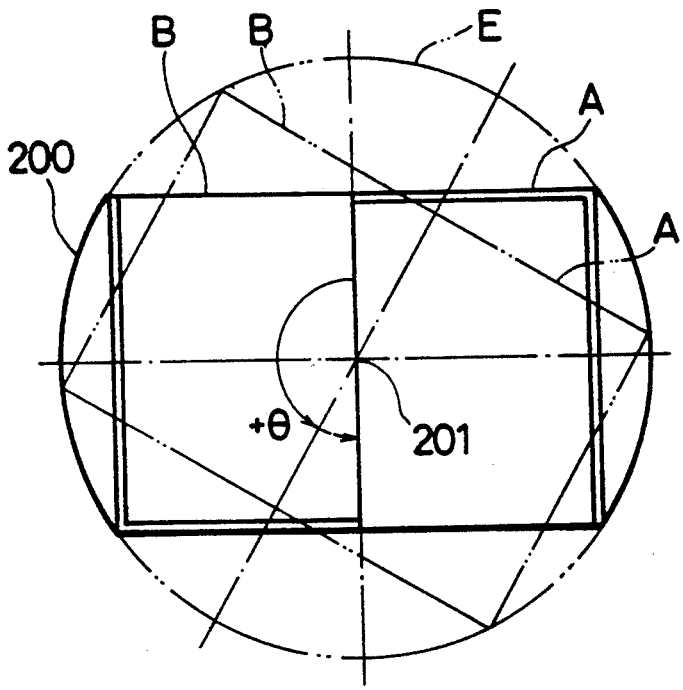
FIG. 46 is a view explaining the rotation of the turntable according to Operation 4 shown in FIG. 24.

As illustrated in FIG. 46, Operation 4 interchanges the places of the paper cassettes 400 in the paper feeding side and in the non-paper-feeding side by rotating the turntable 200 by 180 degrees. The two paper cassettes 400 are placed side by side in the closest proximity of the rotation shaft 201 of the turntable 200, i.e. the cassette rotation shafts 416 are located in the switching points $P_O$. In this state, the turntable 200 is turned. Differently from other operations, Operation 4 is performed independently of the $\theta$-axis driving, $\phi$-axis driving and r-axis driving.

As described above, within the rotatable cassette units 4 and 5 of this embodiment, the two paper cassettes 400, which are disposed on the same level, are interchanged by the rotation of the turntable 200 driven by the 180-degree rotating mechanism 210. Moreover, paper feeding modes are switched between sideways and lengthways by the rotation of the paper cassette 400 driven by the cassette rotating mechanism 410. Therefore, it is possible to feed four types of paper, including sideways and lengthways feeding, within a small space.

In addition, the carriage driving mechanisms 310 move the paper cassettes 400 when the turntable 200 is rotated. And, when the paper cassette 400 in the paper feeding side is rotated, the carriage driving mechanisms 310 move the paper cassette 400 in the non-paper-feeding side to avoid it from interfering with the rotation of paper cassette 400 in the paper feeding side 11 and moves the paper cassette 400 in the paper feeding side 11 to align its leading end in the feeding direction with the cassette leading end setting line H and to prevent it from protruding from the cassette leading end setting line H in the feeding direction, respectively. Furthermore, the rotation of the turntable 200 driven by the small angle rotating mechanism 250 enables the paper center $S_P$ of the paper stored in the paper cassette 400 in the paper feeding side 11 and the paper feeding center line $SL_S$ to come into alignment.

In consequence, it is possible to exclude the small angle rotating mechanism in the following situation: the paper is stored in the paper cassette 400 while aligning its paper center $S_P$ with the cassette rotation shaft 416; an apparatus for aligning the paper center $S_P$ with the paper feeding center line $SL_S$ is provided as well as the rotatable cassette units 4 and 5, or feeding of paper is possible without aligning the paper center $S_P$ with the paper feeding center line $SL_S$. In the case when the movement of the paper cassette 400 driven by the carriage driving mechanisms 310 is unnecessary, it is also possible to exclude the carriage driving mechanisms 310.

Besides, within the rotatable cassette units 4 and 5, in order to make the two rotatable cassette disposed on the same level take a reduced space when their places are interchanged, the following two arrangements are effected. Firstly, when interchanging the places of the paper cassettes 400 in the paper feeding side and non-paper-feeding side by turning the turntable 200, the paper cassettes 400 are disposed side by side in the closest proximity of the rotation shaft 201 of the turntable 200 and then the turntable 200 is turned. Secondly, the cassette B in the non-paper-feeding side is driven in accordance with the motion of the cassette A.

Figure 47:
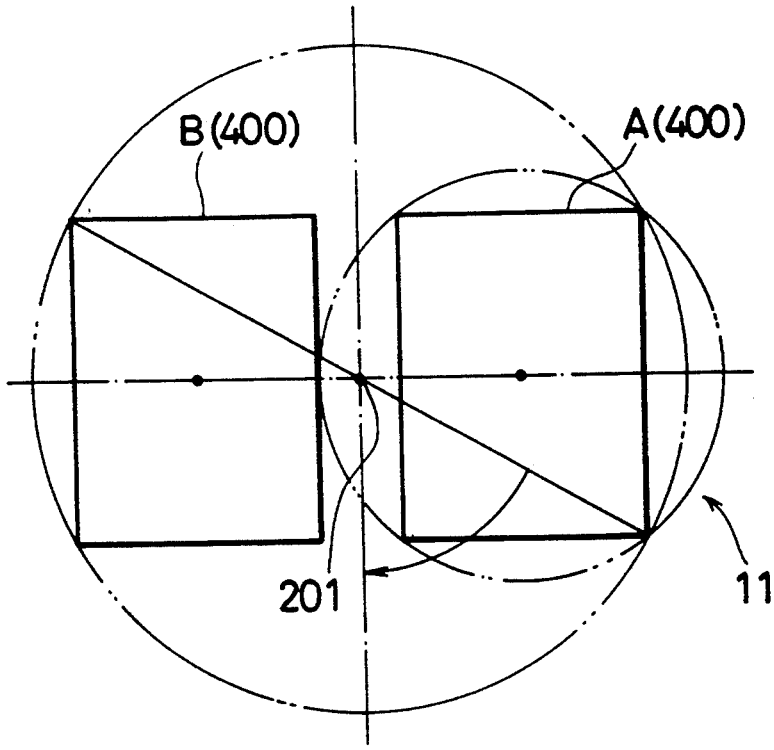
FIG. 47 is a view illustrating the paper cassettes in the paper feeding side and non-paper-feeding side of the rotatable cassette unit shown in FIG. 1, the paper cassette in the paper feeding side being rotatable, and explaining a turning space required by both the paper cassettes when their places are interchanged.
Figure 48:
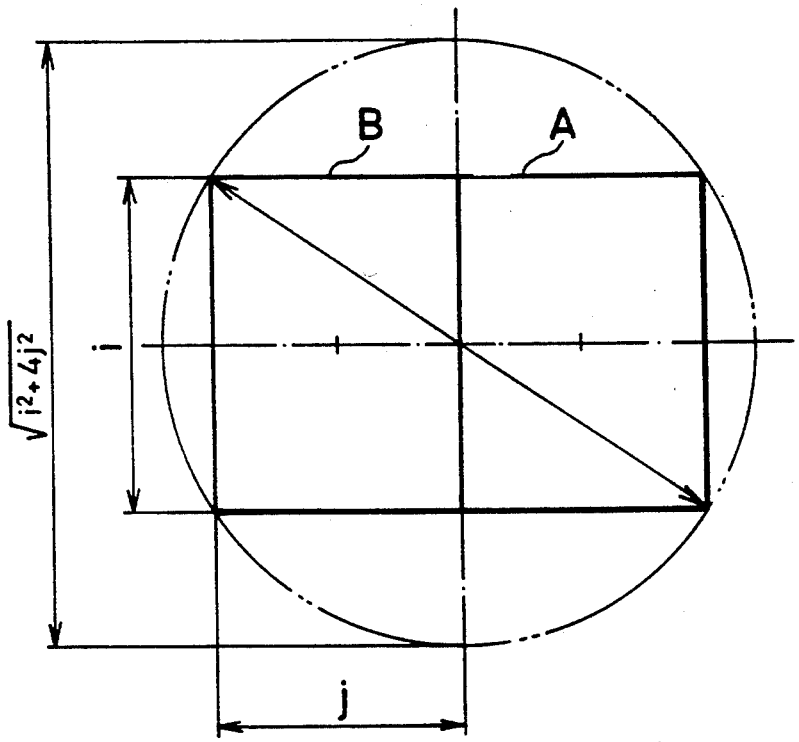
FIG. 48 is a view illustrating the paper cassettes which are disposed in the closest proximity, and explaining a turning space required by both the paper cassettes when their places are interchanged.

Here, the first arrangement will be explained in more detail. For example, as illustrated in FIG. 47, the two paper cassettes 400, i.e., cassettes A and B, are disposed side by side with a space between them, and it is arranged that the paper cassette 400 in the paper feeding side 11 is rotatable. In this state, if the cassettes A and B are rotated to interchange their places, a large turning space is required. So, to reduce the turning space, when interchanging the cassettes A and B, it is arranged in this embodiment that they are disposed as shown in FIG. 48. This arrangement makes it possible to minimize the cassette units 4 and 5.

Figure 49:
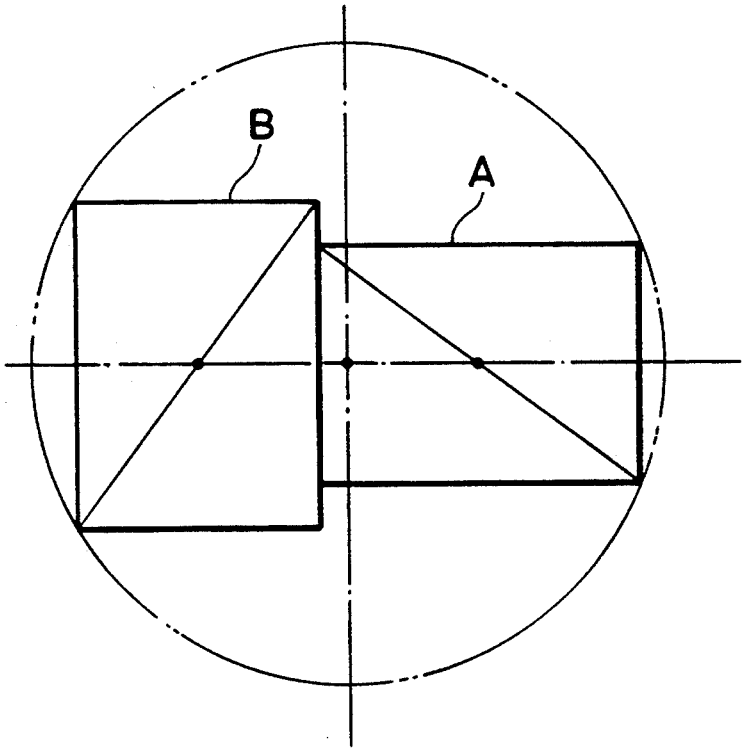
FIG. 49 is a view illustrating the paper cassettes which are disposed in the closest proximity, wherein one of the sides of one paper cassette faces one of the ends of the other cassette, and explaining a turning space required by both the cassettes when their places are interchanged in comparison with FIG. 48.

In FIG. 49 the cassettes A and B are disposed such that one of the ends of the cassette A faces one of the sides of the cassette B. Here, it is arranged that the cassettes A and B are moved to come closer to each other when they are rotated. This enables the turning space is minimized compared to the case when a rotation operation is performed without moving the cassettes A and B to come closer to each other. Thus, in the case when a reduction in the operation time is strongly desired even by excluding a rotating operation of positioning the cassettes A and B side by side, such an arrangement is effective.

Figure 50:
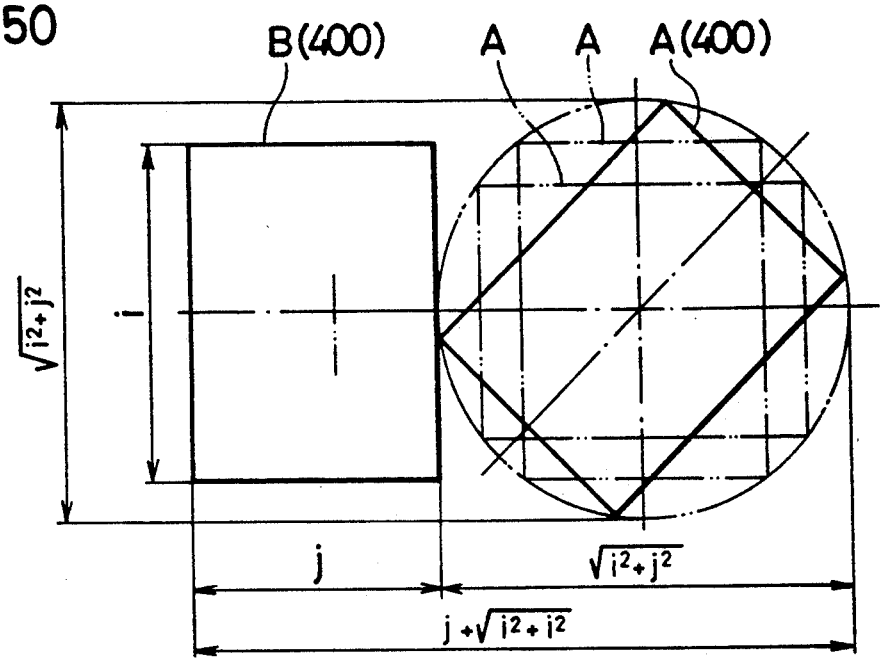
FIG. 50 is a view illustrating the rotatable cassette unit shown in FIG. 1 and explaining spaces required by the paper cassettes in the paper feeding side and non-paper-feeding side when the paper cassette in the paper feeding side is rotated.
Figure 51:
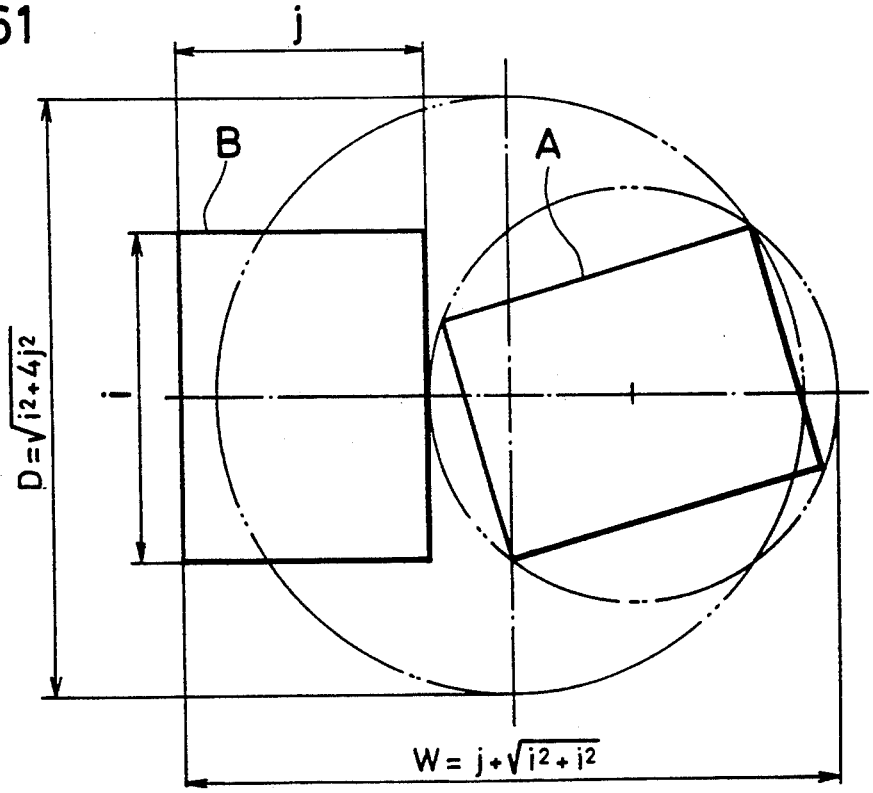
FIG. 51 is an explanatory view illustrating a space that covers both the spaces required by the paper cassettes in the paper feeding side and non-paper-feeding side shown in FIGS. 48 and 50.

In the meantime, regarding the second arrangement, as illustrated in FIG. 50, assuming that the dimensions of the cassettes A and B are i and j respectively, the area of a rectangle $(i^2+j^2)^{\frac{1}{2}} \times \{j+(i^2+j^2)^{\frac{1}{2}}\}$ must be ensured. Moreover, as illustrated in FIG. 48, in order to interchange the cassettes A and B, a circular area with a diameter $(i^2+4j^2)^{\frac{1}{2}}$ must be ensured. Therefore, to meet these two requirements, a space with $(i^2+4j^2)^{\frac{1}{2}}$ in depth and $j+(i^2+4j^2)^{\frac{1}{2}}$ in width must be ensured.

Figure 45:
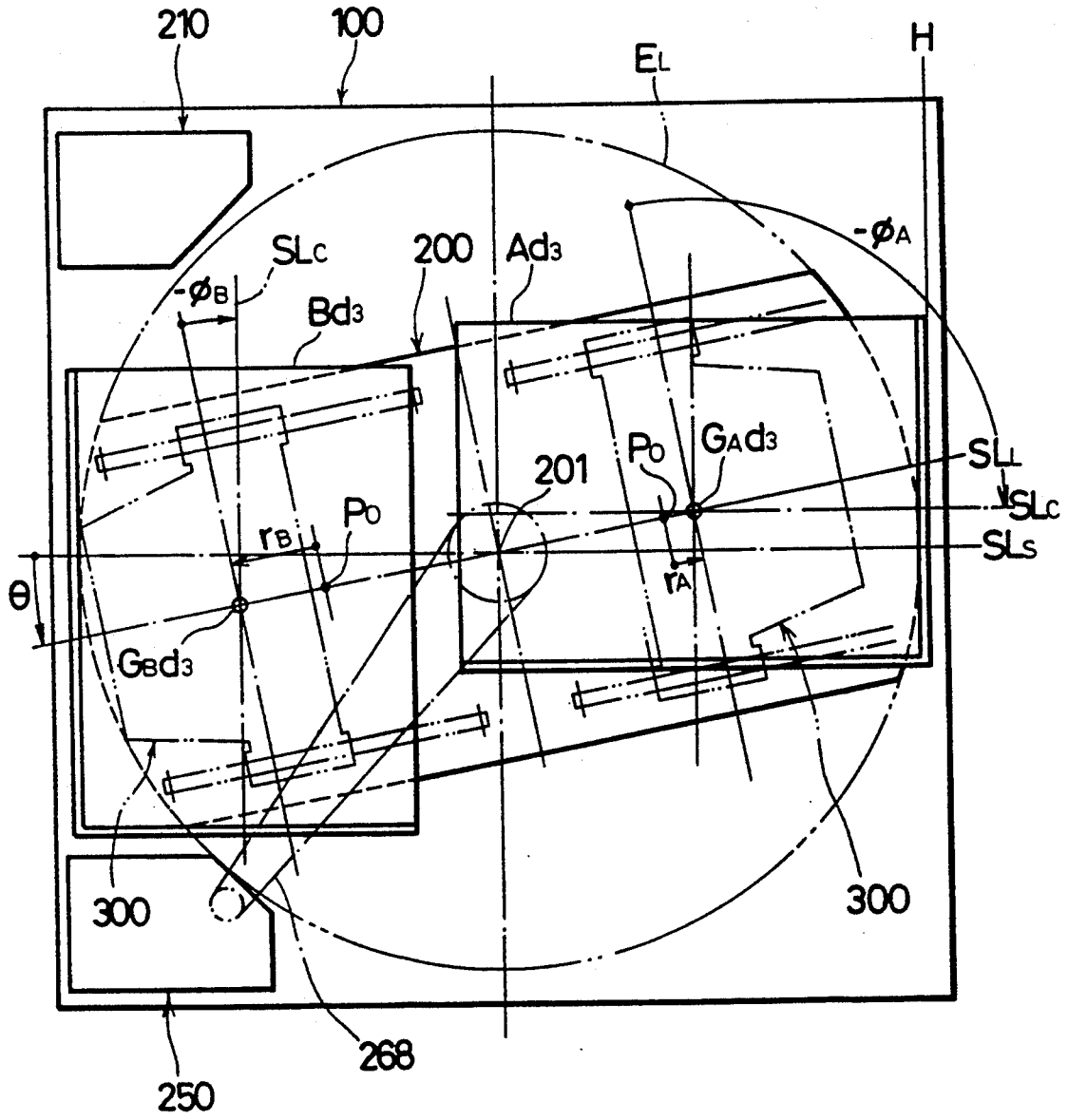
FIG. 45 is an explanatory view illustrating the states of the turntable, carriages and paper cassettes at time $d_3$ during Operation 3 shown in FIGS. 40 and 41.

To reduce the above-mentioned space, the rotatable cassette units 4 and 5 of this embodiment are designed. As illustrated in FIG. 52, the above-mentioned depth and width are adopted in the rotatable cassette units 4 and 5. In this Figure, the cassette A in the paper feeding side 11 is being rotated while the cassette B in the non-paper-feeding side is moved such that one of its longest sides protrudes from the tray 100 and reaches the clearance line $L_B$. In the mean time, when the cassette A is placed in the paper feeding position for sideways feeding or lengthways feeding as illustrated in FIGS. 34, 39 and 45, the cassette B in the non-paper-feeding side is moved from the clearance line $L_B$ toward the feeding direction. Therefore, it is possible to minimize the sizes of the rotatable cassette units 4 and 5 substantially by providing a clearance space, where the cassette B is stayed when the cassette A is rotated, in the housing side of the multi-stage paper feeding device 2. Additionally, even when the cassette B protrudes from the tray 100 at one stage, it goes back to the inside of the tray 100 after the cassette A is rotated. Accordingly, it is possible to pull the rotatable cassette units 4 and 5 out of the housing *2a*.

The clearance space for the cassette B can be easily provided between the supporting rods that support the paper cassette unit 3, rotatable cassette units 4 and 5 and paper tray unit 6 in the housing *2a*.

As for controlling operations of the cassettes A and B, the operation time is shortened by controlling the cassette A to be rotated while being moved and the cassette B to be moved without interfering with the cassette A. On the other hand, in the case when the simplification of the control must take precedence over the shortening of the operation time, for example, the cassette B is moved to the clearance line $L_B$ and the cassette A is then rotated while being moved. In addition, in the case when the cassette A does not have to be retracted to prevent it from protruding from the cassette leading end setting line H during the rotation for avoidance of interference between the cassette A and the paper feeding mechanism of the multi-stage paper feeding device 2, the movement of the cassette A will be excluded.

Within the rotatable cassette units 4 and 5, the cassette rotating mechanisms 410 are controlled to keep the longest sides of the paper cassette 400 in the non-paper-feeding side crossing the paper feeding center line $SL_S$ at right angles during the rotation of the turntable 200 by the 180-degree rotating mechanism 210 and switching of the position of the paper cassette 400 in the paper feeding side 11 between sideways and lengthways. Namely, by controlling the cassette rotating mechanism 410 for rotating the paper cassette 400 in the non-paper-feeding side simply in the same manner during the above-mentioned two operations, control is simplified. Moreover, when the longest sides of the paper cassette 400 in the non-paper-feeding side cross the paper feeding center line $SL_S$, it can be said that the paper cassette 400 is positioned effectively to minimize the turning space of the paper cassettes 400 during the 180-degree turn of the turntable 200 and to prevent it from interfering with the paper cassette 400 in the paper feeding side 11 during the rotation of the paper cassette 400.

In this embodiment, the turntable 200 is rotated by the 180-degree rotating mechanism 210 and small angle rotating mechanism 250. However, it is also possible to integrate the two rotating mechanisms 210 and 250 into a single rotating mechanism, and to control the integrated mechanism in the same manner as that the 180-degree rotating mechanism 210 and small angle rotating mechanism 250 are controlled.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A rotatable cassette-type paper feeding apparatus, comprising:

a tray;

a turning member mounted rotatably on said tray;

first rotating means for rotating said turning member;

a plurality of paper cassettes installed rotatably on said turning member;

second rotating means for rotating said paper cassette located in a paper feeding side; and controller means which controls said first rotating means to interchange said paper cassette in the paper feeding side and said paper cassette in a non-paper-feeding side, and said second rotating means to switch a position of said paper cassette in the paper feeding side between sideways and lengthways.

2. A rotatable cassette-type paper feeding apparatus, comprising:

a tray;

a turning member mounted rotatably on said tray;

first rotating means for rotating said turning member;

a plurality of paper cassettes installed rotatably on said turning member, said paper cassettes being movable in the radial direction of rotation of said turning member;

second rotating means for rotating said paper cassettes respectively;

moving means for moving said paper cassettes respectively in the radial direction of rotation of said turning member; and controller means which controls said moving means and said first rotating means to interchange said paper cassette in a paper feeding side and said paper cassette in a non-paper-feeding side after moving said paper cassettes to positions in the proximity of a rotation axis of said turning member, and said second rotating means to switch a position of said paper cassette in the paper feeding side between sideways and lengthways.

3. The rotatable cassette-type paper feeding apparatus as set forth in claim 2, wherein said controller means is capable of controlling said second rotating means and said moving means to position said paper cassettes side by side in the proximity of the rotation axis of the turning member when said moving means moves said paper cassettes.

4. The rotatable cassette-type paper feeding apparatus as set forth in claim 2, wherein said controller means is capable of controlling said second rotating means and said moving means to move said paper cassette in the non-paper-feeding side in a direction opposite to the rotation axis of said turning member to a clearance position for preventing it from interfering with said paper cassette in the paper feeding side when said second rotating means switches the position of said paper cassette in the paper feeding side between sideways and lengthways, and to move said paper cassette in the non-paper-feeding side from the clearance position toward the rotation axis of said turning member when the rotation of said paper cassette in the paper feeding side is finished.

5. The rotatable cassette-type paper feeding apparatus as set forth in claim 4, wherein said controller means is capable of controlling said second rotating means and said moving means to switch the position of said paper cassette in the paper feeding side between sideways and lengthways without causing it to protrude from a predetermined position toward a paper feeding direction.

6. The rotatable cassette-type paper feeding apparatus as set forth in claim 2, wherein said controller means is capable of controlling said second rotating means to position longest sides of said paper cassette in the non-paper-feeding side at right angles to a paper feeding direction when said first rotating means drives said turning member and when said second rotating member drives said paper cassette in the paper feeding side.

7. The rotatable cassette-type paper feeding apparatus as set forth in claim 2, wherein said controller means is capable of controlling said first rotating means to interchange said paper cassette in the paper feeding side and said paper cassette in the non-paper-feeding side, and said second rotating means and said moving means simultaneously to make said second rotating means and said moving means complete their operations within the same period of time, the operations comprising rotation of said paper cassette in the paper feeding side for switching a position of paper between sideways and lengthways, movement of said paper cassette in the non-paper-feeding side in a direction opposite to the rotation axis for preventing it from interfering with said paper cassette in the paper feeding side and following movement of said paper cassette in the non-paper-feeding side toward the rotation axis of said turning member, and movement of said paper cassette in the paper feeding side to a paper feeding position.

8. A rotatable cassette-type paper feeding apparatus, comprising:

a tray;

a turning member mounted rotatably on said tray;

first rotating means for rotating said turning member;

a plurality of paper cassettes installed rotatably on said turning, member, said paper cassettes being movable in the radial direction of rotation of said turning member;

second rotating means for rotating said paper cassettes respectively; and controller means which controls said first rotating means to interchange said paper cassette in a paper feeding side and said paper cassette in a non-paper-feeding side and to align a paper center of paper stored in said paper cassette in the paper feeding side with a paper feeding center line, and which controls said second rotating means to switch a position of the paper stored in said paper cassette in the paper feeding side between sideways and lengthways and to position the paper stored in said paper cassette in the paper feeding side at right angles to a paper feeding direction.

9. The rotatable cassette-type paper feeding cassette as set forth in claim 8, wherein said controller means is capable of controlling said first rotating means and said second rotating means by programming four controlling operations and combining at least two types of the controlling operations according to a pattern of switching said paper cassettes for placing a selected paper into the paper feeding position sideways or lengthways, the operations comprising:

rotating said paper cassette in the paper feeding side for switching the position of the paper between sideways and lengthways or its reverse operation;

when said paper cassette in the paper feeding side and said paper cassette in the non-paper-feeding side are positioned closely side by side with the rotation axis of said turning member between them, parting said paper cassettes and placing the paper into the paper feeding position without rotating said paper cassette in the paper feeding side for switching the position of the paper between sideways and lengthways or its reverse operation;

when said paper cassette paper feeding side and said paper cassette in the non-paper-feeding side are positioned side by side closely with the rotation axis of said turning member between them, placing the paper in said paper cassette in the paper feeding side into the paper feeding position by parting aid paper cassettes and rotating said paper cassette in the paper feeding side for switching the position of the paper between sideways and lengthways or its reverse operation; and interchanging said paper cassette in the paper feeding side and said paper cassette in the non-paper-feeding side.

10. A rotatable cassette-type paper feeding apparatus, comprising:

a tray;

a turning member mounted rotatably on said tray;

first rotating means for rotating said turning member;

a plurality of paper cassettes installed rotatably on said turning member, said paper cassettes being movable in the radial direction of rotation of said turning member;

second rotating means for rotating said paper cassettes respectively;

moving means for moving said paper cassettes respectively in the radial direction of rotation of said turning member; and controller means which controls said first rotating means to interchange said paper cassette in a paper feeding side and said paper cassette in a non-paper-feeding side and to align a paper center of paper stored in said paper cassette in the paper feeding side with a paper feeding center line, which controls said second rotating means to switch a position of the paper stored in said paper cassette in the paper feeding side between sideways and lengthways and to position the paper stored in said paper cassette in the paper feeding side at right angles to the paper feeding direction, and which controls said moving means to move said paper cassette in the paper feeding side to a paper feeding position.

11. The rotatable cassette-type paper feeding cassette as set forth in claim 8 or 10, wherein said controller means is capable of controlling said first rotating means, said second rotating means and said moving means by programming four controlling operations and combining at least two types of the controlling operations according to a pattern of switching said paper cassettes for placing a selected paper into the paper feeding position sideways or lengthways, the operations comprising:

rotating said paper cassette in the paper feeding side for switching the position of the paper between sideways and lengthways or its reverse operation;

when said paper cassette in the paper feeding side and said paper cassette in the non-paper-feeding side are positioned closely side by side with the rotation axis of said turning member between them, parting said paper cassettes and placing the paper into the paper feeding position without rotating said paper cassette in the paper feeding side for switching the position of the paper between sideways and lengthways or its reverse operation;

when said paper cassette in the paper feeding side and said paper cassette in the non-paper-feeding side are positioned side by side closely with the rotation axis of said turning member between them, placing the paper in said paper cassette in the paper feeding side into the paper feeding position by parting said paper cassettes and rotating said paper cassette in the paper feeding side for switching the position of the paper between sideways and lengthways or its reverse operation; and interchanging said paper cassette in the paper feeding side and said paper cassette in the non-paper-feeding side.

12. The rotatable cassette-type paper feeding apparatus as set forth in claim 11, wherein said first rotating means includes high-speed rotating means for rotating said turning member at high speeds for interchanging said paper cassette in the paper feeding side and said paper cassette in the non-paper-feeding side, and low-speed rotating means for rotating said turning member at low speeds for aligning the center of the paper in said paper cassette in the paper feeding side with the paper feeding center line.

13. The rotatable cassette-type paper feeding apparatus as set forth in claim 12, wherein said first rotating means is mounted on a portion of said tray outside of the turning space of said turning member, said first rotating means and said turning member being mounted on the substantially same level.

14. The rotatable cassette-type paper feeding apparatus as set forth in claim 8 or 10, wherein said first rotating means includes high-speed rotating means for rotating said turning member at high speeds for interchanging said paper cassette in the paper feeding side and said paper cassette in the non-paper-feeding side, and low-speed rotating means for rotating said turning member at low speeds for aligning the center of the paper in said paper cassette in the paper feeding side with the paper feeding center line.

15. The rotatable cassette-type paper feeding apparatus as set forth in claim 1, 2, 3, 4, 5, 6, 7, 8 or 10, wherein said first rotating means is mounted on a portion of said tray outside of the turning space of said turning member, said first rotating means and said turning member being mounted on the substantially same level.

16. The rotatable cassette-type paper feeding apparatus as set forth in claim 2, 3, 4, 5, 6, 7 or 10, wherein said second rotating means and said moving means are attached to said turning member.

* * * * *